US006183945B1

(12) United States Patent
Sato et al.

(10) Patent No.: US 6,183,945 B1
(45) Date of Patent: Feb. 6, 2001

(54) SILVER HALIDE PHOTOGRAPHIC LIGHT SENSITIVE MATERIAL AND IMAGE FORMING METHOD USING THEREOF

(75) Inventors: Hirokazu Sato; Takeshi Hakii, both of Hino (JP)

(73) Assignee: Konica Corporation (JP)

( * ) Notice: Under 35 U.S.C. 154(b), the term of this patent shall be extended for 0 days.

(21) Appl. No.: 09/409,772

(22) Filed: Sep. 30, 1999

(30) Foreign Application Priority Data

Nov. 9, 1998 (JP) ..... 10-317721

(51) Int. Cl.[7] ..... G03C 1/73
(52) U.S. Cl. ..... 430/543; 430/555; 430/558
(58) Field of Search ..... 430/543, 555, 430/558

(56) References Cited

U.S. PATENT DOCUMENTS 5,219,716 * 6/1993 Takada et al. ..... 430/389
5,409,808 * 4/1995 Mizukawa et al. ..... 430/558
5,925,503 * 7/1999 Harder et al. ..... 430/387
5,972,574 * 10/1999 Fischer et al. ..... 430/387

FOREIGN PATENT DOCUMENTS 0660177 6/1995 (EP) .
0844526 5/1998 (EP) .

* cited by examiner

*Primary Examiner*—Hoa Van Le
(74) *Attorney, Agent, or Firm*—Jordan B. Bierman; Bierman, Muserlian and Lucas

(57) ABSTRACT

In a silver halide photographic light sensitive material having at least one emulsion layer provided on a support, a silver halide photographic light sensitive material characterized in that at least one of the silver halide emulsion layer comprises a magenta dye forming coupler represented by a formula (M-1) or (M-1') described below, and a molar ratio MA/MC of silver halide and the magenta dye forming coupler in the silver halide emulsion layer containing the magenta dye forming coupler is 3.1 to 3.7 wherein MA is mols per unit area of silver halide in the silver halide emulsion layer, and MC is mols per unit area of the magenta dye forming coupler in the silver halide emulsion layer.

6 Claims, 3 Drawing Sheets

SILVER HALIDE PHOTOGRAPHIC LIGHT SENSITIVE MATERIAL AND IMAGE FORMING METHOD USING THEREOF

BACKGROUND OF THE INVENTION

The present invention relates to a silver halide photographic light sensitive material (hereafter abbreviated as light sensitive material) and an image forming method employing thereof, particularly to a light sensitive material having excellent in fastness of obtained dye image, stability of the image, stability of characteristics after storage, adaptability to rapid processing, and stability of characteristics in case of rapid processing, and the image forming method thereof.

A silver halide photographic light sensitive material has been employed as a material to provide a high quality image with stable quality and low cost. Request for high quality and stable quality by the user is demanded more and more. With reference to the request for high image quality, improvement of color reproduction, reproduction of gradation and sharpness etc. is requested. As for the stable quality, it is necessary to improve stability in manufacturing, fastness during long time storage as unexposed status and characteristics change depending processing condition. Further, high fastness of the obtained image.

In response to the request for high image quality, in recent years, pyrazolotriazole type magenta dye forming coupler has been employed to improve color reproduction. The pyrazolotriazole type magenta dye forming coupler has a problem as the dye produce from the coupler is unfavorable in fastness against light. Improvement has been investigated in both of coupler and dye image stabilizer, for example, a pyrazolotriazole type magenta coupler substituted by secondary or tertiary alkyl etc. disclosed in to Japanese Patent O.P.I. Publication Nos. 61-65245, 61-120146, 61-120147, 61-120148, 61-120149, 61-120150 and 61-120151; a phenol or a phenylether compounds disclosed in Japanese Patent O.P.I. Publication Nos. 56-159644, 59-125732, 61-145552, 60-262159 and 61-90155; amine compounds disclosed in Japanese Patent O.P.I. Publication Nos. 61-73152, 61-72246, 61-189539, 61-189540 and 63-95439 are listed.

However problems arise by employing these techniques, for example, deterioration of film property of photographic composing layer because of increase of oil-soluble component in the layer, deterioration of image quality when stored for long time, increasing fluctuation of photographic property such as sensitivity, gradation and fog caused by storage of unexposed light sensitive material, since the structure of the dye forming coupler is complicated and the molecular weight is large, and large amount of oil-soluble additive must be employed. While it is effective in improving these problems to increase an amount of gelatin as employed binder of the photographic constitution layer, it also derives the lowering the development processing speed, contrary to demand for rapid processing property.

For a photographic light sensitive material such as color paper, particularly employed in direct appreciation it is desired to see a print picture of stable quality immediately, and therefore rapid processing of development processing and reducing quality fluctuation dependent on development processing.

For this purpose, a method making the shape of development tank to slit type, a method of coating or spraying developing processing composition to a surface of the light sensitive material or method heating the light sensitive material just before the development processing. Theses methods are effective in rapid processing and reducing fluctuation depending of change of developing condition, however, it has been made clear that fluctuation of characteristics such as sensitivity and fog increases caused by storage before exposure in case that the light sensitive material employing the pyrazolotriazole type magenta dye forming coupler.

SUMMARY OF THE INVENTION

The present invention has been made in consideration the situation mentioned above, and the object of the invention is to provide a silver halide photographic light sensitive material which is excellent in color reproduction and improved in image storability, particularly image stability under the light exposure. The other object is to provide a silver halide photographic light sensitive material which is improved in stable quality such as stability of characteristics stored before exposure and stability against fluctuation caused by change of processing condition, and an image forming method using it. The further object is to provide a silver halide photographic light sensitive material excellent in adaptability to rapid processing and an image forming method using it.

The silver halide photographic light sensitive material and an image forming method using it, and embodiments thereof are described below.

A silver halide photographic light sensitive material having an emulsion layer containing a yellow dye forming coupler, an emulsion layer containing a magenta dye forming coupler and an emulsion layer containing a cyan dye forming coupler provided on a support, wherein the magenta dye forming coupler is represented by formula (M-1) or (M-1'), and the yellow dye forming coupler is represented by formula (Y-1), (M-1)

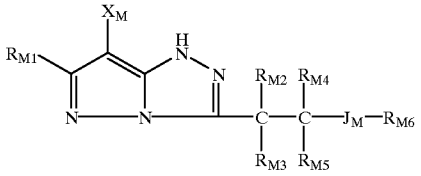

(M-1')

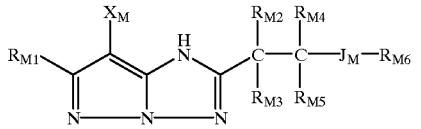

wherein $R_{M1}$ represents a hydrogen atom or a substituent, $R_{M2}$ and $R_{M3}$ represent an alkyl group, and $R_{M4}$ and $R_{M5}$ represent a hydrogen atom or alkyl group. $J_M$ represents —O—C(=O)—, —$NR_{M7}CO$— or —$NR_{M7}SO_2$—, and $R_{M7}$ represents a hydrogen atom or alkyl group. $R_{M6}$ represents an alkyl, aryl, alkoxy, aryloxy, alkylamino or arylamino group. $X_M$ represent a hydrogen atom, halogen atom or a group capable of splitting off by reaction with oxidation product of color developing agent, (Y-1)

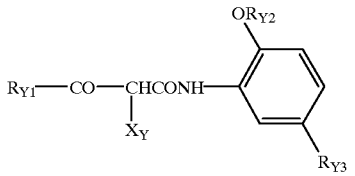

wherein $R_{Y1}$ represents an aliphatic group or an aromatic group, $R_{Y2}$ represents a non-diffusable aliphatic or aromatic group, $R_{Y3}$ represents halogen atom. $X_Y$ represents a 5- or 6-member nitrogen containing heterocyclic group splitting off when coupled with an oxidation product of a developing agent.

The emulsion layer containing a yellow dye forming coupler preferably comprises a water-insoluble and organic solvent-soluble polymer.

The number average molecular weight is preferably not more than 200,000, and more preferably 5,000 to 100,000.

The emulsion layer containing a yellow dye forming coupler preferably comprises a compound represented by a formula (A-1), (A-1)

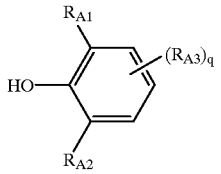

wherein $R_{A1}$ represents a secondary or tertiary alkyl group, $R_{A2}$ represents an alkyl group, $R_{A3}$ represents a group capable of substituting to the benzene ring, q is an integer of 0 to 3, and plural of $R_{A3}$ may be the same or different when q is 2 or more.

In the silver halide photographic light sensitive material a molar ratio MA/MC of silver halide and the magenta dye forming coupler in the silver halide emulsion layer containing the magenta dye forming coupler is preferably 3.1 to 3.7 wherein MA is mols per unit area of silver halide in the silver halide emulsion layer, and MC is mols per unit area of the magenta dye forming coupler in the silver halide emulsion layer.

In another embodiment of the invention, a silver halide photographic light sensitive material having at least one emulsion layer provided on a support, wherein the silver halide emulsion layer comprises a magenta dye forming coupler represented by a formula (M-1) or (M-1'), and a molar ratio MA/MC of silver halide and the magenta dye forming coupler in the silver halide emulsion layer containing the magenta dye forming coupler is 3.1 to 3.7 wherein MA is mols per unit area of silver halide in the silver halide emulsion layer, and MC is mols per unit area of the magenta dye forming coupler in the silver halide emulsion layer.

An image forming method of development processing a silver halide photographic light sensitive material having at least one emulsion layer provided on a support, the image forming method characterized in that at least one of the silver halide emulsion in the silver halide photographic light sensitive material comprises a magenta dye forming coupler represented by a formula (M-1) or (M-1') wherein processing composition is coated on the silver halide photographic light sensitive material The processing composition is preferably coated by direct or indirect coating or coating through air phase.

In one of the image forming method the processing composition is coated by roller coating or slit extrusion coating.

One example of the coating through air phase is spray form.

The processing composition is preferably composed of two components. In this case as one of the preferable example, the first component contains a developing agent and the second component contains alkali agent.

The silver halide photographic light sensitive material is preferably heated not less than 40° C. before development processing.

BRIEF DESCRIPTION OF DRAWING

FIG. 4 Sectional view of another example of a coater head having slit.

DETAILED DESCRIPTION OF THE INVENTION

Figure 1:
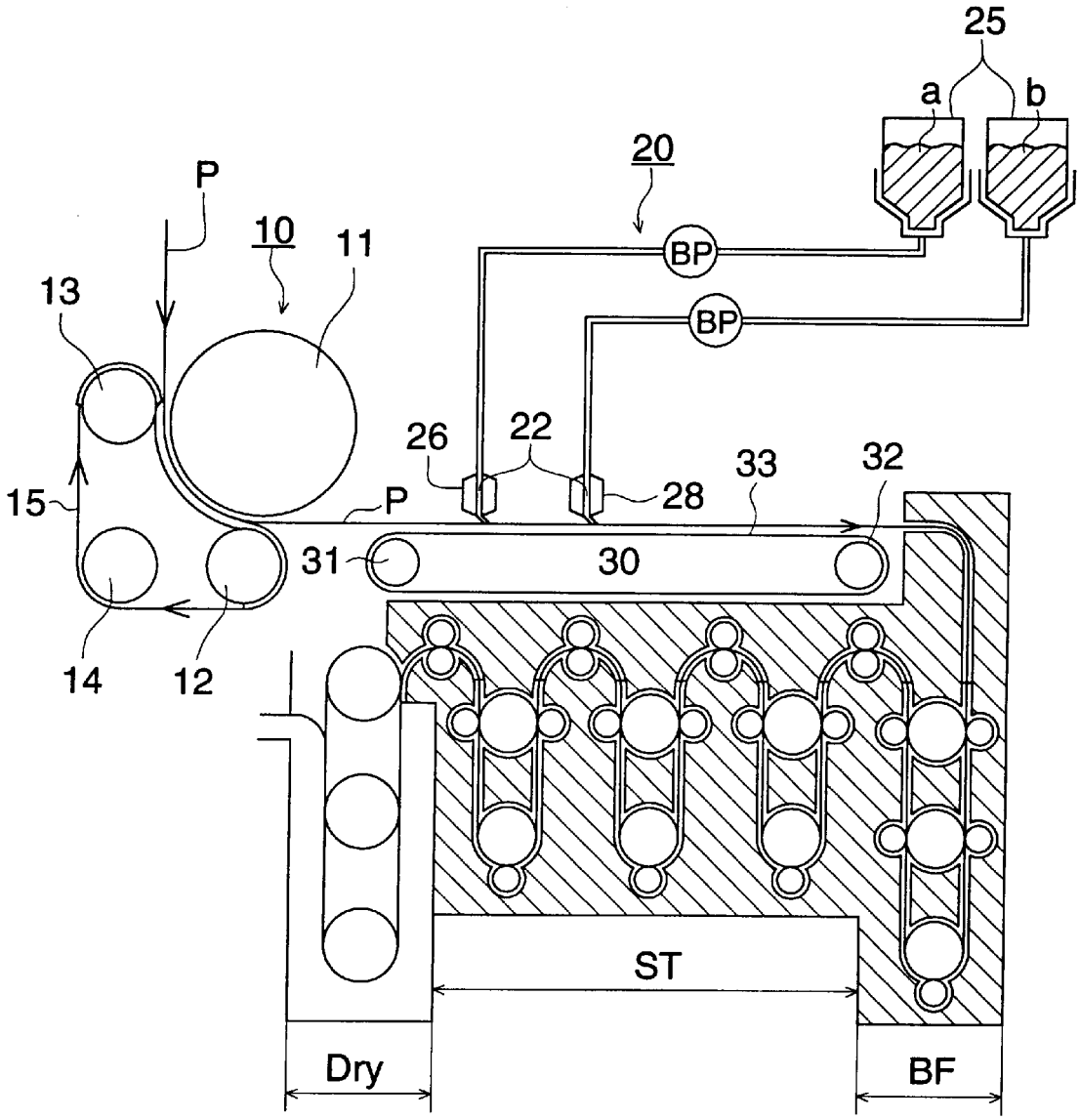
FIG. 1 Schematic view of outline of primary part of developing machine employed in Example 3.

The present invention is described in detail.

A magenta dye forming coupler (hereafter it may be also abbreviated as a magenta coupler) represented by formula (M-1) or (M-1') according to the invention will be explained as below.

In the formula (M-1) or (M-1') examples of the substituent represented by $R_{M1}$ includes an alkyl group (e.g., methyl, ethyl, propyl, isopropyl, tert-butyl, pentyl, cyclopentyl, hexyl, cyclohexyl, hexyl, cyclohexyl, octyl, dodecyl), alkenyl group (e.g., vinyl, allyl), alkynyl group (e.g., propargyl), aryl group (e.g., phenyl, naphthyl), heterocyclic group (e.g., pyridyl, thiazolyl, oxazolyl, imidazolyl, furyl, pyrrolyl, pyrazinyl, pyrimidinyl, selenazolyl, sulfolanyl, piperidinyl, pyrazolyl, tetrazolyl), halogen atom (e.g., chlorine atom, bromine atom, iodine atom, fluorine atom), alkoxy group (e.g., methoxy, ethoxy, propyloxy, pentyloxy, cyclopentyloxy, hexyloxy, cyclohexyloxy, octyloxy, dodecyloxy), aryloxy group (e.g., phenoxy, naphthyloxy), alkoxycarbonyl group (e.g., methyloxycarbonyl, ethyloxycarbonyl, butyloxycarbonyl, octyloxycarbonyl, dodecyloxycarbonyl), aryloxycarbonyl group (e.g., phenyloxycarbonyl, naphthyloxycarbonyl), sulfonamido group (e.g., methylsulfonylamino, ethylsulfonylamino, butylsulfonylamino, hexylsulfonylamino, cyclohexylsulfonylamino, octylsulfonylamino, dodecylsulfonylamino, phenylsulfonylamino), sulfamoyl group (e.g., aminosulfonyl, methylaminosulfonyl, dimethylaminosulfonyl, butylaminosulfonyl, hexylaminosulfonyl, cyclohexylaminosulfonyl, octylaminosulfonyl, dodecyaminosulfonyl, phenylaminosulfonyl, naphthylaminosulfonyl, 2-pyridylaminosulfonyl), ureido group (e.g., methylureido, ethylureido, pentylureido, cyclohexylureido, octylureido, dodecylureido, phenylureido, naphthylureido, 2-pyridylaminoureido), acyl group (e.g., acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl), acyloxy group (e.g. acetyloxy, ethylcarbonyloxy, butylcarbonyloxy, octylcarbonyloxy, dodecylcarbonyloxy, phenylcarbonyloxy), carbamoyl group (e.g., aminocarbonyl, methylaminocarbonyl, dimethylaminocarbonyl, propylaminocarbonyl, pentylaminocarbonyl, cyclohexylaminocarbonyl, octylamino-carbonyl, 2-ethylhexylaminocarbonyl, dodecylaminocarbonyl, phenylaminocarbonyl, naphthylaminocarbonyl, 2-pyridylaminocarbonyl), amido group (e.g., methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), sulfonyl group (e.g., methylsulfonyl, ethylsulfonyl, butylsulfonyl, cyclohexylsulfonyl, 2-ethylhexylsulfonyl, dodecylsulfonyl, phenylsulfonyl, naphthylsulfonyl, 2-pyridylsulfonyl), amino group (e.g., amino, ethylamino, dimethylamino, butylamino, cyclopentylamino, 2-ethylkhexylamino, dodecylamino, anilino, naphtylamino, 2-pyridylamino), cyano group, nitro group, sulfo group, carboxyl group, and hydroxyl group. These groups may be substituted by the substituent described above. Of these groups are preferred the alkyl group, cycloalkyl group, alkenyl group, aryl group, acylamino group, sulfonamido group, alkylthio group, arylthio group, halogen atom, heterocyclic group, sulfonyl group, sulfinyl group, phosphonyl group, acyl group, carbamoyl group, sulfamoyl group, cyano group, alkoxy group, aryloxy group, acyloxy group, carbamoyloxy group, amino group, alkylamino group, ureido group, alkoxycarbonyl, aryloxycarbonyl and carboxyl; an alkyl group is more preferred and t-butyl group is furthermore preferred.

In the formulas of (M-1) and (M-1') mentioned above, example of alkyl group represented by $R_{M2}$ to $R_{M5}$ and $R_{M7}$, is alkyl group of straight chain or branched chain such as methyl group, ethyl group, i-propyl group, t-butyl group, 2-ethylhexyl group, dodecyl group, and 1-hexyl nonyl group. These groups may be substituted by a group listed as substituent represented by $R_{M1}$ mentioned above furthermore. Methyl group is preferable as the alkyl group represented by $R_{M2}$ and $R_{M3}$. As for $R_{M7}$, a hydrogen atom is preferable.

Examples of the alkyl group, aryl, alkoxy group, aryloxy group, and alkylamino group represented by $R_{M6}$ in the formulas of (M-1) and (M-1') mentioned above are listed the same group as the alkyl group, aryl, alkoxy group, aryloxy group, alkylamino group and arylamino group and arylamino group for $R_{M1}$ mentioned above.

Examples of the halogen atom represented by $X_M$ include chlorine atom, bromine atom, and fluorine atom, and, as the group splitting off on reaction with oxidation product of color developing agent includes each group such as alkoxy, aryloxy, heterocyclicoxy, acyloxy, sulfonyloxy, alkoxycarbonylkoxy, aryloxycarbonyloxy, alkyloxalyloxy, alkoxyoxaluloxy, alkylthio, arylthio, heterocyclicthio, alkyloxythiocarbonylthio, acylamino, sulfonamide, nitrogen-containing heterocycle which bonded with N atom, alkyloxycarbonyl amino, aryloxy carbonylamino, and carboxyl. Preferable example is halogen atom, and in particular chlorine atom.

Among the magenta dye forming coupler represented by the formula (M-1) or (M-1') (M-1) mentioned above the preferable example is that represented by formula (M-1). Examples employed particularly preferably are represented by following formula (M-2).

(M-2)

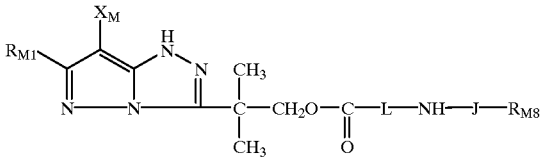

In the formula, $R_{M1}$ and $X_M$ are the same as $R_{M1}$ and $X_M$ in a formula (M-1) mentioned above. $R_{M8}$ represents alkyl group, cycloalkyl group or aryl group each of which may be substituted or non-substituted. L represents alkylene group which may be substituted or non-substituted, and J represents —(C═O)— or —(O═S═O).

In a formula (M-2) mentioned above $R_{M8}$ represents alkyl group, cycloalkyl group or aryl group each of which may be substituted or non-substituted.

As for the alkyl group represented by $R_{M8}$, those of carbon atom number 1-32 are preferable, and the representative example includes methyl group, ethyl group, propyl group, isopropyl group, t-butyl group, hexyl group, octyl group, dodecyl group, hexadecyl group, and 2-ethylhexyl group.

When alkyl group represented by $R_{M8}$ has a substituent, the substituent can be the same group as $R_{M1}$ in a formula (M-1) mentioned above.

As for the cycloalkyl group represented by $R_{M8}$, those having carbon atom number 3-12 is preferable, and the representative example includes cyclopropyl group, cyclopentyl group, cyclohexyl group, 2-methylcyclopropyl group, adamanthyl group.

When the cycloalkyl group represented by $R_{M8}$ has a substituent, the substituent can be the same group as $R_{M1}$ in a formula (M-1) mentioned above.

As for the aryl group represented by $R_{M8}$, those having carbon atom number 6-14 is preferable, and the representative example includes phenyl group, l-naphthyl group, and 2-naphthyl group.

When the aryl group represented by $R_{M8}$ has a substituent, the substituent can be the same group as $R_{M1}$ in a formula (M-1) mentioned above.

In a formula (M-2) mentioned above, L represents alkylene group which may be substituted or non-substituted.

The alkylene group represented by L includes methylene group, ethylene group, trimethylene group, and tetramethylene group.

In case that the alkylene group represented by L has a substituent, the substituent is cited the same one as described in $R_{M1}$ in the formula (M-I).

Examples of an alkylene group represented by L are shown as below.

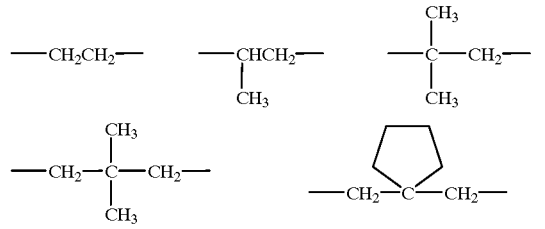

-continued
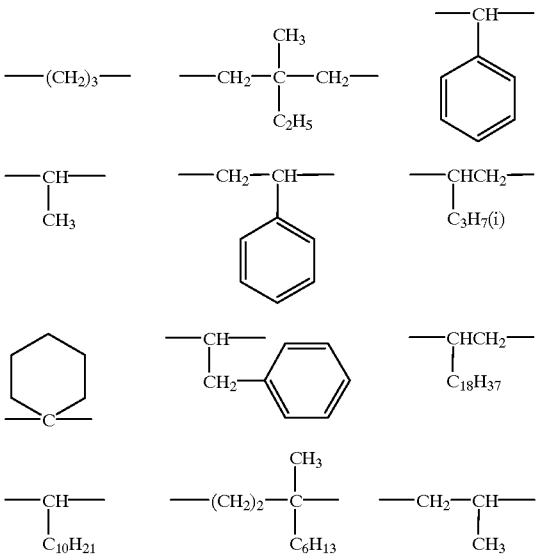
-continued
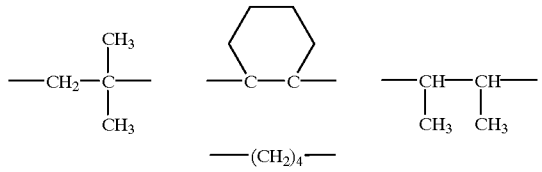
In the formula (M-2) L is preferably an ethylene group which may have a substituent, and more preferably a non-substituted ethylene group.
In the formula (M-2) J represents a group of —(C═O)— or —(O═S═O)—.
Examples of the magenta dye forming coupler represented by formula (M-I) or (M-1') are shown below.
M-1
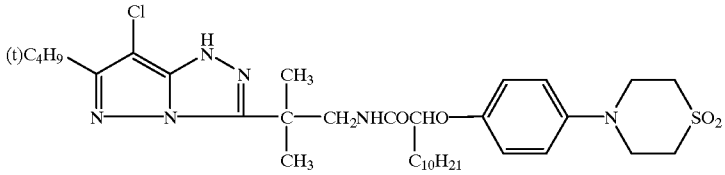
M-2
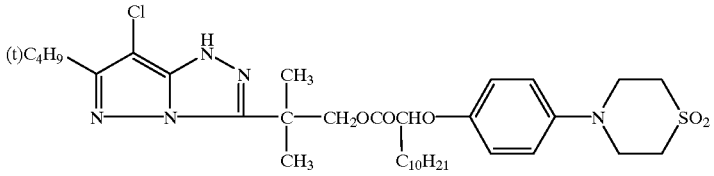
M-3
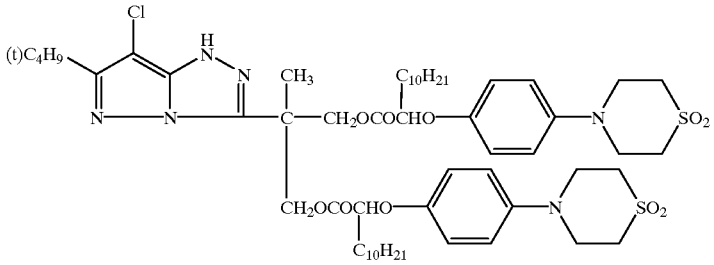
M-4
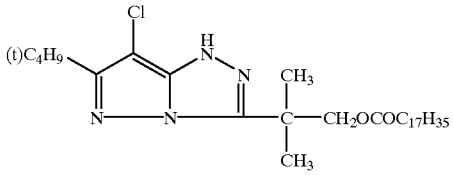

-continued
M-5
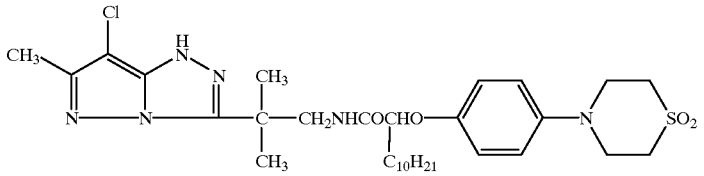
M-6
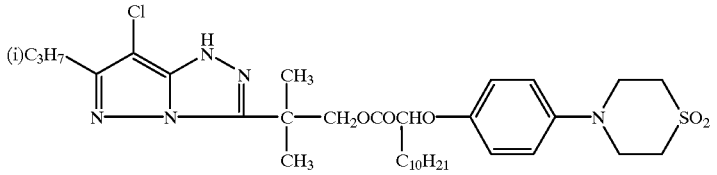
M-7
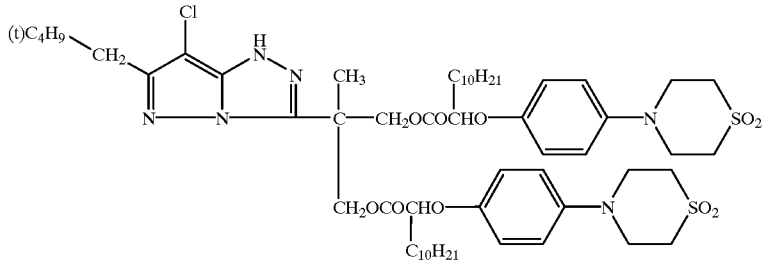
M-8
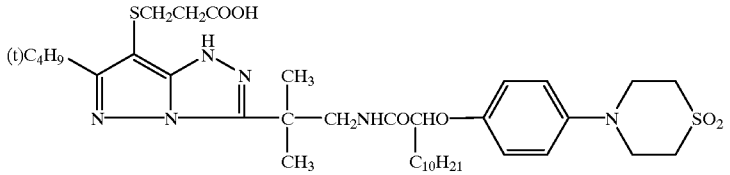
M-9
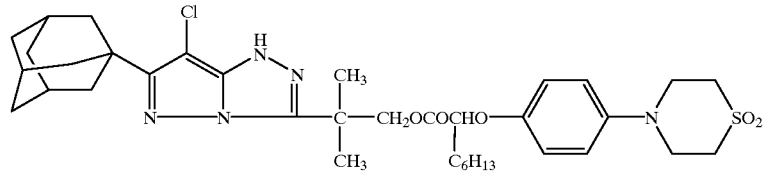
M-10
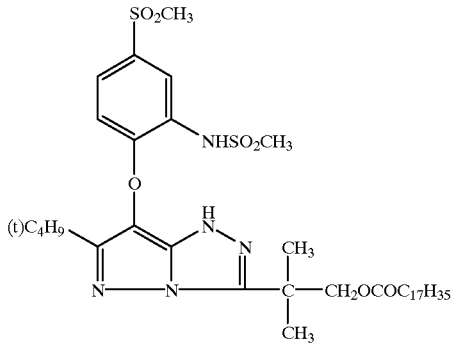
M-11
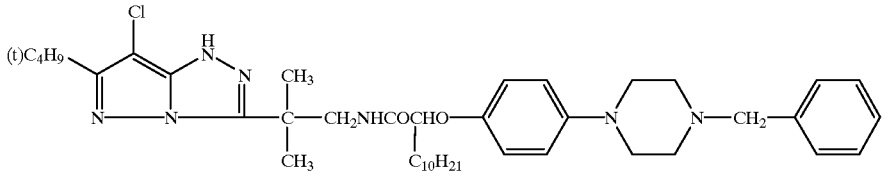

-continued
M-12
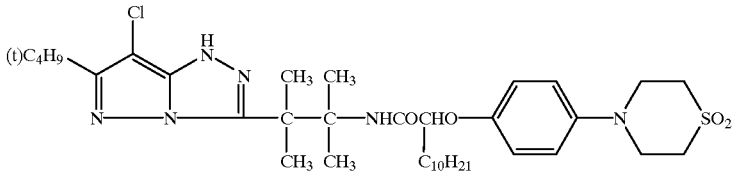
M-13
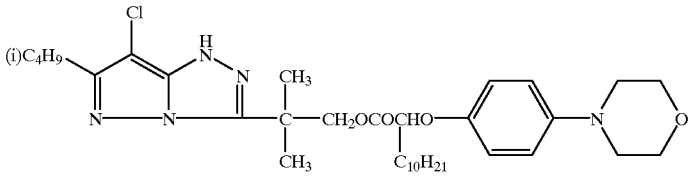
M-14
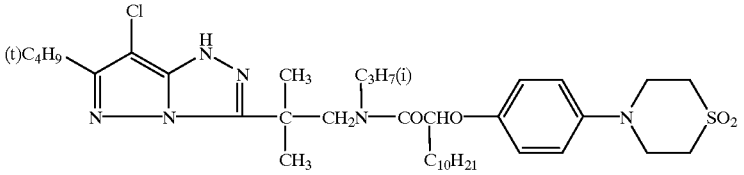
M-15
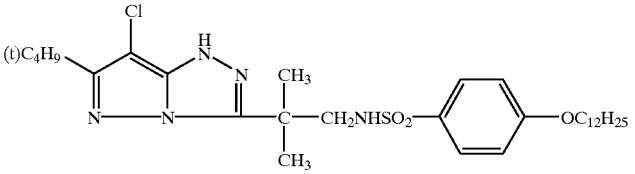
M-16
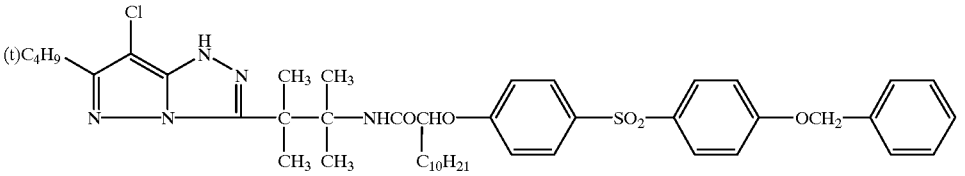
M-17
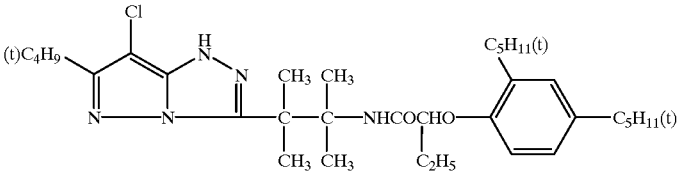
M-18
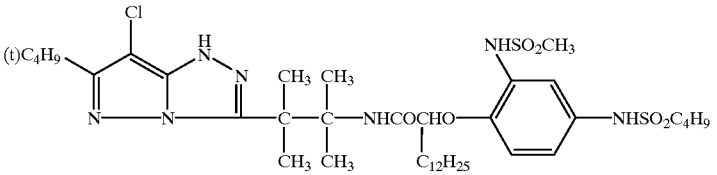
M-19
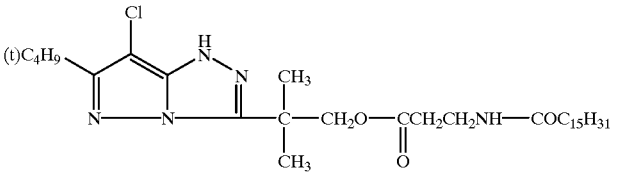

-continued
M-20
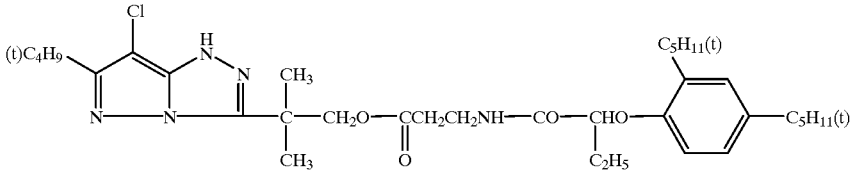
M-21
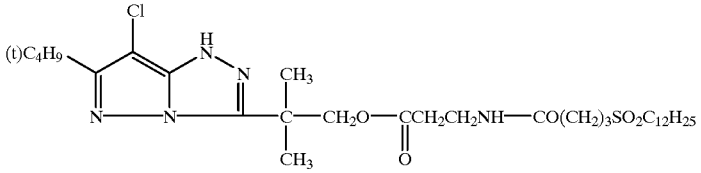
M-22
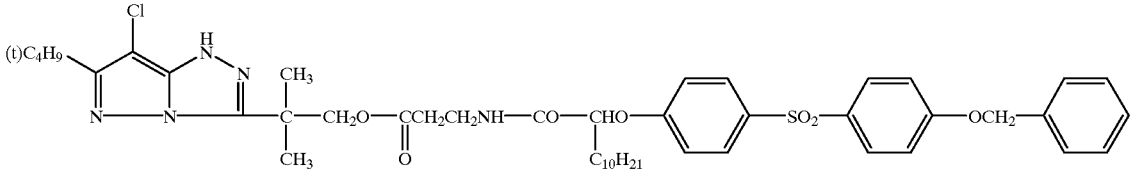
M-23
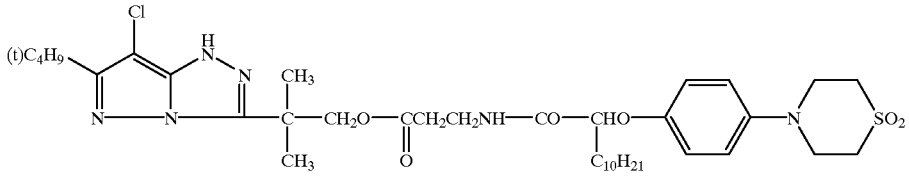
M-24
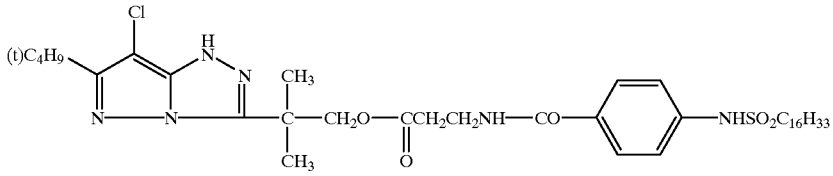
M-25
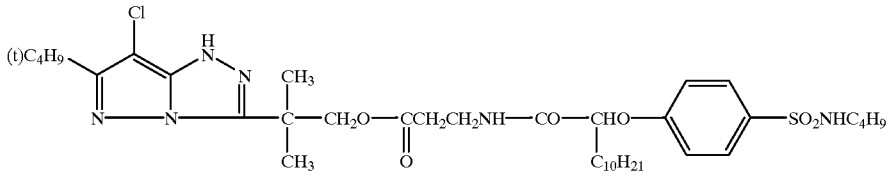
M-26
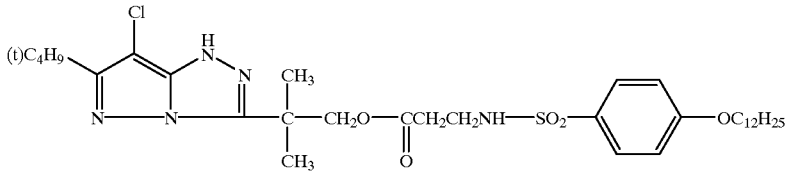
M-27
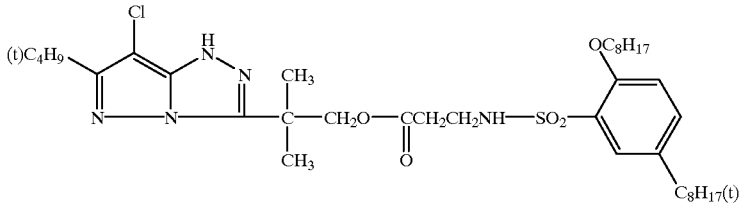

-continued
M-28
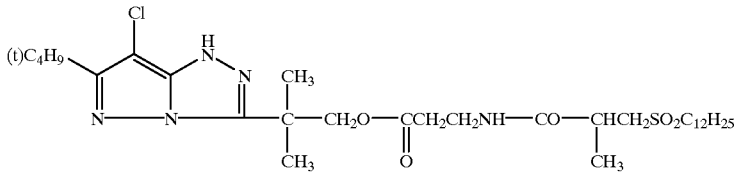
M-29
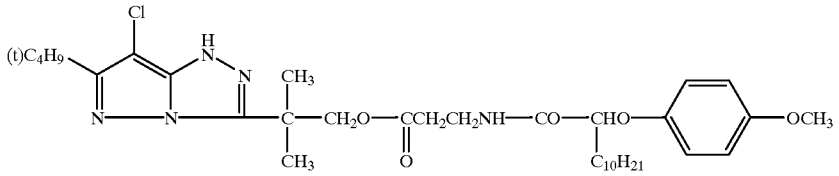
M-30
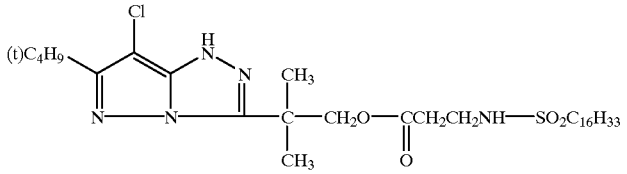
M-31
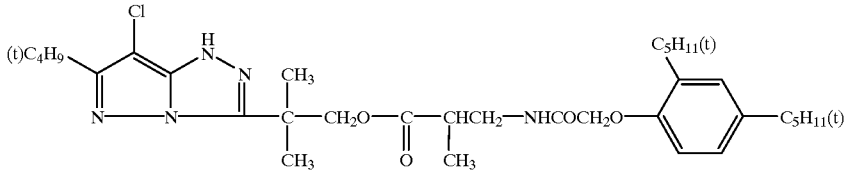
M-32
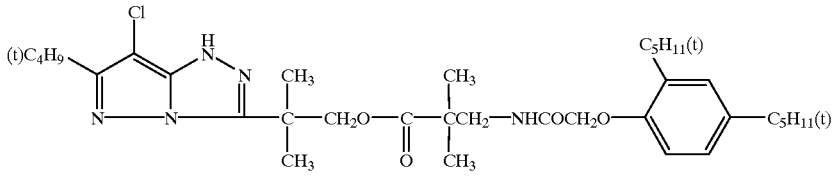
M-33
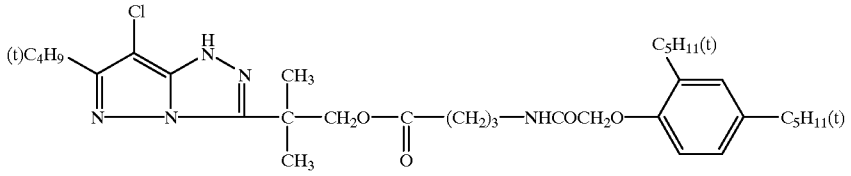
M-34
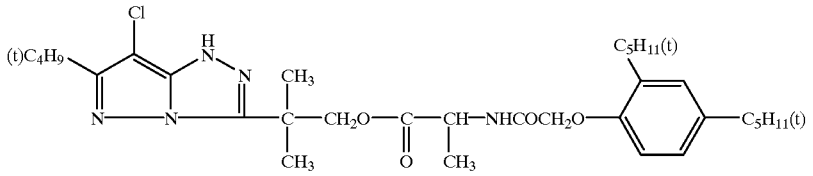
M-35
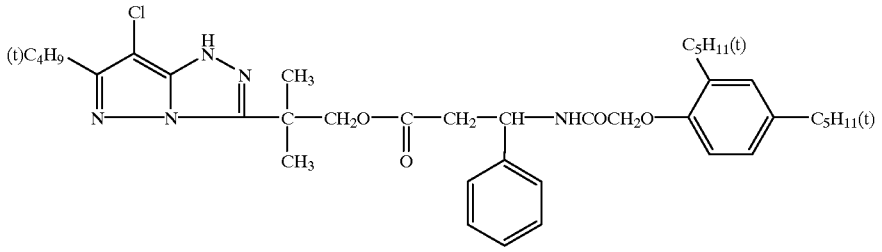

-continued
M-36
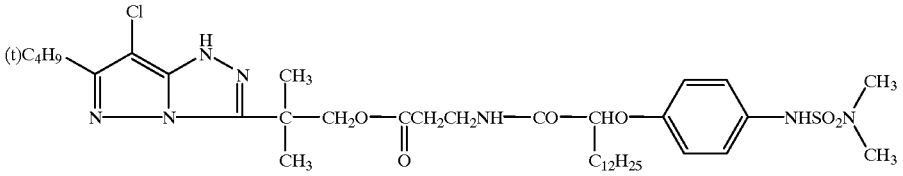
M-37
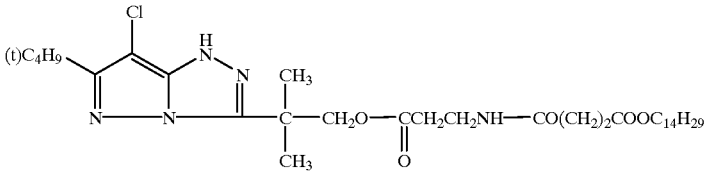
M-38
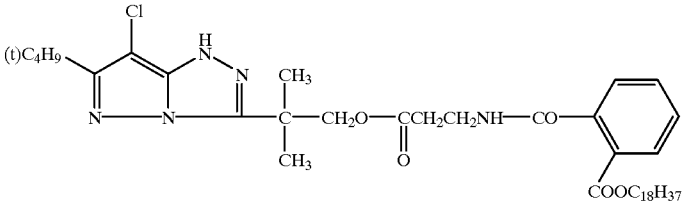
M-39
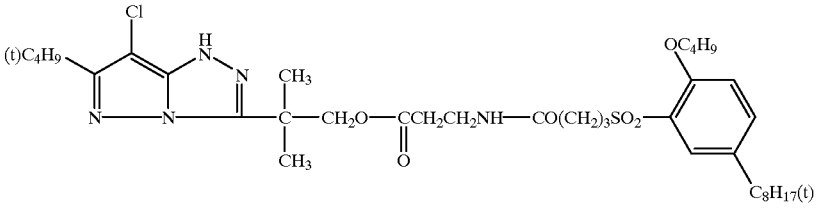
M-40
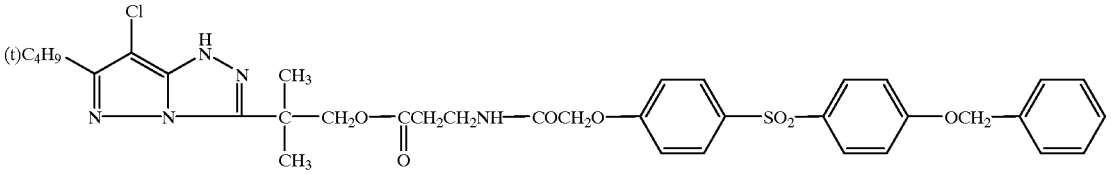
M-41
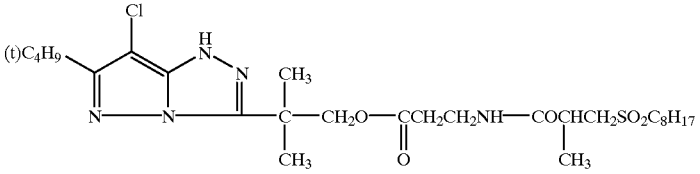
M-42
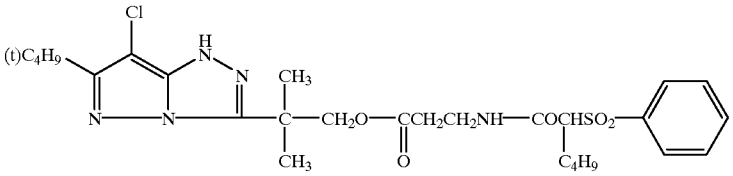
M-43
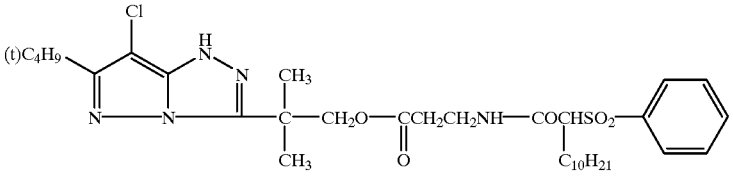

-continued
M-44
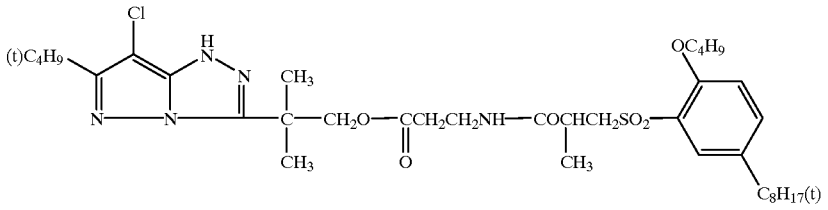
M-45
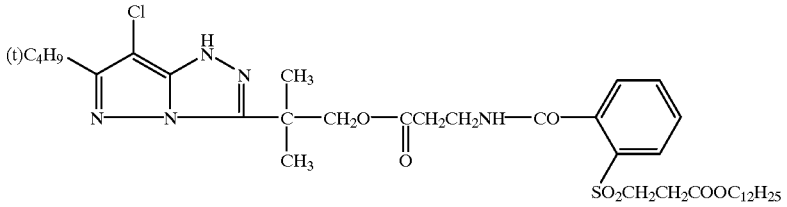
M-46
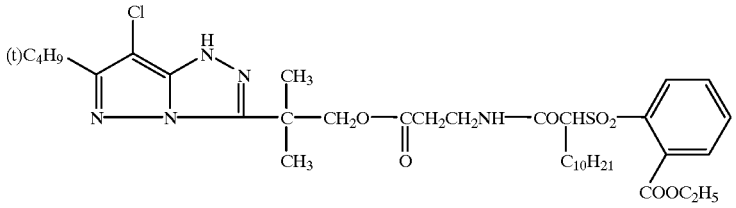
M-47
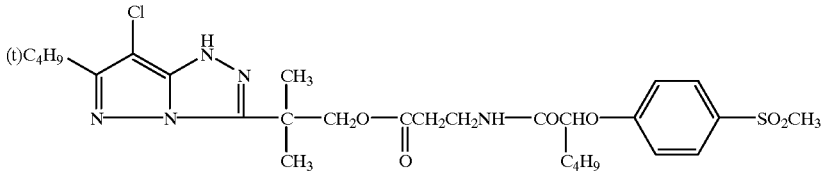
M-48
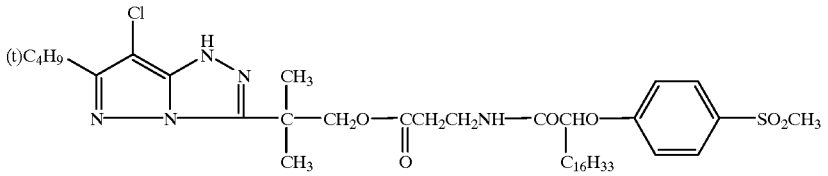
M-49
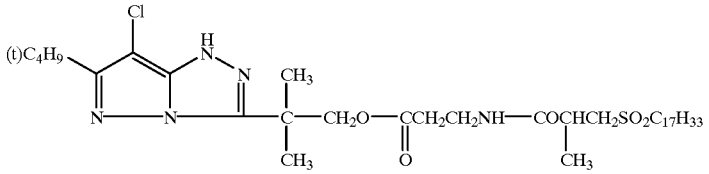
M-50
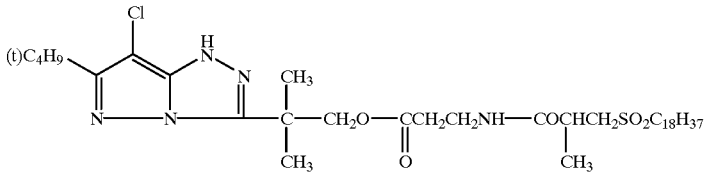
M-51
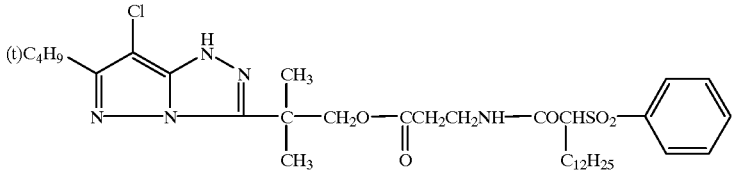

-continued

M-52

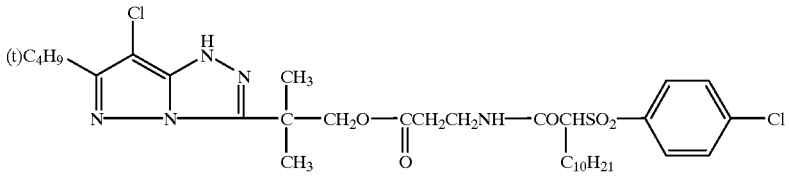

M-53

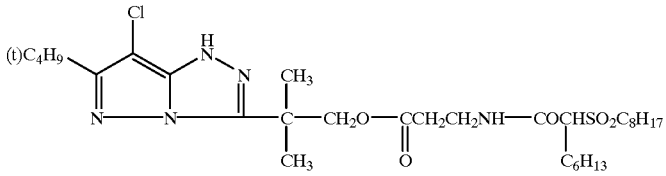

M-54

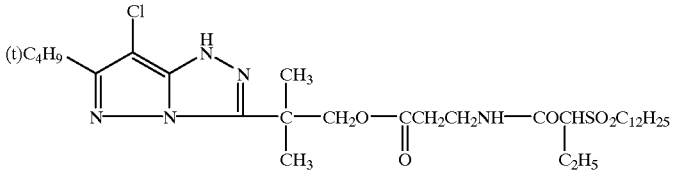

M-55

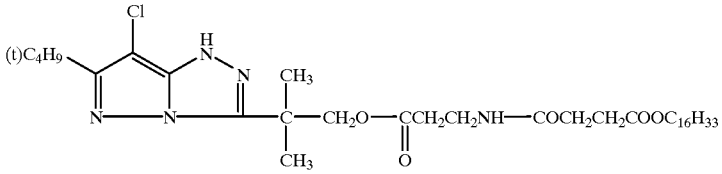

M-56

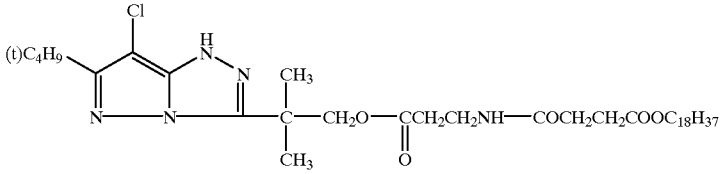

M-57

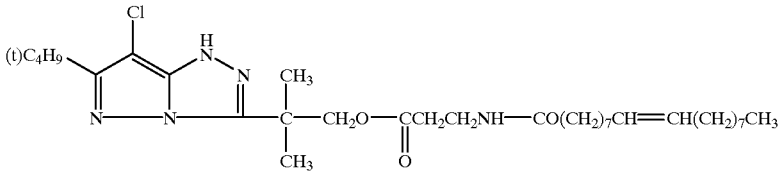

Pyrazoloazole magenta couplers according to the invention can be readily synthesized, with reference to Journal of Chemical Society, Perkin I (1977), 2047–2052; U.S. Pat. No. 3,725,067; Japanese Patent O.P.I. Publication Nos. 59-99437, 58-42045, 59-162548, 59-171956, 60-33552, 60-43659, 60172982, 60-190779, 61-189539, 61-241754, 63-163351, 62-157031; Syntheses, 1981 page 40, ibid 1984, page 122, ibid 1984, page 894; Japanese Patent O.P.I. Publication No. 49-53574; Japanese Patent O.P.I. Publication No. 7-175186; Research Disclosure 40376 (November, 1997) pages 839-842; British patent 1,410,846; Shin Jikken Kagaku Kohza (New Series of Experimental Chemistry) Vol. 14-III, pages 1585–1594 (1977), published by Maruzen; Helv. Chem. Acta., 36, 75 (1953); J. Am. Chem. Soc., 72, 2726 (1950); and Org. Synth., Vol. II, page 395 (1943).

Magenta dye forming coupler of the present invention represented by formula (M-1) or (M-1') can be employed usually in an amount of $1\times10^{-2}$ mol to $8\times10^{-1}$ mol per 1 mol of silver halide, and, in the silver halide photographic light sensitive material as claimed in claim 1 of the present invention, MA/MC is necessary to be 3.1 to 3.7.

Magenta coupler represented by formula (M-1) or (M-1') can be employed in combination with other kind of magenta coupler.

According to the invention, the magenta coupler represented by formula (M-I) is preferably employed in combination with an image stabilizer represented by formulas (AO-I), (AO-II) and/or (AO-III).

(AO-I)

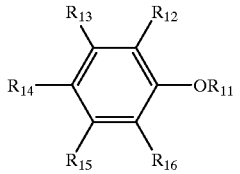

In the formula, $R_{11}$ represents a hydrogen atom, an alkyl group, aryl group, or heterocyclic group or a group represented by the following formula.

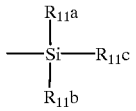

In the formula, $R_{11}a$, $R_{11}b$ and $R_{11}c$ each represent a mono-valent organic group. $R_{12}$, $R_{13}$, $R_{14}$, $R_{15}$, and $R_{16}$ each represent a hydrogen atom, a halogen atom or a group which may be substituted to benzene ring. Each of $R_{11}$ to $R_{16}$ may form a 5 or 6 member ring by bonding each other.

(AO-II)

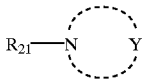

In the formula, $R_{21}$ represents an aliphatic group or an aromatic group; Y represents an atomic group forming a 5–7 member ring together with nitrogen atom.

(AO-III)

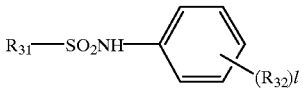

In the formula, $R_{31}$ represents an alkyl group; and $R_{32}$ represents a substituent; 1 is an integer of 0 to 5, wherein plural $R_{32}$ may be same or different in case of 1 is 2 or more.

In the formula (AO-I) alkyl group, aryl group, or heterocyclic group represented by $R_{11}$ is cited the same one as described in $R_{M1}$ in the formula (M-I). The mono-valent organic group represented by $R_{11}a$, $R_{11}b$ and $R_{11}c$ includes an alkyl, aryl, alkoxy or aryloxy group or a halogen atom. Preferable example of $R_{11}$ is hydrogen atom or alkyl group. Substituent which may be substituted to benzene ring represented by $R_{12}$ to $R_{16}$ is cited the same substituent which is substituted further as described in $R_{M1}$ in the formula (M-I). Preferable example of $R_{12}$, $R_{13}$, $R_{15}$, and $R_{16}$ is a hydrogen atom, hydroxy, alkyl, aryl, alkoxy, aryloxy, acylamino, and $R_{14}$ is preferably an alkyl, hydroxy, aryl, alkoxy or aryloxy group. $R_{11}$ and $R_{13}$, may form 5 or 6 member ring by closing mutually, and in this instance, $R_{14}$ is preferably a hydroxy, alkoxy or aryloxy group. $R_{11}$ and $R_{13}$, may form a methylenedioxy ring by closing. $R_{13}$ and $R_{14}$ may form 5 member hydrocarbon ring, and in this instance, $R_{11}$ is preferably an alkyl, aryl or hetero ring group.

Examples of the compound represented by formula (AO-I) are shown below.

Is-1

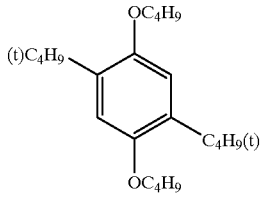

Is-2

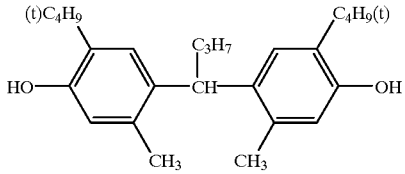

Is-3

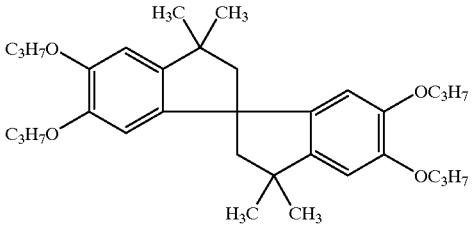

Is-4

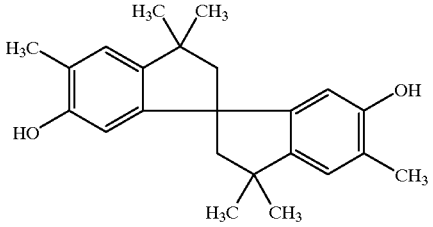

Is-5

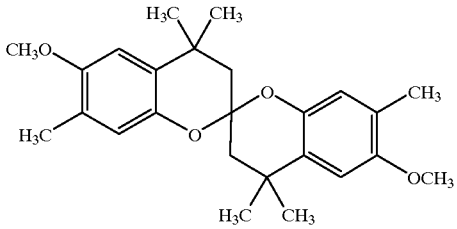

Is-6

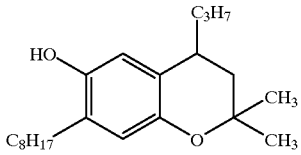

Is-7

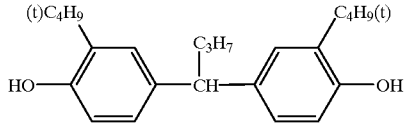

-continued

Is-8

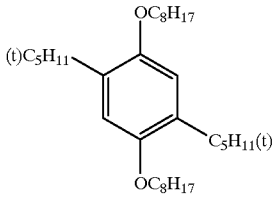

Is-9

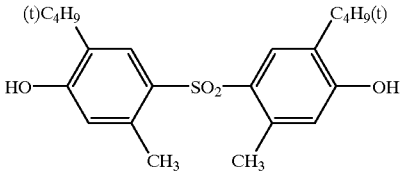

Is-10

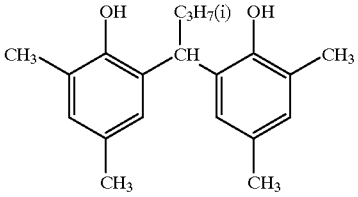

Further to the compounds exemplified above, examples of the compound represented by formula (AO-I) include those disclosed as A-1 to A-28 in Japanese Patent O.P.I. Publication No. 60-262159, pages 11–13; PH-1 to PH-29 in Japanese Patent O.P.I. Publication No. 61-14552, pages 8–10; B-1 to B-21 in Japanese Patent O.P.I. Publication No. 1-306846, page 6–7; I-1 to I-13, I'-1to I'-8, II-1to II-12, II'-1 to II'-21, III-8 to III-14, IV-1 to IV-24 and V-13 to V-17 in Japanese Patent O.P.I. Publication No. 2-958, pages 10–18; and II-1 to II-33 in Japanese Patent O.P.I. Publication No. 3-39956.

In the formula (AO-II) $R_{21}$ represents an aliphatic group or an aromatic group, whose preferable example includes an alkyl, aryl, and heterocycle group, more preferably, an aryl group. The heterocycle group formed by Y with nitrogen atom includes piperidine, piperazine, morpholine, thiomorohline, thiomorpholine-1,1-dione, and pyrrolidine group.

Examples of the compound represented by formula (AO-II) are shown below.

IIs-1

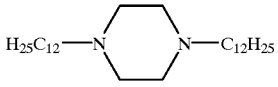

IIs-2

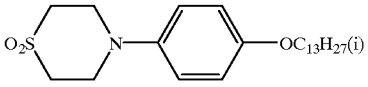

IIs-3

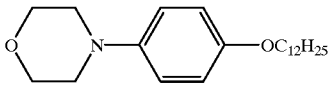

IIs-4

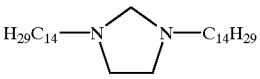

-continued

IIs-5

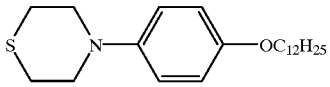

IIs-6

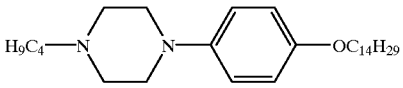

Further to the compounds exemplified above, examples of the compound represented by formula (AO-II) include those disclosed as B-1 to B-65 in Japanese Patent O.P.I. Publication No. 2-167543 and pages 8–11; (1) to (120) in Japanese Patent O.P.I. Publication No. 63-95439, pages 4–7.

In the formula (AO-III) alkyl group represented by $R_{31}$ is cited the same one as described in $R_{M1}$ in the formula (M-I), and the substituent represented by $R_{32}$ is cited the same one as described in $R_{M1}$ in the formula (M-I).

Alkyl group represented by $R_{31}$ is preferably non-substituted alkyl group having carbon atoms 1 to 16. Preferable example of $R_{32}$ includes an alkyl and alkoxy group and halogen atom.

Examples of the compound represented by formula (AO-III) are shown below.

IIIs-1

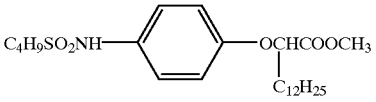

IIIs-2

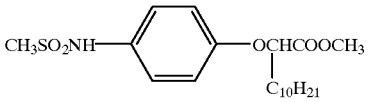

IIIs-3

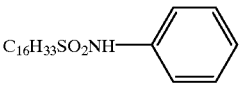

IIIs-4

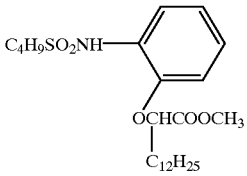

IIIs-5

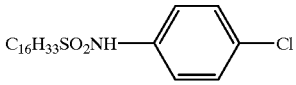

IIIs-6

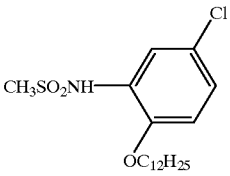

-continued

IIIs-7

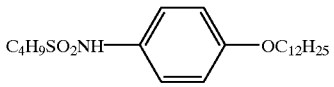

IIIs-8

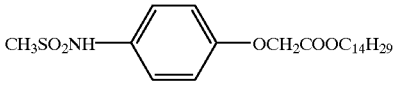

IIIs-9

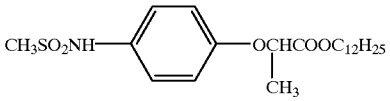

IIIs-10

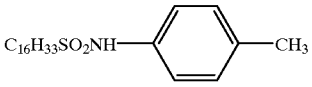

IIIs-11

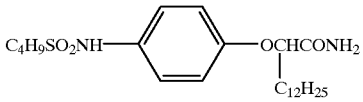

IIIs-12

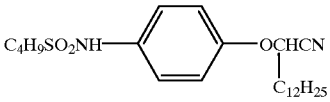

IIIs-13

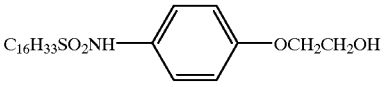

The image stabilizer represented by formula (AO-I), (AO-II) and (AO-III) is preferably used in an amount of 5 to 400 mol % and more preferably, 10 to 250 mol %, based on the magenta coupler represented by formula (M-I) according to the invention.

The magenta dye forming coupler represented by formula (M-I)or (M-1') according to the invention and the image stabilizer are preferably contained together in the same layer, but the image stabilizer may be contained in a layer adjacent to a coupler containing layer.

Yellow dye forming couplers (which may be referred as yellow couplers according to the invention) are described below.

In the Formula (Y-I), examples of the aliphatic group represented by $R_{Y1}$ include a straight chain, branched chain or cyclic alkyl group such as methyl, ethyl, i-propyl, t-butyl, cyclopropyl, cyclohexyl, adamantyl, dodecyl, 1-hexylnonyl, etc. These alkyl groups represented by $R_{Y1}$ can contain a substituent group and examples of the substituent group include a halogen atom (chlorine, bromine, etc.), an aryl group (phenyl group, p-t-octylphenyl group, etc.), an alkoxy group (methoxy group, butoxy group, etc.), an aryloxy group (2,4-di-t-amylphenoxy group, etc.), a sulfonyl group (mathanesulfonyl group, benzenesulfonyl group, etc.), an acylamino group (acetoamide group, benzamide group, etc.), a sulfonylamino group (dodecanesulfonylamino group, etc.) and a hydroxyl group.

Examples of the aromatic group represented by $R_{Y1}$ include an aryl group having 6 to 14 carbon atoms (phenyl group, 1-naphthyl group, 9-anthranyl group, etc.). These aryl groups represented by $R_{Y1}$ can contain a substituent group. Examples of the substituent group include a nitro group, a cyano group, an amino group (dimethylamino group, anilino group, etc.), an alkylthio group (methythio group, etc.), the same groups as defined for the alkyl group represented by the above-mentioned $R_{Y1}$, or the same substituent groups as defined for the substituent groups for the alkyl group represented by the above-mentioned $R_{Y1}$.

$R_{Y1}$ is preferably alkyl group, more preferably branched alkyl group, most preferably t-butyl group.

Examples of the nondiffisuble aliphatic group represented by $R_{Y2}$ include preferably straight chain, branched chain or cyclic alkyl group having 8 to 21 carbon atoms such as 2,6-dimethylcyclohexyl, 2-ethylhexyl, 1-tridecyl, hexadecyl or octadecyl group, etc. The nondiffisuble alkyl group represented by $R_{Y2}$ may be a group having a functional group in its molecular structure represented by the following Formula (Y-2).

$$-J_Y X_{Y2}-R_{22}. \qquad \text{Formula (Y-2)}$$

In the formula (Y-2), $J_Y$ represents a straight or a branched alkylene group having 1 to 20 carbon atom(s) and examples of the alkylene group include methylene group, 1,2-ethylene group, 1,1-dimethylmethylene group, 1-decylmethylene group, etc., $R_{22}$ represents a straight or a branched alkyl group having 1 to 20 carbon atom(s), for example, the same alkyl group as defined for $R_{Y1}$.

$X_{Y2}$ represents chemical bond such as —O—, —OCO—,—$OSO_2$—, —CO—, —COO—, —CON($R_{23}$)—, —CON($R_{23}$)$SO_2$—, —N($R_{23}$)—, —N($R_{23}$)CO—, N($R_{23}$)$SO_2$—, —N($R_{23}$)CON($R_{24}$)—, —N($R_{23}$)COO—, —$S(O)_a$—, —$S(O)_a$N($R_{23}$)— or —$S(O)_a$N($R_{23}$)CO—. $R_{23}$ and $R_{24}$ each represent a hydrogen atom or the same alkyl group and aryl group as defined for those represented by $R_{Y1}$ in the above-mentioned Formula (Y-1). a represents an integer of 0 to 2. $R_{22}$ and $J_Y$ may bond with each other to form a ring structure.

The alkyl group represented by $R_{Y2}$ can further contain a substituent group and the substituent group represents the same substituent group as defined as the substituent group for the alkyl group represented by $R_{Y1}$ in the Formula (Y-1).

Examples of the nondiffisuble aromatic group represented by $R_{Y2}$ in the above-mentioned Formula (Y-1) include the same aryl group as defined as the aryl group represented by the above-mentioned $R_{Y1}$ in the formula (Y-I).

The aryl group represented by $R_{Y2}$ can contain a substituent and examples of the substituent include the same substituent as defined for the substituent for the aryl group represented by the above-mentioned $R_{Y1}$. The preferable substituent for the aryl group represented by $R_2$ is a straight or branched alkyl group having 4 to 10 carbon atoms.

$R_{Y3}$ in the Formula (Y-I) represents a hydrogen atom or a halogen atom, and examples of the halogen atom include chlorine or bromine. Preferable one is chlorine.

In the formula (Y-1) $X_Y$ represents a nitrogen containing heterocyclic group which is released at the coupling with an oxidized color developer, and is represented by the following Formula [III].

Formula [III]

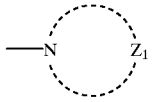

wherein, $Z_1$ represents a nonmetallic atom group necessary to form a 5 or 6 membered heterocyclic ring together with a nitrogen atom.

Herein, as a atom group necessary to form said nonmetallic atom group, for example, are cited a substituted and an unsubstituted methylene, a substituted and an unsubstituted methine, >C═O, >N—$R_{25}$ ($R_{25}$ represents a hydrogen atom, an alkyl group, a cycloalkyl group, an aryl group or a heterocyclic group), —N═, —O—, and —$S(O)_m$ (m is an integer of 0 to 2).

The nitrogen containing heterocyclic group represented by the above-mentioned Formula [III] is preferably represented by the following Formulas [IV], [V], [VI], [VII], [VIII] or [IX].

Formula (IV)

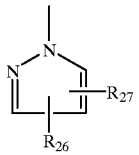

Formula (V)

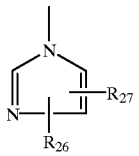

Formula (VI)

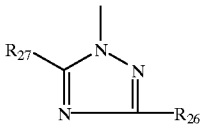

Formula (VII)

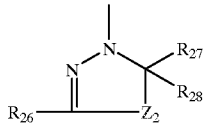

Formula (VIII)

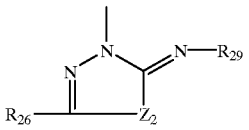

-continued

Formula (IX)

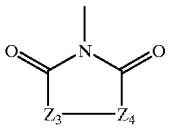

In the above-mentioned Formulas [IV], [V], [VI], [VII] or [VIII], $R_{26}$, $R_{27}$ and $R_{28}$ each represent a group capable of substituting on a nitrogen containing heterocyclic ring, and examples of the group capable of substituting on the nitrogen containing heterocyclic ring include the same substituents as defined for the substituents for the alkyl group, the cyclocalkyl group and the aryl group represented by $R_{Y1}$ in the above-mentioned Formula (Y-I).

In the Formula [VIII], $R_{29}$ represents the same group as defined for the groups of the alkyl, the cycloalkyl and the aryl represented by $R_{Y1}$ in the Formula (Y-I), additionally a carbonyl group (alkyl carbonyl group such as acetyl, trifluoroacetylpivaloyl, etc. and aryl carbonyl group such as benzoyl, pentafluorobenzoyl, 3,5-di-t-butyl-4-hydroxybenzoyl, etc.) and a sulfonyl group (alkyl sulfonyl group such as mathane sulfonyl group, trifluoromethane sulfonyl group, etc. and aryl sulfonyl group such as p-toluene sulfonyl group, etc.).

In the Formulas [VII] and [VIII], $Z_2$ represnts >N—$R_{40}$ ($R_{40}$ represents the same group as defined for $R_{25}$ of the group $Z_1$ in the above-mentioned Formula [III]), —O— or —$S(O)_k$— (k is an integer of 0 to 2).

In the Formula [IX], $Z_3$ represents >N—$R_{41}$ ($R_{41}$ represents the same group as defined for $R_{25}$ of the group $Z_1$ in the above-mentioned Formula [III]), or —O—.

$Z_4$ represnts >N—$R_{42}$ ($R_{42}$ represents the same group as defined for $R_{25}$ of the group $Z_1$ in the above-mentioned Formula [III]), or >C($R_{43}$)($R_{44}$) ($R_{43}$ and $R_{44}$ each represent a hydrogen atom or the same substituent group as defined for the substituent group for alkyl group, cycloalkyl group and aryl group represented by $R_{Y1}$ in the Formula (Y-I).

As the nitogen containing heterocyclic group X represented by the above-mentioned Formula [III] included in the Formula (Y-I), the group represented by the above-mentioned Formula [IX] is specifically preferable.

At least two two-equivalent yellow couplers represented by the Formula (Y-I) of the present invention may bond with each other at some portions of the substituents in their molecular structures to form a bis type, tris type, tetrakis type or polymer type yellow coupler.

Exemplified two equivalent yellow couplers represented by the Formula (Y-I) are shown below.

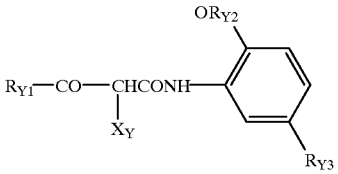

| No. | $R_{Y1}$ | $R_{Y2}$ | $R_{Y3}$ | $X_Y$ |
|---|---|---|---|---|
| (1) | $(CH_3)_3C$— | —$C_{18}H_{37}$ | H | 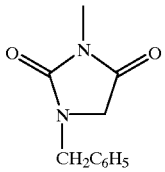 |

-continued
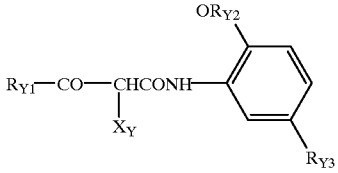
| No. | $R_{Y1}$ | $R_{Y2}$ | $R_{Y3}$ | $X_Y$ |
|---|---|---|---|---|
| (2) | $(CH_3)_3C$— | —$C_{18}H_{37}$ | H | 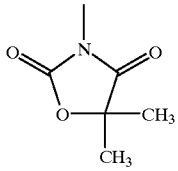 |
| (3) | $(CH_3)_3C$— | —$C_{16}H_{33}$ | H | 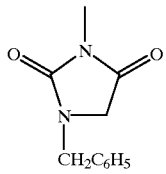 |
| (4) | $(CH_3)_3C$— | —$C_{16}H_{33}$ | H | 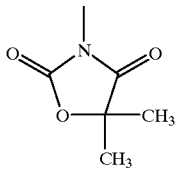 |
| (5) | $(CH_3)_3C$— | —$C_{16}H_{33}$ | H | 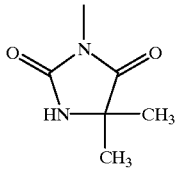 |
| (6) | $(CH_3)_3C$— | —$C_{14}H_{29}$ | H | 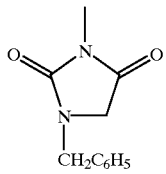 |
| (7) | $(CH_3)_3C$— | —$C_{14}H_{29}$ | H | 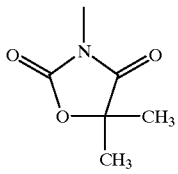 |
| (8) | $(CH_3)_3C$— | —$C_{12}H_{25}$ | H | 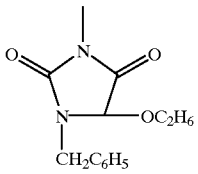 |

-continued
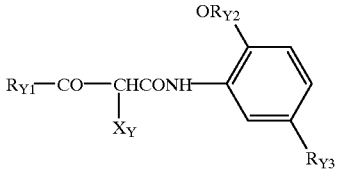
| No. | $R_{Y1}$ | $R_{Y2}$ | $R_{Y3}$ | $X_Y$ |
|---|---|---|---|---|
| (9) | $(CH_3)_3C$— | —$CH_2CO_2C_{12}H_{25}$ | H | 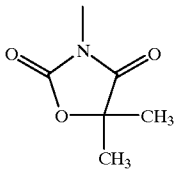 |
| (10) | $(CH_3)_3C$— | —$CH_2CO_2C_{12}H_{25}$ / $C_4H_9$ | H | 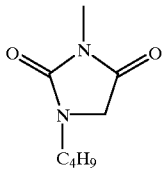 |
| (11) | $(CH_3)_3C$— | 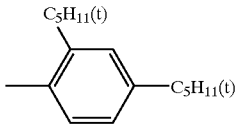 | H | 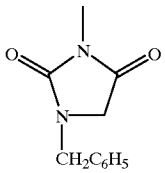 |
| (12) | $(CH_3)_3C$— | 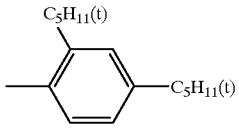 | H | 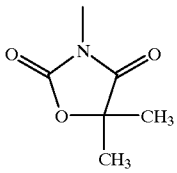 |
| (13) | $(CH_3)_3C$— | 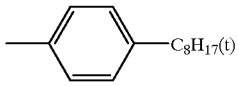 | H | 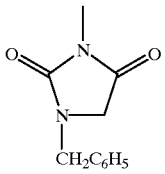 |
| (14) | $(CH_3)_3C$— | 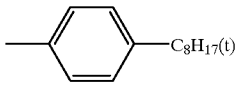 | H | 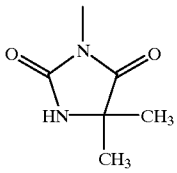 |
| (15) | $(CH_3)_3C$— | 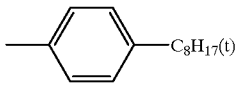 | H | 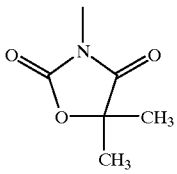 |

-continued
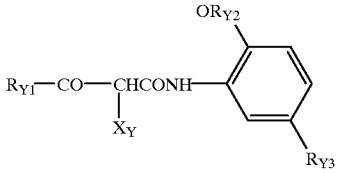
| No. | $R_{Y1}$ | $R_{Y2}$ | $R_{Y3}$ | $X_Y$ |
|---|---|---|---|---|
| (16) | $(CH_3)_3C$— | 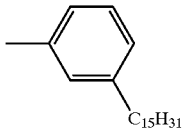 | H | 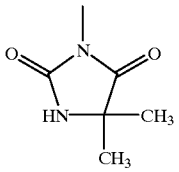 |
| (17) | $(CH_3)_3C$— | 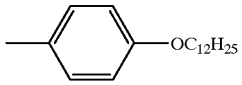 | H | 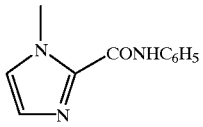 |
| (18) | $(CH_3)_3C$— | —$C_{18}H_{37}$ | Cl | 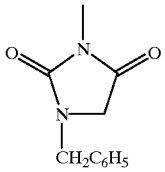 |
| (19) | $(CH_3)_3C$— | —$C_{18}H_{37}$ | Cl | 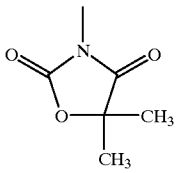 |
| (20) | $(CH_3)_3C$— | —$C_{16}H_{33}$ | Cl | 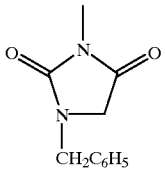 |
| (21) | $(CH_3)_3C$— | —$C_{16}H_{33}$ | Cl | 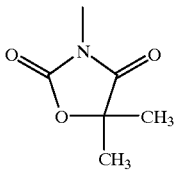 |
| (22) | $(CH_3)_3C$— | —$C_{14}H_{29}$ | Cl | 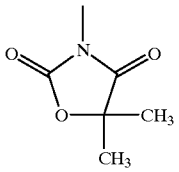 |

-continued
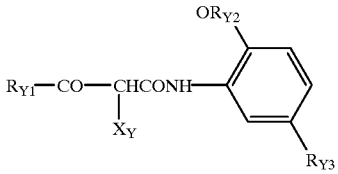
| No. | $R_{Y1}$ | $R_{Y2}$ | $R_{Y3}$ | $X_Y$ |
|---|---|---|---|---|
| (23) | $(CH_3)_3C$— | —$C_{14}H_{29}$ | Cl | 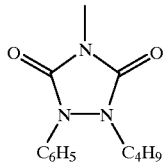 |
| (24) | $(CH_3)_3C$— | —$C_{14}H_{29}$ | Cl | 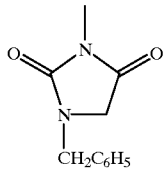 |
| (25) | $(CH_3)_3C$— | —$C_{12}H_{25}$ | Cl | 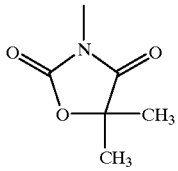 |
| (26) | $(CH_3)_3C$— | —$C_{12}H_{25}$ | Cl | 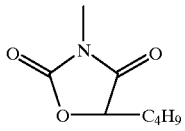 |
| (27) | $(CH_3)_3C$— | —$C_{12}H_{25}$ | Cl | 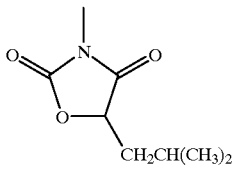 |
| (28) | $(CH_3)_3C$— | —$C_{12}H_{25}$ | Cl | 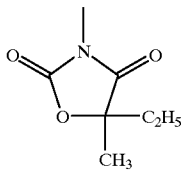 |
| (29) | $(CH_3)_3C$— | —$C_{12}H_{25}$ | Cl | 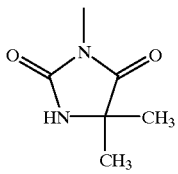 |

-continued
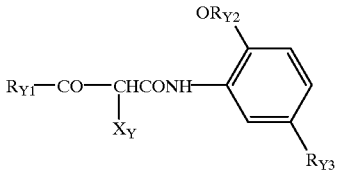
| No. | $R_{Y1}$ | $R_{Y2}$ | $R_{Y3}$ | $X_Y$ |
|---|---|---|---|---|
| (30) | $(CH_3)_3C$— | —$C_{10}H_{21}$ | Cl | 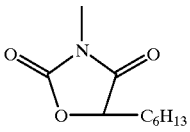 |
| (31) | $(CH_3)_3C$— | —$C_8H_{17}$ | Cl | 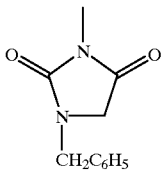 |
| (32) | $(CH_3)_3C$— | —$C_{14}H_{29}$ | Cl | 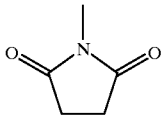 |
| (33) | $(CH_3)_3C$— | —$CH_2CO_2C_{14}H_{29}$ | Cl | 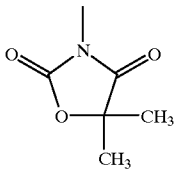 |
| (34) | $(CH_3)_3C$— | —$CH_2CONH(C_8H_{17}\text{-}t)_2$ | Cl | 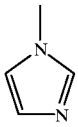 |
| (35) | $(CH_3)_3C$— | 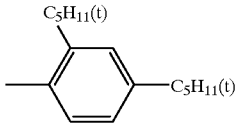 | Cl | 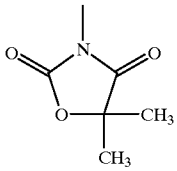 |
| (36) | $(CH_3)_3C$— | 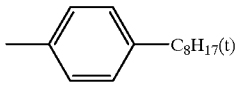 | Cl | 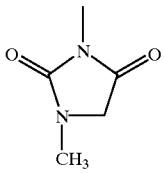 |

-continued
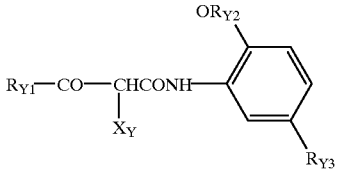
| No. | $R_{Y1}$ | $R_{Y2}$ | $R_{Y3}$ | $X_Y$ |
|---|---|---|---|---|
| (37) | 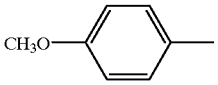 | $—C_8H_{17}(t)$ | Cl | 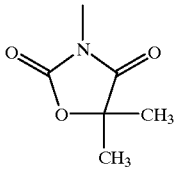 |
| (38) | 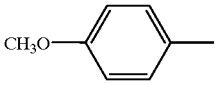 | $—C_{16}H_{33}$ | Cl | 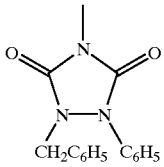 |
| (39) | 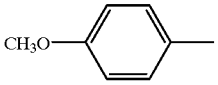 | $—CH_2CO_2C_{12}H_{25}$ | Cl | 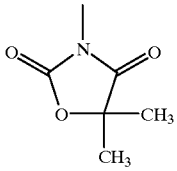 |
| (40) | 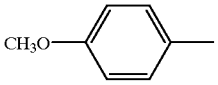 | 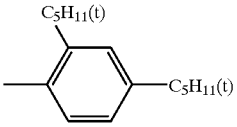 | Cl | 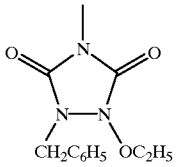 |
| (41) | 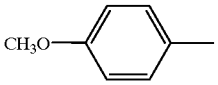 | 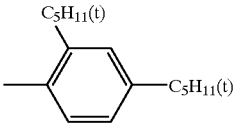 | Cl | 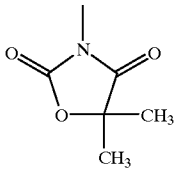 |
| (42) | 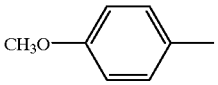 | 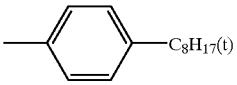 | H | 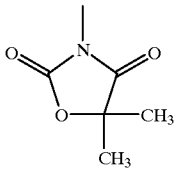 |
| (43) | 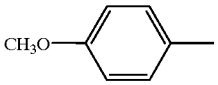 | 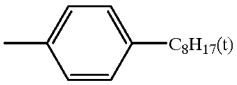 | H | 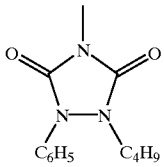 |

-continued
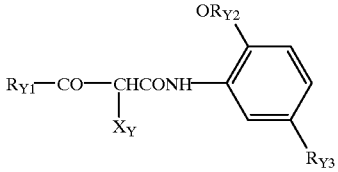
| No. | $R_{Y1}$ | $R_{Y2}$ | $R_{Y3}$ | $X_Y$ |
|---|---|---|---|---|
| (44) | 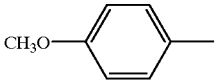 | 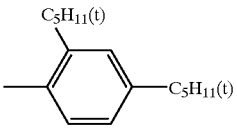 | Cl | 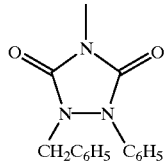 |
| (45) | 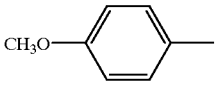 | 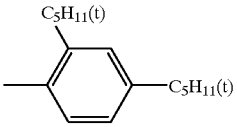 | Cl | 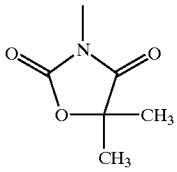 |
| (46) | 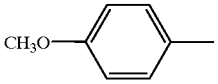 | 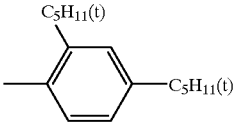 | Cl | 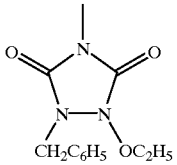 |
| (47) | 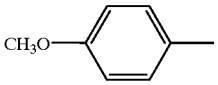 | 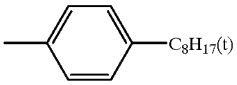 | Cl | 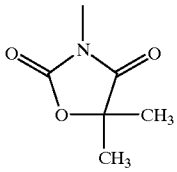 |
| (48) | 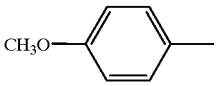 | 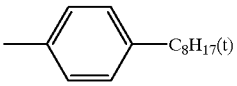 | Cl | 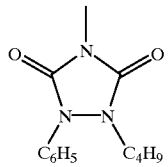 |
| (49) | 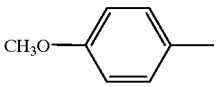 | 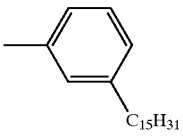 | Cl | 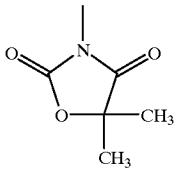 |
| (50) | 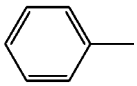 | 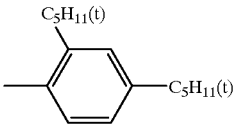 | H | 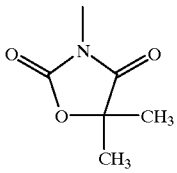 |

The yellow dye forming coupler of the present invention represented by formula (Y-1) can be synthesized by a known method easily.

SYNTHESIS EXAMPLE

Exemplified compound (19) was synthesized according to the following schemes.

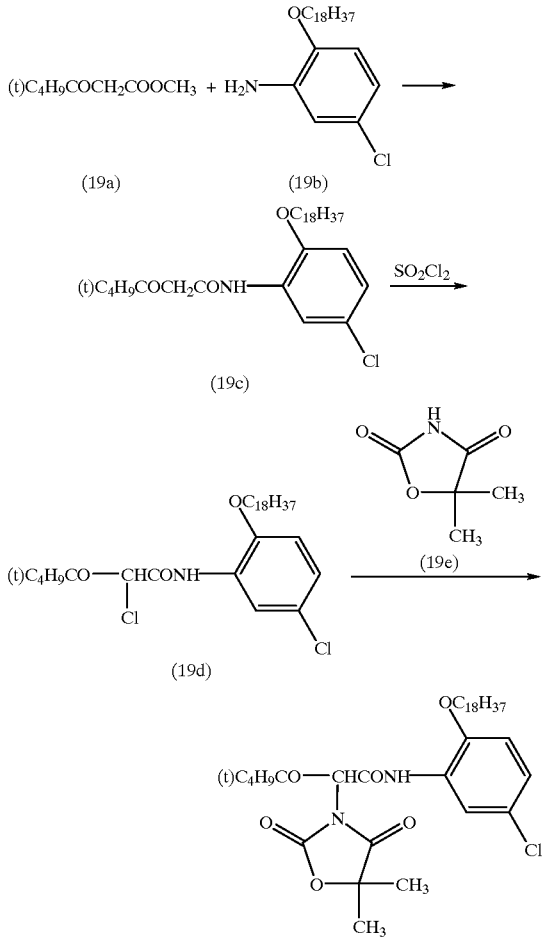

i) Synthesis of intermediate (19c)

Compound (19a) in an amount of 34.8 g (0.22 mol) and 79.2 g (0.20 mol) of (19b) in 300 ml of xylene were reacted under heat reflux for 3.5 hours while removing methanol formed by the reaction by evaporation.

After completion of the reaction solvent was collected under reduced pressure, and 91.8 g of intermediate (19c) (yield 88%) was obtained by recrystallization from the residue in 300 ml of ethanol.

ii) Synthesis of intermediate (19d)

Intermediate (19c) in an amount of 60 g (0.115 mol) was dissolved in 300 ml of ethylacetate and 9.24 ml (0.115 mol) of chlorosulfuric acid was added thereto dropwise slowly at about 30° C.

After completion of dropwise additiion stirring was continued for about 1 hour at the same temperature. Then the solvent was collected under reduced pressure to obtain 65.6 g of intermediate (19d) (yield 103%), which was employed for the next manufacturing process without being refined.

iii) Synthesis of exemplified compound (19)

Intermediate (19d) in an amount of 15 g (26.9 mg mol) was dissolved in acetone 45 ml, and potassium carbonate 4.83 g (34.9 mg mol) and 4.51 g of (19e) (34.9 mg mol) were added thereto, and the reaction was continued for 4 hours with heat reflux. Aforganic phase was extracted, which was washed with dilute aqueous chloric acid 3 times. Then the solvent was collected under reduced pressure. The exemplified compound (19), 14.7 g (yield 84%) was obtained by recrystallization of the residue from mixed solvent of ethanol of 50 ml and ethyl acetate of 10 ml.

The structure of exemplified coupler (19) was confirmed by NMR and mass spectrum.

Couplers other than the exemplified coupler (19) were synthesized by employing starting material corresponding to them followed the synthesis example mentioned above.

Yellow dye forming coupler of the present invention represented by a formula (Y-1) can be used in one kind or more in combination. Andy conventional pivaloyl acetanilide series or benzoyl acetanilide series yellow coupler can be employed in combination.

Next, the water-insoluble and the organic solvent-soluble polymer employed with the yellow dye forming coupler and a compound represented by formula (A-1) in combination is described.

The water-insoluble and organic solvent-soluble polymer usable in the light-sensitive material of the invention includes a polymer and copolymer of vinyl compound, a condensation product of a polyvalent alcohol and a polybasic acid, a polyester produced by cycle-opening polymerization method, a polycarbonate resin, a polyurethane resin and a polyamide resin.

As for the molecular weight of the polymer, the number average molecular weight is preferably not more than 200,000, more preferably 5,000 to 100,000.

Examples of preferably usable polymer are shown below. In the case of copolymer, the weight ratio of the monomers is shown.

PO-1 Poly(N-t-butylacrylamide)

PO-2 N-t-butylacrylamide/methyl methacrylate copolymer (60:40)

PO-3 Polybutyl methacrylate

PO-4 Methyl methacrylate/styrene copolymer (90:10)

PO-5 N-t-butylacrylamide/2-methoxyethyl acrylate copolymer (55:45)

PO-6 ω-metoxyetylene glycol acrylate (adducted amount in molar number=9)/N-t-butylacrylamide copolymer (25:75)

(PO-7)

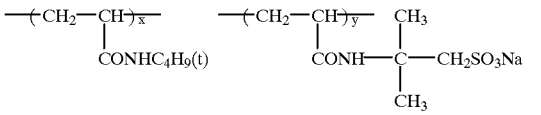

x:y = 99:1

Other than the above-mentioned, exemplified compounds P-1 to P-200 described in Japanese Patent Publication Open to Public Inspection No. 64-537, pages 10 to 15, can be cited.

The water-insoluble and organic solvent-soluble polymer compound may be added as an emulsified dispersion prepared by dissolving with coupler and high boiling point organic solvent with heating, or may be added in the form of aqueous polymer latex. In case it is added in the form of aqueous polymer latex, dispersion methods described in Japanese Patent O.P.I. Publication Nos. 8-254774 and 8-254781 are preferably employed.

Next compound represented by the formula (A-1) which is employed in combination with the yellow dye forming coupler and the organic solvent-soluble polymer is described.

In the formula (A-1) secondary or tertiary alkyl group represented by $R_{A1}$ is that having number of carbon atom 3-32 is preferable, and preferable example is listed as isopropyl group, t-butyl group, t-amyl group.

Alkyl group represented by $R_{A2}$ is that having number of carbon atom 1-32 is preferable, and preferable example is listed as methyl group, ethyl group, propyl group, isopropyl group, t-butyl group, 2-ethylhexyl group, octyl group, and dodecyl group.

Alkyl group represented by $R_{A1}$ and $R_{A2}$ may have a substituent, and, the substituent includes the group same as $R_{M1}$ in a formula (M-1) mentioned above.

Example of a group substitutable to benzene ring represented by $R_{A3}$ includes any aliphatic group, aromatic group, or halogen atom, and preferable example includes alkyl group, alkenyl group, cycloalkyl group, aryl, acylamino-group, sulfonamide group, alkylthio group, arylthio group, sulfonyl group, sulfinyl group, phosphonyl group, acyl group, carbamoyl group, sulfamoyl group, alkoxy group, aryloxy group, acyl oxy group, ureide group, urethane group, carbonyl group, alkoxycarbonyl group, aryloxy carbonyl group, amino group, alkylamino group, anilino group, heterocyclic group, halogen atom. Further preferable group is alkyl group, cycloalkyl group, aryl, alkoxycarbonyl group, aryloxy carbonyl group, and acylamino-group.

Concrete example of the compound represented by formula (A-1) is shown below.

A-1

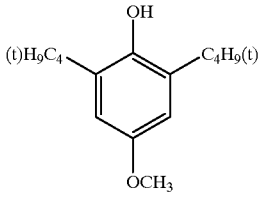

A-2

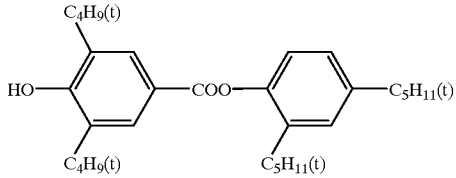

A-3

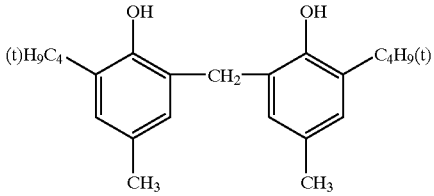

A-4

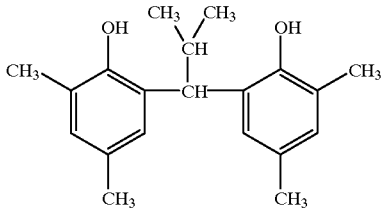

A-5

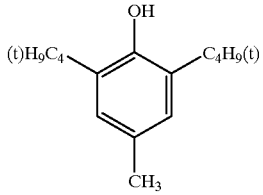

A-6

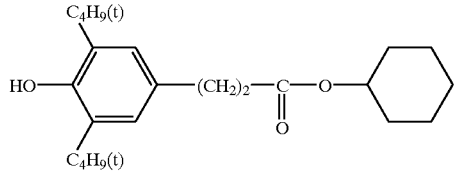

A-7

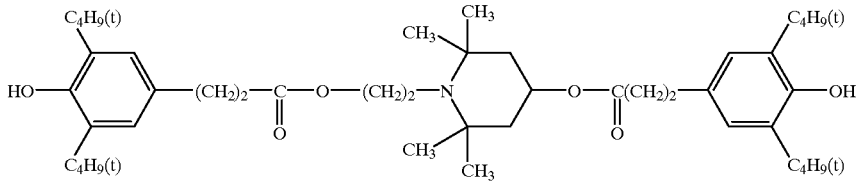

A-8

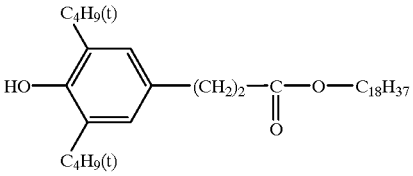

A-9

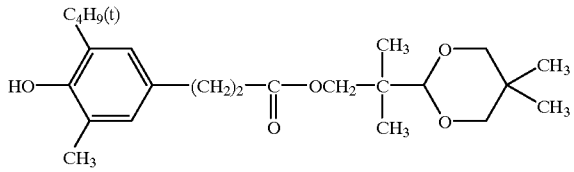

-continued
A-10
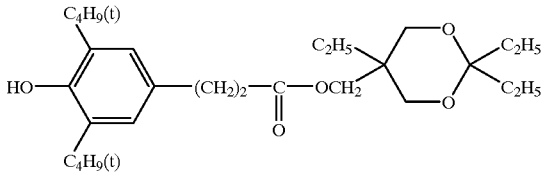
A-11
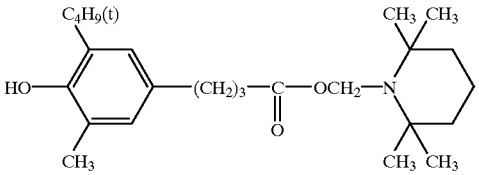
A-12
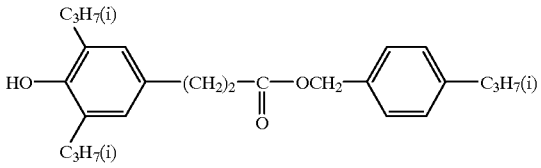
A-13
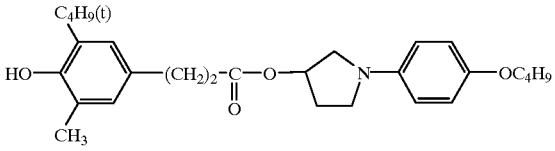
A-14
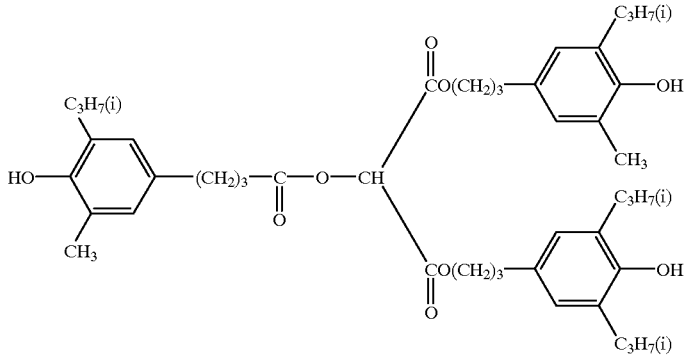
A-15
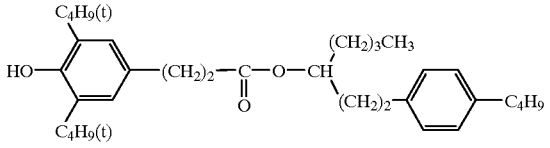
A-16
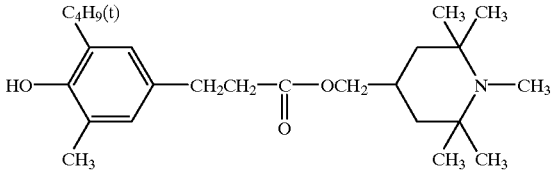
A-17
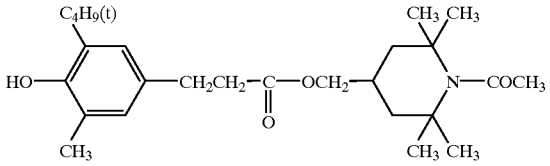
A-18
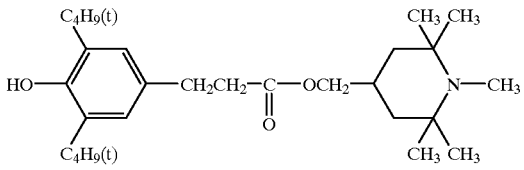
A-19
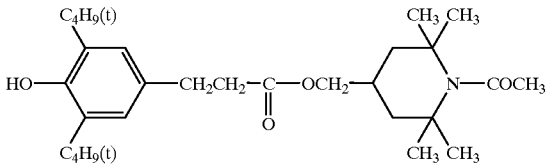
A-20
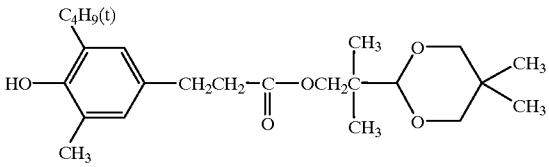
A-21
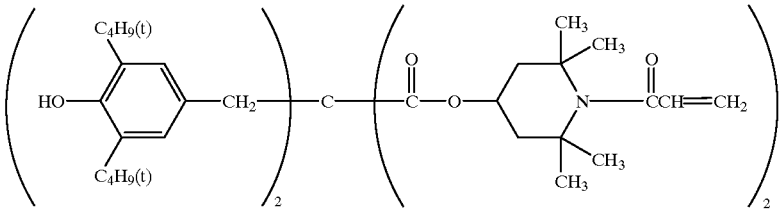

-continued
A-22
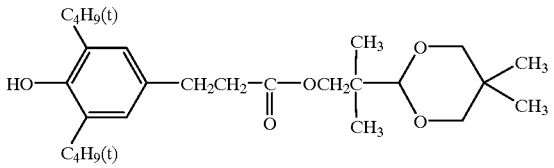
A-23
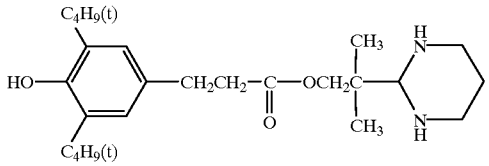
A-24
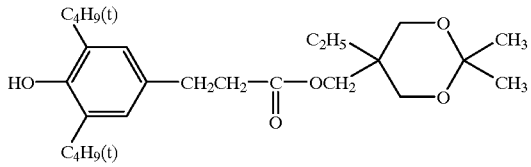
A-25
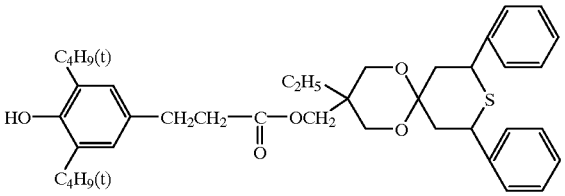
A-26
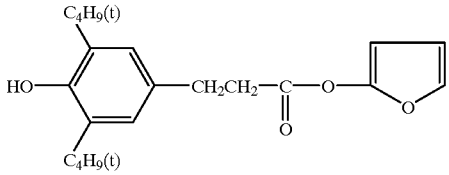
A-27
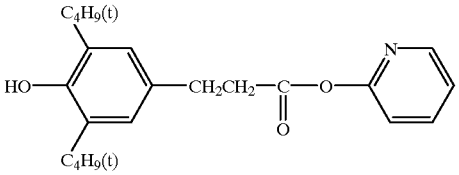
A-28
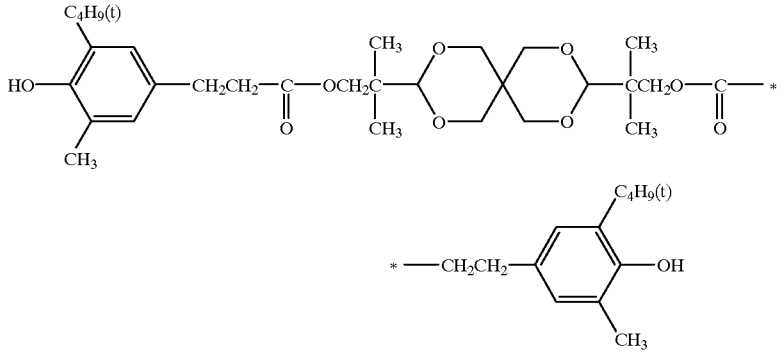
A-29
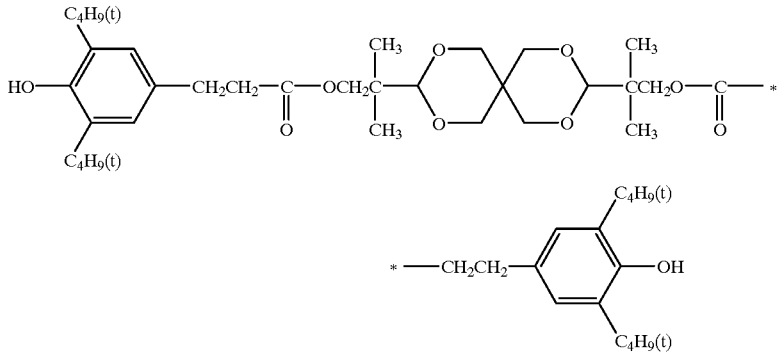
A-30
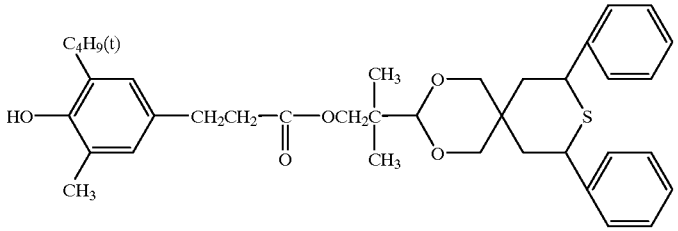

These compounds are readily synthesized by a way described in EP 310,552.

Compound A-28 is preferably employed in particular among compounds represented by the formula (A-1)

An amount of compound represented by formula (A-1), $0.03\times10^{-3}$ to $3\times10^{-3}$ mol/m is preferable, and $0.05\times10^{-3}$ to $1\times10^{-3}$ mol/m$^2$ is more preferable.

A hydrophobic compound such as a color-forming coupler can be added to an objective hydrophilic colloid layer by the following procedure: the compound is usually dissolved in a high-boiling solvent having a boiling point of not less than 150° C. or a polymer compound insoluble in water and solved in an organic solvent at not more than 80° C., and, according to necessity, a low-boiling solvent or a water-miscible solvent, and dispersed in a liquid of a hydrophilic binder such as gelatin by a dispersing means such as a stirrer, a homogenizer, a colloid mill, a flow-jet mixer or an ultrasonic dispersing device in the presence of a surfactant. Thus obtained dispersion is added to a coating liquid of the hydrophilic colloid layer. In case of employing low-boiling point solvent, it is preferable to enter a process removing the low-boiling point solvent after or during the dispersion.

The high-boiling organic solvent usable in the light-sensitive material includes a ester such as phthalate or phosphate, an organic acid amide, a ketone and a hydrocarbon compound. Concrete examples of such the solvent include exemplified compounds A-1 to A-120 described in Japanese Patent O.P.I. Publication No. 1-196048, pages 4 to 7, II-1 to II-29 described on pages 8 to 9 of the same document, H-1 to H-22 described on pages 14 to 15 of the same document, exemplified compounds S-1 to S-69 described in Japanese Patent O.P.I. Publication No. 1-209446, pages 3 to 7, exemplified compound I-1 to I-95 described in Japanese Patent O.P.I. Publication No. 63-253943, pages 10 to 12, exemplified compounds a-i to a-iX described in USP 5,429,913 at page 2, and exemplified compounds 5-1 to 5-15 described in EP 550,3591 A at page 22.

Coating method of the processing composition is explained below.

The coating method of the present invention includes coating by shower, coating by splaying or coating bu painting. In the present invention one of the preferred embodiment is coating directly or indirectly onto the light sensitive material by painting not through a gas phase because it is more suitably effective to the present invention.

Among the coating methods by painting, a roller painting or extrusion painting means are preferably employed.

From the viewpoint of obtaining the objects of the present invention, the amount of developing liquid fed from respective feeding means onto an emulsion surface of a silver halide photographic light-sensitive material is preferably 5 to 100 ml and more preferably 10 to 60 ml, particularly 15 to 50 ml per m$^2$ of light-sensitive material. The amount means the sum amount of each liquid part when the composition is composed of plural liquid parts.

It is preferred that time required for the silver halide photographic light-sensitive material to arrived at the next process within not more than 20 seconds, more preferably from 3 to 15 seconds, particularly from 5 to 12 seconds after the supply of the developing liquid. The effects of the invention is satisfactorily enhanced when the developing process is performed within the rang e of from 2 to 15 seconds, and the developing liquid is supplied for not more than 5 seconds in total.

In the invention, it is preferred that the processing liquid to be supplied composed of to or more component liquids. In such the case, the effects of the invention can be sufficiently enhanced since a highly concentrated liquid can be temporarily formed by mixing plural concentrated liquids on the surface of the light-sensitive material. Such the high concentration of the liquid is hardly attained when the liquid is prepared in a form of one liquid.

In concrete, it is preferred that the processing liquid is at least composed of a first partial liquid containing a developing agent and a second partial liquid containing an alkaline component. Consequently, at least a first supplying means for the first partial liquid and a second supplying means for the second partial liquid are provided in the automatic processor of the invention. As the developing agent, a black-and-white developing agent such as hydroquinone, methol, phenidone, and a color developing agent such as a p-phenylene diamine derivative and a hydrazine derivative are usable. The effects of the invention is enhanced when the color developing agent is used.

And, another preferable embodiment is composed of the first composition liquid containing aminopolycarboxylicacid ferric complex salt and the second composition liquid containing compound selected from at least one kind of thiosulfate and/or thiocyanate.

Aminopolycarboxylicacid ferric complex salt compound represented by formulas [K-I] to [K-IV] which is preferably employed in the present invention is described.

[K-1]

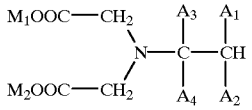

In the formulas $A_1$ through $A_4$, each of which may be same or different, represent hydrogen atom, hydroxy group, —COOM', —$PO_3(M_1)_2$, —$CH_2COOM_2$, —$CH_2OH$ or lower alkyl group which may have a substituent, with proviso that at least one of $A_1$ through $A_4$ is —COOM', —$PO_3(M_1)_2$, or —$CH_2COOM_2$. $M_1$, $M_2$, and M' each represents hydrogen atom, ammonium group, alkali metal or organic ammonium group.

[K-11]

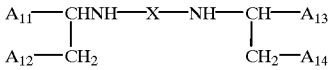

In the formulas $A_{11}$ through $A_{14}$, each of which may be same or different, represent —$CH_2OH$, —$COOM_3$, or —$PO_3(M_4)_2$. $M_3$ and $M_4$ each represents hydrogen atom, ammonium group, alkali metal, lower alkyl group which may have a substituent or organic ammonium group. X is an alkylen group having 2–6 carbon atoms, or —$(B_1O)_n$—$B_2$—. n is an integer of 1–8, and $B_1$ and $B_2$ each of which may be same or different, represent alkylen group having 1–5 carbon atoms.

[K-III]

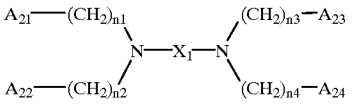

In the formulas $A_{21}$ through $A_{24}$, each of which may be same or different, represent —$CH_2OH$, —$COOM_5$, —N[$(CH_2)_{n5}$COOH)][$(CH_2)_{n6}$COOH)] or —$PO_3(M_6)_2$. $M_5$ and $M_6$ each represents hydrogen atom, ammonium group, alkali metal or organic ammonium group. $X_1$ is a straight or branched alkylene group having 2–6 carbon atoms, saturated or non-saturated organic group forming a ring, or —$(B_{11}O)_{n7}$—$B_{12}$—. $n_7$ is an integer of 1–8, and $B_{11}$ and $B_{12}$ each of which may be same or different, represent alkylen group having 1–5 carbon atoms. $n_1$ to $n_6$ is an integer of 1–4, which may be same or different.

[K-IV]

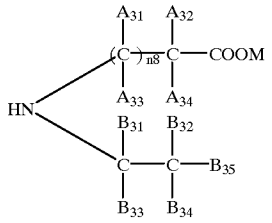

In the formula M is a hydrogen atom, cation, or alkali metal atom, $n_8$ is an integer of 1 to 3, $A_{31}$ to $A_{34}$, $B_{31}$ to $B_{35}$ each represents —H, —OH, $—C_2H_{2n+1}$, or $—(CH_2)_mX_2$, wherein n and m is an integer of 1–3 and 0–3 respectively, $X_2$ is $—COOM_7$ ($M_7$ is the same as M), $—NH_2$, or —OH. With proviso that all of $B_{31}$ to $B_{35}$ are not a hydrogen atom.

Preferable compounds represented by formulas [K-I] to [K-IV] are exemplified.

K-I-1

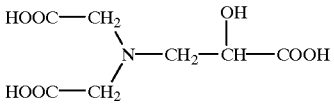

K-I-2

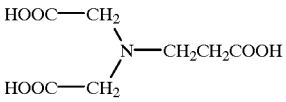

K-I-3

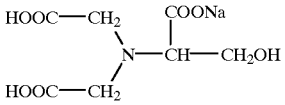

K-I-4

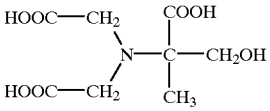

K-I-5

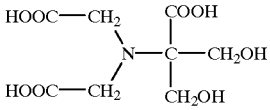

K-I-6

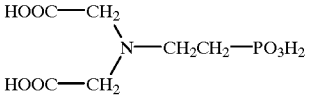

K-II-1

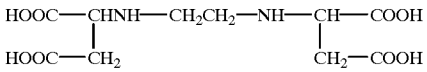

K-II-2

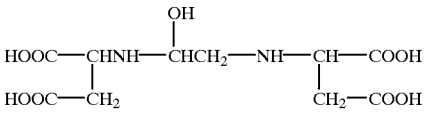

K-II-3

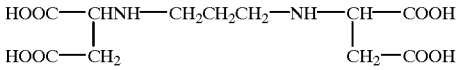

K-II-4

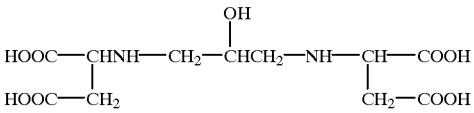

K-II-5

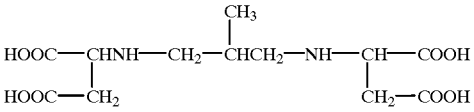

K-II-6

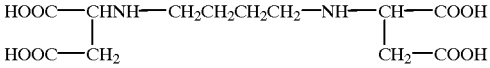

K-II-7

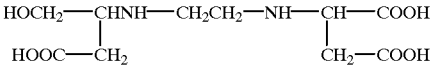

K-III-1

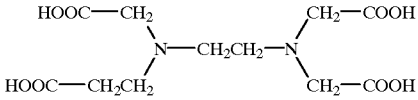

K-III-2

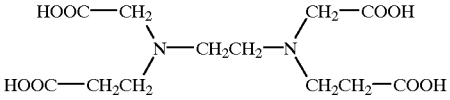

K-III-3

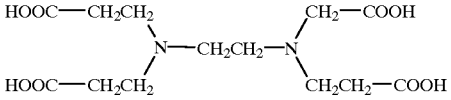

K-III-4

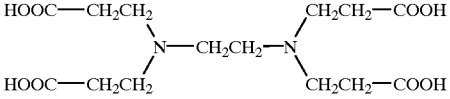

K-III-5

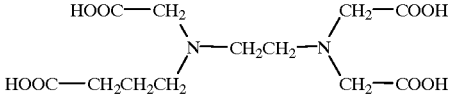

K-III-6

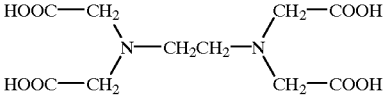

K-III-7

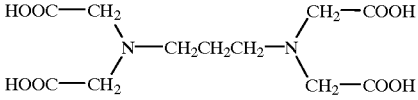

-continued

K-III-8

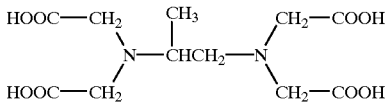

K-III-9

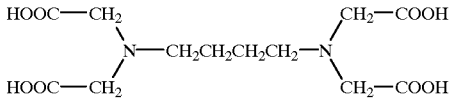

K-III-10

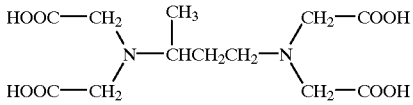

K-IV-1

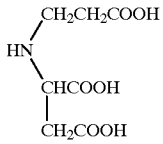

K-IV-2

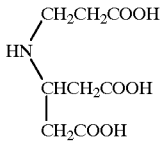

K-IV-3

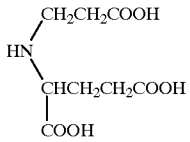

K-IV-4

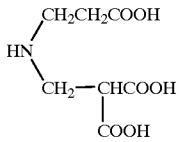

K-IV-5

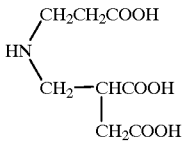

K-IV-6

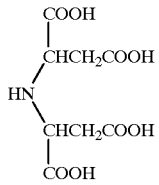

K-IV-7

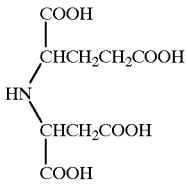

K-IV-8

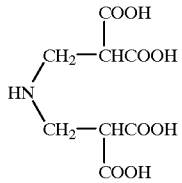

K-IV-9

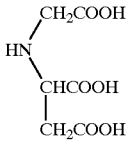

K-IV-10

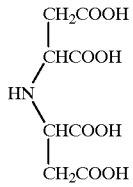

The compounds exemplified above may be salt of Na, K, $NH_4$ or Li. The compounds exemplified above may contain crystal water.

The preferable examples are K-I-2, K-II-1, K-III-6, K-III-7, K-III-8, K-IV-9 and K-IV -10,and particularly K-III-6 and K-IV-10 among the compounds described above.

Preferable example of thiosulfate employed in the present invention includes ammonium thiosulfate, sodium thiosulfate and potassium thiosulfate, and example of thiocyanate is ammonium thiocyanate, sodium thiocyanate and potassium thiocyanate.

The first component, in case that the processing composition is a developer, is a processing composition containing a color developing agent or a black and white developing agent, which may comprise a surfactant, a solubilizing agent of color developing agent, a stabilizer etc. The second component is a processing composition containing alkali agent as a major component, which may contain a surfactant, a solubilizing agent of color developing agent, a stabilizer, a chelating agent etc.

Preferably pH of the first component is usually not more than 8, and the second component not less than 8, and more preferably, the first component is not more than 4 and the second component is not less than 10.

A color developing agent employed in the present invention is preferably paraphenylenediamin compounds, and among them those containing a water soluble group is employed preferably because the object of the invention is performed advantageously and reduced fog occurs.

The paraphenylenediamin compounds containing a water soluble group have advantage that contamination of the light sensitive material is not caused and poisoning on a skin when it attached to the skin is reduced and attains the object of the invention more efficiently in comparison with those not containing the water soluble group.

It is preferable that the color developing agent relating to the invention has a solubilizing group. The p-phenylenediamine compound has at least one solubilizing group at the amino group or the benzene ring thereof. As preferable example of the solubilizing group, $-(CH_2)_nCH_2OH$, $-(CH_2)_mNHSO_2-(CH_2)_nCH_3$, $-(CH_2)_mO-(CH_2)_nCH_3$, $-(CH_2CH_2O)_nC_mH_{2m+1}$, in which m and n represent each an integer of 0 or more, —COOH and —$SO_3H$ are cited.

Concrete examples of paraphenylenediamine compound preferably usable in the invention are shown below.

(C-1)

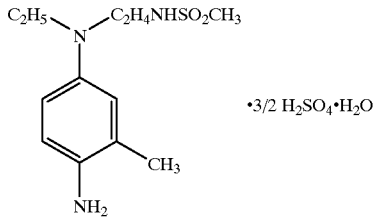

(C-2)

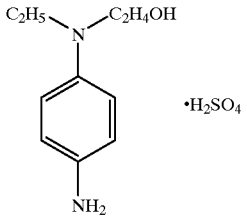

(C-3)

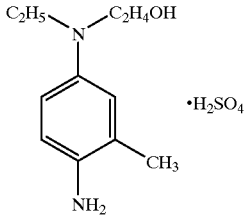

(C-4)

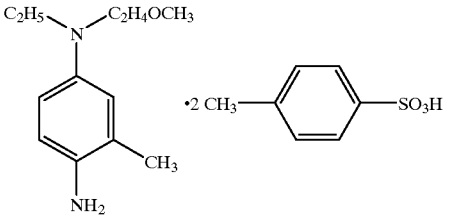

(C-5)

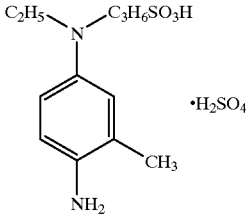

-continued (C-6)

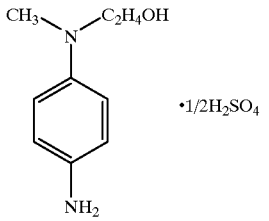

(C-7)

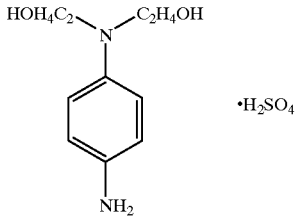

(C-8)

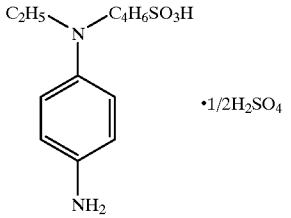

(C-9)

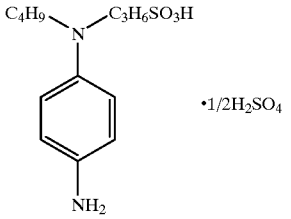

(C-10)

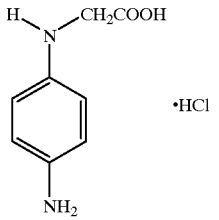

(C-11)

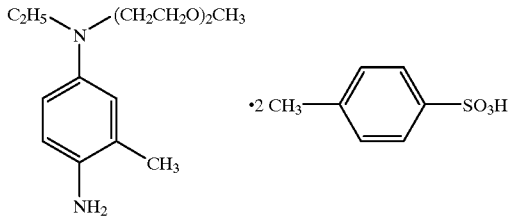

-continued (C-12)

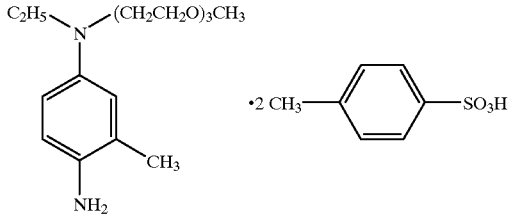

(C-13)

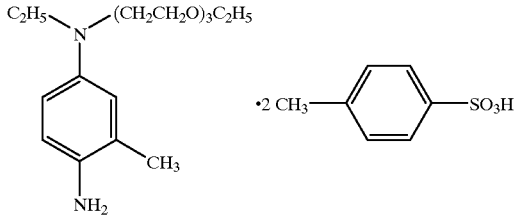

(C-14)

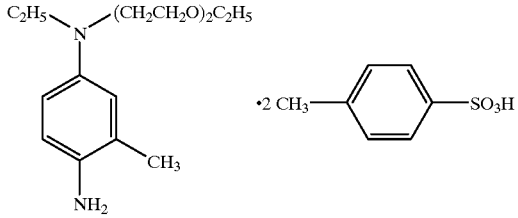

(C-15)

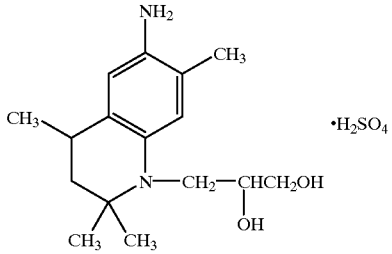

(C-16)

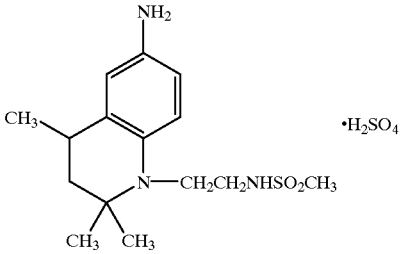

Among the above-shown color developing agents, C-1, C-2, C-3, C-4, C-6, C-7 and C-15 are preferred, and C-1 and C-3 are particularly preferred.

The above-mentioned para-phenylenediamine compound is usually used in a form of hydrochloride, sulfate or p-toluenesulfonate.

The using amount of the color developing agent is usually from 10 to 150 g, preferably from 10 to 100 g, more preferably from 15 to 70 g, per liter of the total of the developing partial liquids usually supplied.

As the solubilizing agent for developing agent, triethanolamine, a polyethylene glycol, and paratouenesulfonic acid described in Japanese Patent O.P.I. Publication No. 8-202003 are usable. The solubilizing agent is usually used in an amount of from 1 to 100 g, preferably 5 to 80 g, more preferably 10 to 50 g, per liter of the total of the developing partial solutions usually supplied.

In the invention, the alkaline component is one giving a pH value not less than 8.0 when 7.0 g of the component is dissolved in pure water and finished to 1 liter, and is preferably an alkali metal compound such as potassium carbonate, sodium carbonate, sodium bicarbonate, potassium bicarbonate, trisodium phosphate, tripotassium phosphate, dipotassium phosphate, sodium borate, potassium borate, sodium tetraborate or borax, potassium tetraborate, potassium hydroxide, sodium hydroxide, and lithium hydroxide are usable.

Among them, sodium carbonate, sodium bicarbonate, trisodium phosphate and sodium borate are preferred, and sodium carbonate is particularly preferred for the effect of the invention.

The alkaline component is usually used in an amount of from 10 to 300 g, preferably 10 to 150 g, more preferably 20 to 100 g, per liter of the total of the developing processing solutions usually supplied.

As the preservative, sodium sulfite, hydroxylamine, and hydroxylamines described on pages 9 through 13 of Japanese Patent O.P.I. Publication No. 8-29924 are usable.

The surface tension of the processing liquid is preferably 20 to 45 dyne/cm, and more preferably 25 dyne/cm to 35 dyne/cm. In order to regulate the surface tension, it is preferable to incorporate fluorine-containing agents disclosed in Japanese O.P.I No. 7-92634 at pages 3–5 or a nonion type activators such as an ethyleneoxide type or a glycidol type or silicone type activators disclosed in Japanese Patent O.P.I. Publication No. 4-299340 at pages 11-31.

Supplying amount of the processing liquid is preferably controlled proportional to the exposure level of the light sensitive material.

[Heating means]

It is preferable that the surface of the heated light-sensitive material to 40° C. or higher, specifically 45 to 95° C. From the viewpoint of heat durability of the light-sensitive material and controllability for processing, further, prevention of reticulation of the light sensitive material 50 to 90° C. is preferably.

As a heating means, a transmission heating means in which a heat drum or a heat belt contacts the light-sensitive material for transmitting heat, a convection heating means due to convection of hot air from a drier and an irradiation heating means due to irradiation of infrared beam or high frequency electromagnetic wave are exemplified.

The transmission heating means is preferably employed in the invention.

The light sensitive material is preferably heated by such means just before the supplying the processing liquid. It is preferable that the light sensitive material is heated by such means during supplying and thereafter prior to entering the subsequent bleaching or bleach-fixing process to keep at predetermined temperature (40° C. or more). It is preferable for the invention to process by a subsequent processing liquid having bleaching ability within 2 to 20 second after supplying the processing liquid to the light sensitive material.

To provide a heating control means which controls in such a manner that a heating means heats the light-sensitive material when the silver halide photographic light-sensitive material exists at a point where the heating means heats is preferable since unnecessary heating can be prevented. The present invention is attained by having a conveyance means which conveys the silver halide photographic light-sensitive material at a prescribed conveyance speed and a light-sensitive material sensing means which senses the existence of the silver halide photographic light-sensitive material at a prescribed position on the upstream side in the conveyance direction compared with a position where the heating means heats, wherein the heating control means conducts controlling based on the sensing of the light-sensitive material sensing means. It is preferable to control the heating by the heating means since a prescribed time passed after the sensing of the existence of the silver halide photographic light-sensitive material from non-existence at a prescribed position by the light-sensitive material sensing means until a prescribed time passed after (including just after) the sensing of the nonexistence of the silver halide photographic light-sensitive material from existence at a prescribed position by the light-sensitive material sensing means.

In the case of a transmission heating means, in order to prevent adverse affects onto the emulsion surface of the light-sensitive material processed, it is preferable that a heat source contacts the light-sensitive material processed from the rear side.

Processing liquid supplying means

The processing liquid supplying means can be roughly divided into a system in which the solution is supplied by splaying or through a gas phase, and a system in which the liquid is supplied by coating through a tool such as a roller or coater, or directly supplied to contact.

As the system supplying through gas phase, a method got scattering droplet of the solution using the vibration of a piezoelectric element such as a piezo-type ink-jet head or a thermal head using bumping, which is preferably employed since the amount of processing liquid can be controlled and a portion of light sensitive material to be supplied can be selected. A splay method in which the solution is splayed by pressure of air or a liquid, are usable.

It is preferable that the processing liquid is supplied by droplets in case supplied through gas phase, and the volume of processing droplets supplied at one time preferably $0.1\times10^{-6}$ to $50\times10^{-6}$ ml, more preferably $0.5\times10^{-6}$ to $5\times10^{-6}$ ml.

As the method of coating through a tool or directly coating, an air doctor coater, a blade coater, a rod coater, a knife coater, a squeeze coater, an immersing coater, a reverse coater, a transfer coater, a curtain coater, a double roller coater, a slide hopper, a gravure coater, a kiss-roller coater, a bead coater, a cast coater, a spray coater, a calender coater and a extruding coater are usable. The coating method employed preferably in the invention is a squeeze coater, a gravure coater, an immersing coater, a bead coater and a blade coater, in view of coating amount and uniform coating of the processing liquid.

A roller coating method and slit extrusion coating means are preferable in view of compact apparatus and convenience of handling, and obtaining preferable supplying amount.

Material of Roll Coating Means

Material of roller coating means preferably employed in the present invention includes cloth, non-woven cloth, porous material such as sponge, and more preferably chemical proof and soft material hard to give damage to the emulsion surface of the light sensitive material. Further, surface of roller is preferably composed of or covered with a material capable of water absorbing and water keeping in view of effect of the present invention.

The material of the cloth or non-woven cloth includes polyolefin series fiber, polyester fiber, polyacrylonitrile series fiber, aliphatic polyamide series fiber, aromatic polyamide series fiber, polyphenylene sulfide fiber are preferable.

The porous material such as sponge includes vinyl chloride, silicone rubber, polyurethane, ethylene propylene rubber (EPDM), polyvinyl alcohol (PVA), neoprene rubber, butyl rubber series fiber, alkylbenzene sulfonic acid resin (ABS), phenol resin as preferable example. In addition thereto Rupicel (trade name), Krarino (trade name), POR (composition of pulverized urethane bound with a resin in the condition maintaining void) are also example of preferable porous material.

Material of roller preferably employed in the present invention is a porous material, whose practical examples are set forth above. By employing these material roller is able to coat the supplied processing liquid stably.

The processing liquid is supplied to coating means. By the supplying method the processing liquid is conveyed in constant volume from the processing liquid container by means of a constant pump such as a bellows pump, tube pump or ceramic pump, then is supplied to the coating means through a pipe shaped nozzle having single or plural slit or openings lined in a single array or zigzag array.

The roller employed in the present invention preferably has a function in combination to convey a light sensitive material by pushing it with certain pressure. According to this, the light sensitive material is conveyed smooth, and further, the processing power of the light sensitive material becomes better.

The processing liquid is controlled so as to coat it uniformly and constantly with small amount by coating amount control means whose example includes stepping motor, tube pump or ceramic pump.

In a so-called ink-jet method the processing liquid may be supplied through fixed head arrayed linearly or through a scanning head.

Distance between the processing liquid supplying opening to the light sensitive material surface is preferably not less than 50 micrometer, particularly not less than 1 mm, in view of uniform coating and not more than 10 mm, particularly 5 mm is preferably in view of avoiding scattering processing liquid.

When the present invention is applied to a light-sensitive material for color print, the composition of the silver halide emulsion may be any ones which have arbitrary halogen composition such as silver chloride, silver bromide, silver bromochloride, silver bromoiodide, silver bromoiodochloride and silver iodochloride. However, silver bromochloride substantially not containing silver iodide in which silver chloride is contained by 95 mol % or more. From viewpoint of rapid processing property and processing stability, a silver halide emulsion having preferably 97 mol % or more and more preferably 98–99.9 mol % of silver chloride.

In order to obtain the silver halide emulsion of the present invention, a silver halide emulsion having a portion where containing silver bromide at high density. In this occasion, the portion where containing silver bromide at high density may have an epitaxy joint by silver halide emulsion grains or it may be a so-called core-shell emulsion. In addition, aforesaid portion does not form a complete layer where there are regions having different composition each other partially. In addition, the composition may be changed continuously or discontinuously. It is specifically preferable that the portion containing silver bromide at high density is the top of crystal grains on the surface of the silver halide grains.

In the silver halide emulsion of the present invention, heavy metal ion may be incorporated. As the heavy metal ion usable, metals of 8th to 10th group in the periodic table such as iron, iridium, platinum, paradigm, nickel, rhodium, osmium, ruthenium and cobalt and transition metals in the 12th group such as cadmium, zinc and mercury and lead, rhenium, molybdenum, tungsten and chrome. Of these, transitional metallic ions such as iron, iridium, platinum, ruthenium and osmium are preferable.

The above-mentioned metallic ions can be added to the silver halide emulsion in a form of a salt and a complex salt.

In case that the above-mentioned heavy metal ion forms a complex, as its ligand or ion, cyanide ions, thiocyanate ions, cyanate ions, chloride ions, bromide ions, iodide ions, nitrate ions, carbonyl and ammonia are cited. Of these, cyanide ions, thiocyanate ions, isocyanate ions, chloride ions and bromide ions are preferable.

In order to incorporate the heavy metal ion in the silver halide emulsion, aforesaid heavy metal compound may be added at any place of each step, i.e., before forming silver halide grains, during forming the silver halide grains or during physical ripening after forming the silver halide grains. The heavy metal compound may be dissolved together with the halogenide salt and be added at all through the grain forming step continuously or at a part of aforesaid step.

The added amount of the heavy metal ion into the silver halide emulsion, $1\times10^{-9}$ to $1\times10^{-2}$ mol is preferable and $1\times10^{-3}$ to $1\times10^{-5}$ mol per mol of silver halide is specifically preferable.

With regard to the form of the silver halide grains, arbitrary ones may be used. One of preferable examples is cubic having (100) plane as a crystal surface. In addition, by methods described in U.S. Pat. Nos. 4,183,756 and 4,225,666, Japanese Patent O.P.I. Publication No. 55-26589, Japanese Patent Publication No. 55-42737 and The Journal of Photographic Science (J. Photogr. Sci.) 21, 39 (1973), grains having octagonal, tetradecahedral and dodecahedral crystal are formed to be used. In addition, grains having twinned surface may be used.

With regard to the silver halide grain, grains composed of a single form may be used. And, particularly preferable is two or more monodispersed emulsions are added in an emulsion layer.

As for the grain size of the silver halide grain, the range of 0.1–1.2 $\mu$m is preferable and 0.2–1.0 $\mu$m is more preferable considering other photographic performances such as rapid processing property and sensitivity.

Aforesaid grain size can be measured by the use of a projected area of the grain or a diameter approximate value. If the grain is substantially uniform, the grain size distribution can considerably be represented in terms of a diameter or a projected area.

The distribution of the grain size of the silver halide grain used for the present invention may be polydispersed. However, preferably a mono-disperse silver halide grain whose variation coefficient was preferably 0.22 or less and more preferably a mono-dispersed silver halide grains whose variation coefficient was 0.15 or less. It is specifically preferable to add two or more kinds of mono-dispersed emulsions whose variation coefficient is respectively 0.15 or less. Here, the variation coefficient is a coefficient representing the width of grain size distribution, and is defined by the following equation:

variation coefficient=$S/R$ (S: the standard variation of the grain size distribution, R: average grain size)

wherein, the grain size is defined to be a diameter in the case of a spherical silver halide grains. In addition, the form of the grain is other than cubic or spherical, it is defined to represent a diameter when its projected image is converted to a cycle image having the same area.

As a preparation apparatus and the method of the silver halide emulsion, various conventional methods in the relevant field can be used.

The silver halide emulsion may be produced by means of any of an acidity method, a neutral method and an ammonia method. Aforesaid grain may be grown linearly. In addition, aforesaid grain may be grown after seed grains were prepared. A method to prepare a seed grain and a method to grow may be the same or different.

In addition, with regard to a style to react a soluble silver salt and a soluble halide product, any methods including an ordinary mixing method, a reverse mixing method and their mixture may be adopted. Among these, a double jet method is preferable. As one style of the double jet method, a pAg controlled double jet method described in Japanese Patent O.P.I. Publication No. 54-48521 can be used.

In addition, an apparatus disclosed in Japanese Patent O.P.I. Publication Nos. 57-92523 and 57-92524 wherein water-soluble silver salt and water-soluble halogenated compound salt aqueous solution is fed from an addition device placed in an initial solution for reaction, an apparatus disclosed in German Patent No. 2921164 wherein the concentration of water-soluble silver salt and water-soluble halogenated compound salt aqueous solution is continuously changed for adding, or an apparatus disclosed in Japanese Patent Publication No. 56-501776 wherein grains are formed while the distance between each silver halide grain is kept constant by taking an initial solution outside of a reactor and concentrating it by the use of a ultra filtration method may be used.

In addition, if necessary, silver halide solvents such as thioether may be used. In addition, compounds having a mercapto group and compounds such as nitrogen-containing heterocycles or sensitizing dyes may be used by adding during formation of silver halide grains or after completion of forming grains.

The silver halide emulsion may be sensitized by the use of sensitizing methods using gold compounds and sensitizing methods using chalcogen sensitizers in combination.

As chalcogen sensitizers applicable, sulfur sensitizers, selenium sensitizers and tellurium sensitizers can be used. Among them, sulfur sensitizers are desirable. As sulfur sensitizers, thiosulfate, allylthiocarbamidothiourea, allylisothiacyanate, cystine, p-toluenethiosulfonate salt, rhodanine and an inorganic sulfur are cited.

The added amount of sulfur sensitizers is different depending upon the kind of silver halide emulsion and intended effects, preferably $5\times10^{-10}$ to $5\times10^{-5}$ mol per mol of silver halide, and more preferably $5\times10^{-8}$ to $3\times10^{-5}$ mol per mol of silver halide.

The gold sensitizers applicable can be added in the form of gold chloride, silver chloride, gold sulfide, gold thiosulfate and various gold complex. As compounds to be used therein, dimethylrhodanine, thiocyanate, mercaptotetrazole and mercaptotriazole are cited. The added amount of gold compounds is different depending upon the kind of silver halide emulsion, kind of compounds used and ripening conditions, preferably $1\times10^{-4}$ to $1\times10^{-8}$ mol per mol of silver halide, and more preferably $1\times10^{-5}$ to $1\times10^{-8}$ mol per mol of silver halide.

As chemical sensitizing of the silver halide emulsion reduction sensitizing may be carried out.

In the silver halide emulsion, conventional anti-foggants and stabilizers can be used for preventing fog which occurs during preparation step of a silver halide photographic light-sensitive material, for reducing fluctuation in properties during storage and preventing fog which occurs when being developed. As an example of compounds used for such purposes, compounds represented by formula (II) described in the lower column on page 7 of Japanese Patent O.P.I. Publication No. 146036/1990 are cited. Practical examples thereof are compounds (IIa-1) through (IIa-8) and (II-b) through (IIb-7), 1-(3-methoxyphenyl)-5-mercaptotetrazole and 1-(4-ethoxyphenyl)-5-mercaptotetrazole are cited.

These compounds are added, depending upon their purposes, in a preparation step, in a chemical sensitization step, at the end of chemical sensitization step and in a preparation step for a coating solution. When chemical sensitization is carried out in the presence of these compounds, the addition amount of these compounds are preferably $1\times10^{-5}$ to $5\times10^{-4}$ per 1 mol of silver halide. When these compounds are added after completion of chemical sensitization, the addition amount of these compounds are preferably $1\times10^{-6}$ to $1\times10^{-2}$, and more preferably $1\times10^{-5}$ to $5\times10^{-3}$ per 1 mol of silver halide. When these compounds are added to the silver halide emulsion during preparation of the coating solution, the addition amount of these compounds are preferably $1\times10^{-6}$ to $1\times10^{-1}$, and more preferably $1\times10^{-5}$ to $1\times10^{-2}$ per 1 mol of silver halide. When these compounds are added to layers other than silver halide emulsion layers, the content in the coating layer of these compounds are preferably $1\times10^{-9}$ to $1\times10^{-3}$ per $m^2$ of the coating layer.

To the silver halide photographic light-sensitive materials of the present invention, dyes having absorption ability for various wavelength can be used for preventing irradiation and halation. The conventional dyes can be used, and, dyes AI-1 to AI-11 described in Japanese Patent O.P.I. Publication No. 3-251840/1991, page 308 or dyes described in Japanese Patent O.P.I. Publication No. 6-3770/1994 are preferably used, as dyes having an absorption in the visible light wavelength region. The dyes represented by the general formula (I), (II) or (III) described in Japanese Patent O.P.I. Publication No. 1-280750/1989, page 2, lower left side are preferably used as infrared absorption dyes which have preferable spectral characteristic, in view of no adverse affect on photographic properties of photographic emulsions or staining due to remaining color. The preferable examples includes exemplified compounds (1) through (45) described in Japanese Patent O.P.I. Publication No. 1-280750/1989, page 3, lower left side through page 5, lower left side.

The addition amount of these dyes is preferably an amount necessary to give a spectral reflective density at 680 nm of preferably 0.7 or more, and more preferably 0.8 or more in non-processed light sensitive material, in view of sharpness improvement.

The light sensitive material preferably contains a brightening agent in view of white background improvement. The brightening agent preferably includes the compound represented by formula II described in Japanese Patent O.P.I. Publication No. 2-2326520.

When a silver halide photographic light-sensitive material is used as a color photographic light-sensitive material, it is combined with a yellow coupler, a magenta coupler and a cyan coupler to have layers containing a silver halide emulsion subjected to spectral sensitization on a specific region of 400–900 nm. Aforesaid silver halide emulsion contains one kind of or two or more kind of sensitizing dyes in combination.

As a spectral sensitizing dye used in the silver halide emulsion, any of compounds can be used. As a blue sensitive sensitizing dye, compounds BS-1 through 8 described in Japanese Patent O.P.I. Publication No. 3-251840 can be preferably used independently or mixingly in combination. As a green sensitive sensitizing dye, GS-1 through 5 described in Japanese Patent O.P.I. Publication No. 3-251840, on page 28 are preferably used. It is preferable to mix aforesaid infrared, red, green and blue sensitive sensitizing dyes with super sensitizers SS-1 through SS-9 described in Japanese Patent O.P.I. Publication No. 4-285950, on pp. 8–9 or compounds S-1 through S-17 described in Japanese Patent O.P.I. Publication No. 5-66515, on pp. 15–17.

Addition timing of aforesaid sensitizing dye may be arbitrary from formation of the silver halide grains to complete of chemical sensitization.

As an addition method of the sensitizing dye, they may be dissolved in water-mixing organic solvent such as methanol, ethanol, alcohol fluoride, acetone and dimethylformamide or water, and added as a solution. Or, they may be added as a solid dispersant.

As couplers employed in the light-sensitive material according to the present invention, can be employed any compounds which can form a coupling product (e.g., a dye) having a spectral absorption maximum at the wavelengths of 340 nm or longer upon coupling with an oxidized color developing agent. Particularly, representative compounds include a yellow dye forming coupler having a spectral absorption maximum at the wavelengths in the region of 350 to 500 nm, magenta dye forming coupler having a spectral absorption maximum at the wavelengths in the region of 500 to 600 nm and a cyan dye forming coupler having a maximum spectral absorption at the wavelengths in the region of 600 to 750 nm.

As a cyan dye forming coupler a naphthol series and phenol series coupler are employed preferably in the present invention.

When the light sensitive material of the present invention in particular is employed as direct appreciation of color paper, 2,5-diacylaminophenol cyan coupler described in U.S. Pat. No. 2,895,826, Japanese Patent O.P.I. Publication Nos. 50-112038, 53-109630, 55-163537 and 63-96656, phenol cyan coupler containing alkyl group having 2 or more carbon atom at 5 position described in U.S. Pat. Nos. 3,772,002, and 4,443,536 are employed favorably in view of stiffness of the dye image and color reproduction.

In addition to the naphthol or phenol coupler mentioned above, preferably employed are imidazole cyan coupler described in Japanese Patent O.P.I. Publication Nos. 1-156748, 3-174153, and 3-196039, pyrazolo azole cyan coupler or pyrazolo azine cyan coupler described in Japanese Patent O.P.I. Publication Nos. 2-136854 and 3-196039, hydroxypyridine cyan coupler, hydroxy diazin cyan coupler described in Japanese Patent O.P.I. Publication Nos. 3-103848 and 3-103849, aminopyridine line cyan coupler described in Japanese Patent O.P.I. Publication No. 3-206450 and pyrrolo triazole series cyan coupler described in Japanese Patent O.P.I. Publication Nos. 10-3147, 10-20462 and 10-97040, in view of color reproduction, dye image durability and improved cyan dye loss.

Concrete examples of cyan coupler employed in the invention.

CC-1

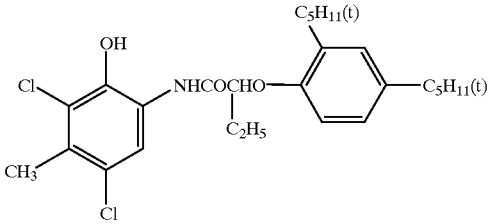

CC-2

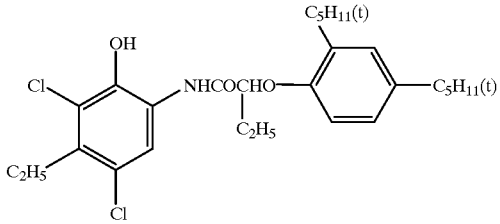

CC-3

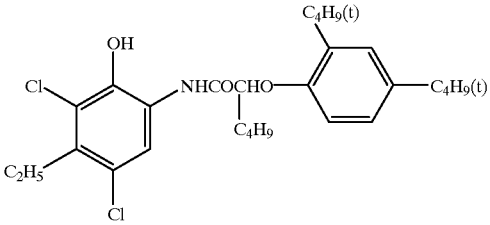

CC-4

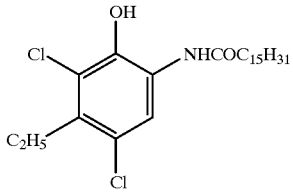

CC-5

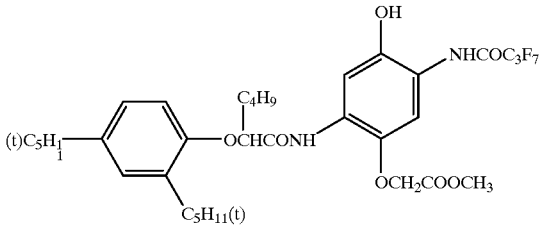

CC-6

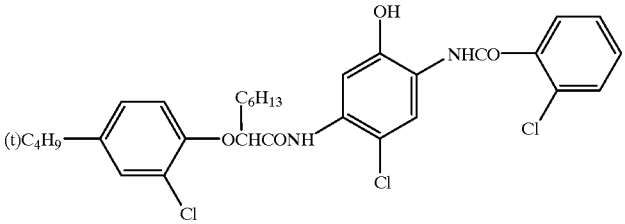

CC-7

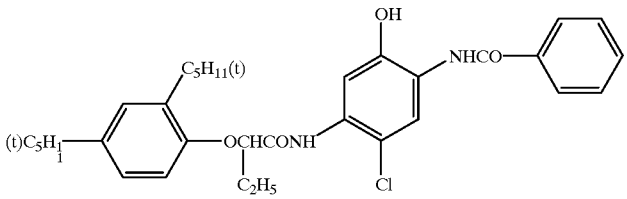

CC-8

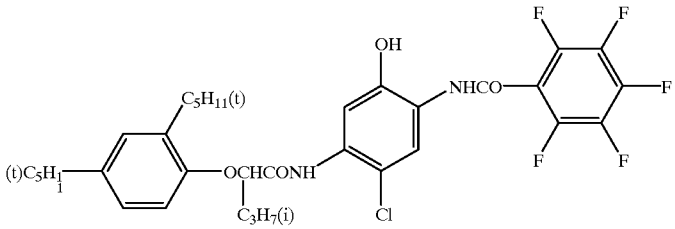

-continued

CC-9

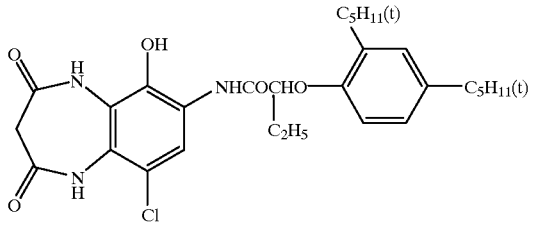

CC-10

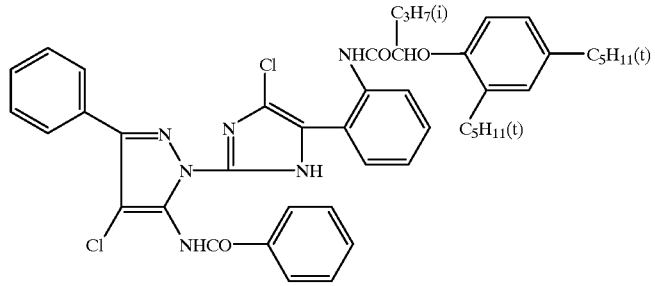

CC-11

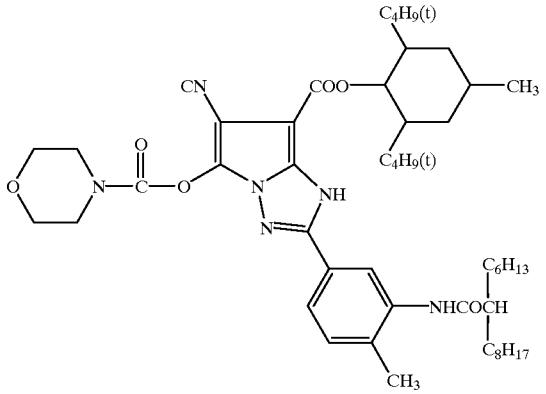

CC-12

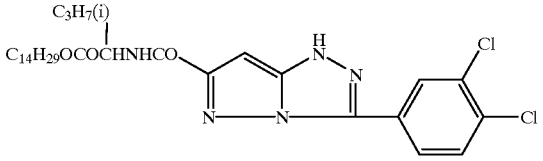

CC-13

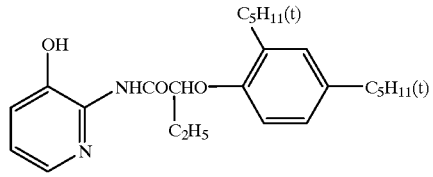

CC-14

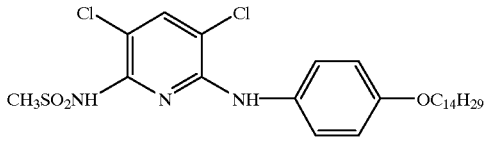

Further, examples of the phenol cyan coupler include exemplified compounds C-1 to C-31 described in Japanese Patent O.P.I. Publication No. 63-96656 at 4-6 pages, exemplified compounds III-1 to III-31, and IV-1 to IV-20 described in Japanese Patent O.P.I. Publication No. 1-196048, at 10-13 pages, exemplified compounds C-1 to C-22 described in Japanese Patent O.P.I. Publication No. 3-109549, and exemplified compounds C-1 to C-42 described in Japanese Patent O.P.I. Publication No. 62-215272, at 99–103 pages, and examples of cyan coupler other than the phenol coupler includes exemplified compounds A-1 to A-13, B-1 to B-16, C-1 to C-8 and D-1 to D-8 described in Japanese Patent O.P.I. Publication No. 2-136854, at 5–7 pages, exemplified compounds (1) to (69) described in Japanese Patent O.P.I. Publication No. 3-103848, at 7–13 pages, exemplified compounds C-1 to C-103 and D-1 to D-31 described in Japanese Patent O.P.I. Publication No. 3196039, at 10–16 pages and 18-20 pages, and exemplified compounds (1) to (34) described in Japanese Patent O.P.I. Publication No. 10-77040, at 6–14 pages.

The preferable surfactant used in dispersing photographic additives or adjusting surface tension includes compounds which have a hydrophobic group with 8 to 30 carbon atoms and a sulfonic acid group or its salt group in a molecule. The examples include compounds A-1 to A-11 described in Japanese Patent O.P.I. Publication No. 62-26854. The surfactant having a fluorinated alkyl group is preferably used. The dispersion solution of the compounds is usually added to a coating solution containing a silver halide emulsion. The time between their dispersion and their addition to the coating solution or the time between their addition and the coating is preferably shorter, each being preferably 10 hours or less, more preferably 3 hours or less and still more preferably 20 minutes or less.

The anti-fading additive is preferably added to each coupler layer in order to prevent discoloration of a formed dye image due to light, heat or humidity. The especially preferable compounds include phenylether compounds represented by formulas I to II described in Japanese Patent O.P.I. Publication No. 2-66541, 3 page, phenol compounds A-1 to A-11 represented by formula IIIB described in Japanese Patent O.P.I. Publication No. 3-174150, amine compounds represented by formula A described in Japanese Patent O.P.I. Publication No. 64-90445, and metal complexes represented by formula XII, XIII, XIV or XV described in Japanese Patent O.P.I. Publication No. 62-182741, which are preferable especially for a magenta dye. The compounds represented by formula I' described in Japanese Patent O.P.I. Publication No. 1-196049 or compounds represented by formula II described in Japanese Patent O.P.I. Publication No. 5-11417 are preferable for a yellow or cyan dye.

For the purpose of shifting an absorption wavelength of a color dye compound (d-11) described on pages 33 and compound (A'-1) described on pages 35 of Japanese Patent O.P.I. Publication No. 4-114152 can be used. Besides the compounds, a fluorescent dye releasing compound disclosed in U.S. Pat. No. 4,774,187 may be used.

The compound capable of reacting with an oxidation product of a color developing agent is preferably added to the layers between the two silver halide emulsion layers to prevent color mixture or to the silver halide emulsion layers to restrain fog. The compounds include preferably hydroquinone derivatives, more preferably dialkylhydroquinone such as 2,5di-t-octylhydroquinone. The especially preferable compounds includes a compound represented by formula II described in Japanese Patent O.P.I. Publication No. 4-133056, and compounds II-1 through II-14 on pages 13 and 14 and compound 1 described on page 17, of the same Japanese Patent O.P.I. Publication.

The UV absorber is preferably added to light sensitive material to restrain static fog or to improve light fastness of a formed dye image. The preferable UV absorber includes benzotriazoles, and more preferably a compound represented by formula III-3 described in Japanese Patent O.P.I. Publication No. 1-250944, a compound represented by formula III described in Japanese Patent O.P.I. Publication No. 64-66646, UV-1L through UV-27L described in Japanese Patent O.P.I. Publication No. 63-187240, a compound represented by formula I described in Japanese Patent O.P.I. Publication No. 4-1633, and a compound represented by formula (I) or (II) described in Japanese Patent O.P.I. Publication No. 5-165144.

For the silver halide photographic light-sensitive materials, it is advantageous to use gelatin as a binder. In addition, other gelatins, gelatin derivatives, graft polymers between gelatin and other polymers, proteins other than gelatin, sugar derivatives, cellulose derivatives and hydrophilic colloid such as synthetic hydrophilic polymers including homopolymers or copolymers can also be used if necessary.

The hardeners for a binder may be used. As hardeners, vinylsulfone type hardeners and chlorotriazine type hardeners are preferably used singly or in combination. The compounds described in Japanese Patent O.P.I. Publication Nos. 61-249054 and 61-245153 are preferably used. The antiseptic agent or anti-fungal described in Japanese Patent O.P.I. Publication No. 3-157646 are preferably added to the colloid layer in order to prevent breed of bacilli or fungi which adversely affects photographic properties or image storage stability. The lubricant or matting agent described in Japanese Patent O.P.I. Publication Nos. 6-118543 and 2-73250 is preferably added to a protective layer in order to improve surface property of the non-processed or processed light sensitive material.

The support used in the color light sensitive material of the invention may be any material, and includes papers covered with polyethylene or polyethylene terephthalate, paper supports made of natural or synthetic pulp, a polyvinyl chloride sheet, polypropylene containing a white pigment, polyethyleneterephthalate support and baryta papers. The support comprising a paper and a water-proof resin layer provided on each side thereof is preferable. The water-proof resin preferably is polyethylene, polyethyleneterephthalate or their copolymer.

As white pigments to be used for the support, inorganic and/or organic white pigments can be used. The preferred are inorganic white pigments. For example, sulfate of alkaline earth metals such as barium sulfate, carbonate salts of alkaline earth metals such as calcium carbonate, silica such as fine silicate and synthetic silicate, calcium silicate, alumina, alumina hydrate, titanium oxide, zinc oxide, talc and clay are cited. The preferred white pigments are barium sulfate and titanium oxide.

The amount of white pigment contained in the water-proof resin layer on the surface of the support is preferable to be not less than 13% by weight, and more preferable to be not less than 15% by weight, in view of improved image sharpness.

The degree of dispersion of white pigment in the water-proof resin layer on a paper support used can be measured by means of a method described in Japanese Patent O.P.I. Publication No. 2-28640. When measured by means of this method, the degree of dispersion of white pigment is preferable to be not more than 0.20, and more preferable to be not more than 0.15 in terms of fluctuation coefficient described in the aforesaid Publication, in view of improved glossiness.

The average roughness of center surface the support is preferably 1.05 $\mu$m or less, more preferably 0.12 $\mu$m or less because of improved glossiness. The white pigment containing water-proof resin layer of a paper support or hydrophilic colloid layer coated on a paper support preferably contains a bluing agent or reddening agent such as ultramarine or oil-soluble dyes in order to adjust a reflective density balance of white background after processing and to improve whiteness.

After the surface of the support is provided with corona discharge, UV ray irradiation and firing treatment if necessary, a light-sensitive materials may be coated directly or through subbing layers (one or two or more subbing layer in order to improve adhesiveness, anti-static property stability in sizing, anti-abrasion property, stiffness, anti-halation property, abrasion property and/or other properties of the surface of the support.)

When a light-sensitive materials using silver halide emulsions is coated, a thickener may be used. As coating methods, an extrusion coating method and a curtain coating method is especially advantageous because they can coat 2 or more layers concurrently.

An image forming method employing the color light sensitive material of the invention includes a method comprising printing on a photographic paper an image formed on a negative, a method comprising converting an image to digital information, displaying the image from the information on a CRT (cathode ray tube), and then printing the displayed image on a photographic paper, and a method comprising printing an image on a photographic paper by scanning a laser light which strength is varied based on digital information.

The invention is applied to preferably a light sensitive material containing no color developing agent, and more preferably a light sensitive material capable of forming an image for direct appreciation. The example includes color paper, color reversal paper, a light sensitive material capable of forming a positive image, a light sensitive material for display and a light sensitive material for color proof. The invention is applied to especially preferably a light sensitive material having a reflective support.

As a developing apparatus used for developing the silver halide photographic light-sensitive material of the present invention, a roller transportation type in which a light-sensitive material is sandwiched by rollers provided in the processing tank to be conveyed or an endless belt type in which the light-sensitive material is fixed on a belt. In addition, a system in which the processing tank is formed in a slip shaped and the light-sensitive material is conveyed together with feeding the processing composition onto aforesaid processing tank, a spray type in which a processing composition is sprayed, a web type in which a carrier immersed in the processing composition is contacted and a type using a viscosity processing composition. When a light-sensitive material is processed in a large amount, it is ordinary to conduct running processing using an automatic developing machine. In this occasion, the replenishment amount of the replenisher composition is smaller, the preferable. The most preferable processing style from viewpoint of environment friendliness is to add a replenishing composition in a form of replenishing tablet. A method disclosed in Published Technical Report No. 16935/1994 is the most preferable.

EXAMPLES

The present invention is explained based on examples.

Referential Example

A pulp paper having a weight of 180 g/m$^2$ was laminated on both sides by high density polyethylene to prepare a paper support. The surface on which the emulsion layer to be coated was laminated by a molten polyethylene in which 15% by weight of surface-treated anatase type titanium oxide was dispersed to prepare a reflective support. The reflective support was subjected to corona discharge treatment and coated with a gelatin subbing layer. Then the layers each having the following composition were coated on the surface of the support to prepare a silver halide photographic light-sensitive material. The coating liquids were prepared as follows.

First layer coating liquid

To 60 ml of ethyl acetate, 23.4 g of yellow coupler (Y-1), 3.34 g of (ST-2), 3.34 g of dye image stabilizing agent (HQ-1), 5.0 g of image stabilizing agent A, 3.33 g of high-boiling organic solvent (DBP) and 1.67 g of high-boiling organic solvent (DNP) were added and dissolved. The solution was dispersed in 220 ml of a 10% aqueous solution of gelatin containing 7 ml of a 20% solution of surfactant (SU-1) by using an ultrasonic homogenizer to prepare a yellow coupler dispersion. The dispersion was mixed with a blue-sensitive silver halide emulsion prepared under the following conditions to prepare a first layer coating liquid.

Coating compositions for second through seventh layers were each prepared in the similar manner so that the coating amounts were as the followings.

Compounds (H-1) and (H-2) were added as hardeners. For adjusting the surface tension, surfactants (SU-2) and (SU-3) were added. Furthermore, compound F-1 was added to each layer so that the total amount is 0.04 g/m$^2$.

TABLE 1

| Layer | Composition | Amount (g/m$^2$) |
|---|---|---|
| Layer 7 (Protective layer) | Gelatin | 1.00 |
| | DIDP | 0.002 |
| | DBP | 0.002 |
| | Silicon dioxide | 0.003 |
| Layer 6 (UV-absorption layer) | Gelatin | 0.40 |
| | AI-1 | 0.01 |
| | UV-absorbent (UV-1) | 0.12 |
| | UV-absorbent (UV-2) | 0.04 |
| | UV-absorbent (UV-3) | 0.16 |
| | Antistaining agent (HQ-5) | 0.04 |
| | PVP | 0.03 |
| Layer 5 (Red-sensitive layer) | Gelatin | 1.30 |
| | Red-sensitive silver chlorobromide emulsion (Em-R) | 0.21 |
| | Cyan coupler (C-1) | 0.25 |
| | Cyan coupler (C-2) | 0.04 |
| | Cyan coupler (C-3) | 0.04 |
| | Dye-image stabilizer (ST-1) | 0.10 |
| | Antistaining agent (HQ-1) | 0.004 |
| | DBP | 0.10 |
| | DOP | 0.20 |

TABLE 2

| Layer | Composition | Amount (g/m$^2$) |
|---|---|---|
| Layer 4 (UV-absorption layer) | Gelatin | 0.94 |
| | UV-absorbent (UV-1) | 0.28 |
| | UV-absorbent (UV-2) | 0.09 |
| | UV-absorbent (UV-3) | 0.38 |
| | AI-1 | 0.02 |
| | Antistaining agent (HQ-5) | 0.10 |
| Layer 3 (Green-sensitive layer) | Gelatin | 1.30 |
| | AI-2 | 0.01 |
| | Green-sensitive silver chlorobromide emulsion (Em-G) | 0.13 |
| | Magenta coupler (MM-1) | 0.19 |
| | Dye-image stabilizer (ST-3) | 0.20 |
| | Dye-image stabilizer (ST-4) | 0.17 |
| | DIDP | 0.13 |
| | HBS-1 | 0.20 |
| Layer 2 (Intermediate layer) | Gelatin | 1.20 |
| | AI-3 | 0.01 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.04 |
| | DBO | 0.02 |
| | Brightening agent (W-1) | 0.10 |
| Layer 1 (Blue-sensitive layer) | Gelatin | 1.20 |
| | Blue-sensitive silver chlorobromide emulsion (Em-B) | 0.26 |
| | Yellow coupler (MM-1) | 0.70 |
| | Dye-image stabilizer (ST-2) | 0.10 |
| | Anti-stain agent (HQ-1) | 0.01 |
| | Image stabilizer A | 0.15 |
| | DNP | 0.05 |
| | DBP | 0.10 |
| Support | Polyethylene-laminated paper (Containing a slight amount of a tinting agent) | |

In the above, the amounts of silver halide emulsions are each described in terms of silver.

SU-2: Sodium tri-i-propylnaphthalenesulfonate

SU-1: Sodium salt of di-(2-ethylhexyl) sulfosuccinate

SU-3: Sodium salt of di-(2,2,3,3,4,4,5,5-octafluoropentyl)-sulfosuccinate

DBP: Dibutyl phthalate

DNP: Dinonyl phthalate

DOP: Dioctyl phthalate

DIDP: Di-i-decyl phthalate
PVP: Polyvinylpyrrolidone
HBS-1: Oleyl alcohol
H-1: Tetrakis(vinylsulfonylmethyl)methane
H-2: Sodium salt of 2,4-dichloro-6-hydroxy-s-triazine
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl)-butylhydroquinone
Image stabilizing agent A: p-t-octylphenol

Y-1

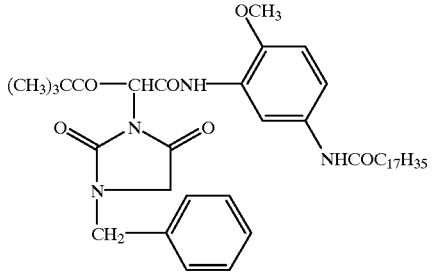

C-1

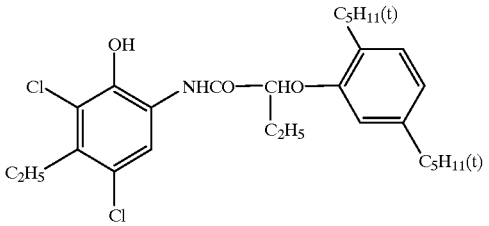

C-2

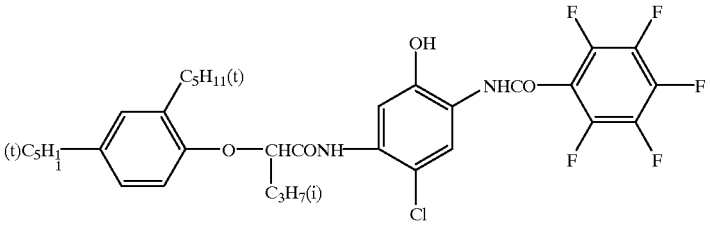

C-3

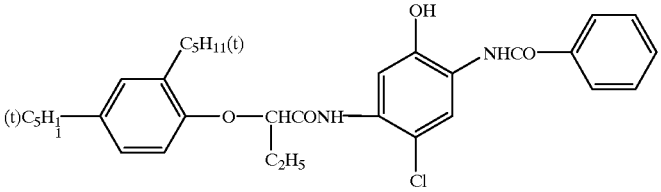

MM-1

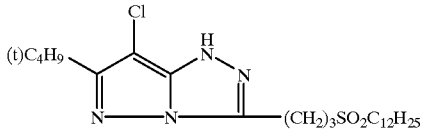

ST-1

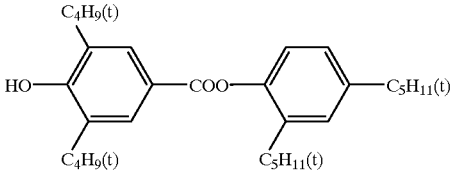

ST-2

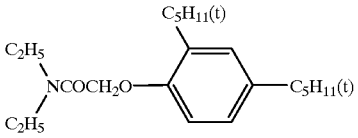

ST-3

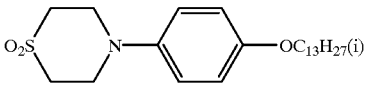

ST-4

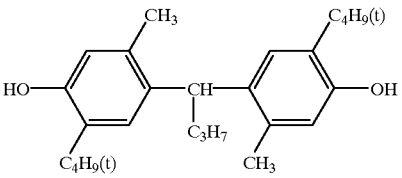

UV-1

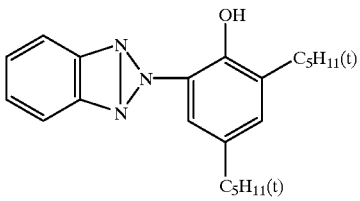

-continued

UV-2

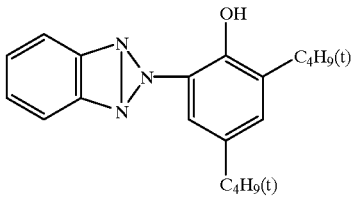

UV-3

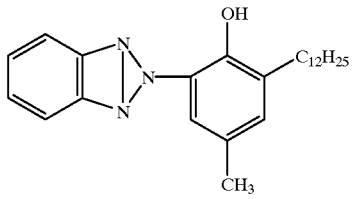

Al-1

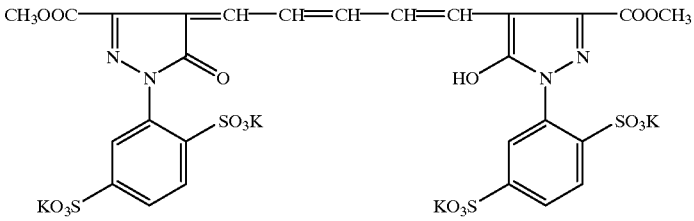

Al-2

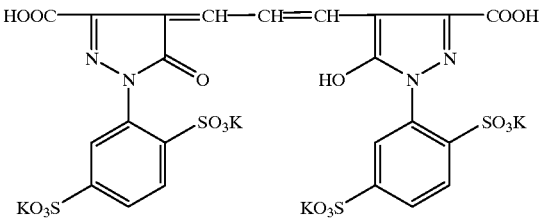

Al-3

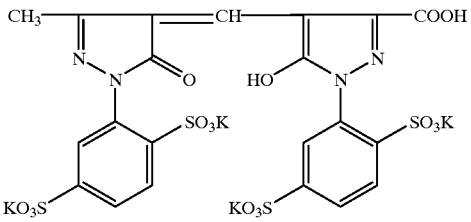

W-1

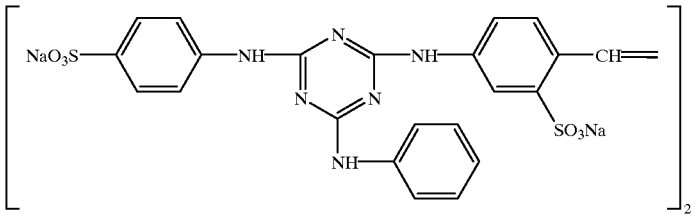

F-1

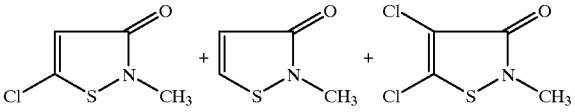

(50%) (46%) (4%)
molar ratio

Preparation of blue-sensitive silver halide emulsion

The following Solution A and Solution B were added by a double-jet method spending 30 minutes to 1 liter of a 2% aqueous gelatin solution maintaining at 40 C. while the pAg and pH were held at 7.3 and 3.0, respectively. Then Solution C and Solution D were added spending 180 minutes by a double-jet method while the pH and pAg were held at 8.0 and 5.5, respectively. The control of the pAg was carried out by the method described in Japanese Patent O.P.I. Publication No. 59-45437, and the control of the pH was carried out by the use of sulfuric acid or sodium hydroxide.

| Solution A | |
|---|---|
| Sodium chloride | 3.42 g |
| Potassium bromide | 0.03 g |
| Water to make | 200 ml |

-continued

| Solution B | |
|---|---|
| Silver nitrate | 10 g |
| Water to make | 200 ml |
| Solution C | |
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water make to | 600 ml |
| Solution D | |
| Silver nitrate | 300 g |
| Water make to | 600 ml |

After completion of the addition, the emulsion was desalted using a 5% aqueous solution of Demol N, manufactured by Kao-Atlas Co. Ltd., and a 20% aqueous solution of magnesium sulfate. Then the emulsion was mixed with an aqueous gelatin solution. Thus a monodisperse cubic emulsion EMP-1 was prepared, which had an average grain diameter of 0.71 μm, a variation coefficient of grain distribution of 0.07 and a silver chloride content of 99.5 mole %. A monodisperse cubic emulsion EMP-1B was prepared in the same manner except that the time for addition of Solution B and Solution C, and that of Solution D and Solution F were changed, which had an average grain diameter of 0.64 μm, a variation coefficient of grain distribution of 0.07 and a silver chloride content of 99.5 mole %.

EMP-1 was optimally subjected to chemical sensitization at 60° C. using the following compounds. Besides, EMP-1B was optimally subjected to chemical sensitization in a similar manner to prepare a blue-sensitive silver halide emulsion, and then the sensitized EMP-1 and Em-1B were mixed with together in a ratio of 1:1 in the silver amount. Thus blue-sensitive silver halide emulsion Em-B was obtained.

| | |
|---|---|
| Sodium thiosulfite | 0.08 mg/mole of AgX |
| Chlorauric acid | 0.5 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye BS-1 | $4 \times 10^{-4}$ moles/mole of AgX |
| Sensitizing dye BS-2 | $1 \times 10^{-4}$ moles/mole of AgX |

Preparation of green-sensitive silver halide emulsion

A monodisperse cubic emulsion EMP-2 was obtained in the same manner as in EMP-1 except that the adding time for Solution A and Solution B, and that for Solution C and Solution D were changed. EMP-2 had an average grain diameter of 0.40 μm, a variation coefficient of grain distribution of 0.08 and a silver chloride content of 99.5 mole %. Besides, a monodisperse cubic emulsion EMP-2B was prepared which had an average grain diameter of 0.50 μm, a variation coefficient of grain distribution of 0.08 and a silver chloride content of 99.5 mole %.

EMP-2 was optimally subjected to chemical sensitization at 55° C. using the following compounds. Besides, EMP-2B was optimally subjected to chemical sensitization in a similar manner. Thus sensitized EMP-2 and EMP-2B were mixed with together in a ratio of 1:1 in the silver amount. Thus green-sensitive silver halide emulsion Em-G was obtained.

| | |
|---|---|
| Sodium thiosulfite | 1.5 mg/mole of AgX |
| Chlorauric acid | 1.0 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye GS-1 | $4 \times 10^{-4}$ moles/mole of AgX |

Preparation of red-sensitive silver halide emulsion

A monodisperse cubic emulsion EMP-3 was obtained in the same manner as in EMP-1 except that the adding time for Solution A and Solution B, and that for Solution D and Solution E were changed. EMP-3 had an average grain diameter of 0.40 μm, a variation coefficient of grain distribution of 0.08 and a silver chloride content of 99.5 mole %. Besides, a monodisperse cubic emulsion EMP-3B was prepared which had an average grain diameter of 0.38 μm, a variation coefficient of grain distribution of 0.08 and a silver chloride content of 99.5 mole %.

EMP-3 was optimally subjected to chemical sensitization at 60° C. using the following compounds. Besides, EMP-2B was optimally subjected to chemical sensitization in a similar manner. Thus sensitized emulsions EMP-3 and EMP-3B were mixed with together in a ratio of 1:1 in the silver amount. Thus green-sensitive silver halide emulsion Em-R was obtained.

| | |
|---|---|
| Sodium thiosulfite | 1.8 mg/mole of AgX |
| Chlorauric acid | 2.0 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye RS-1 | $1 \times 10^{-4}$ moles/mole of AgX |
| Sensitizing dye RS-2 | $1 \times 10^{-4}$ moles/mole of AgX |

STAB-1: 1-(3-acetoamidophenyl)-5-mercaptotetrazole
STAB-2: 1-phenyl-5-mercaptotetrazole
STAB-3: 1-(4-ethoxyphenyl)-5-mercaptotetrazole Compound SS-1 was added to the red-sensitive emulsion in an amount of $2.0 \times 10^{-3}$ moles per mole of silver halide.

BS-1

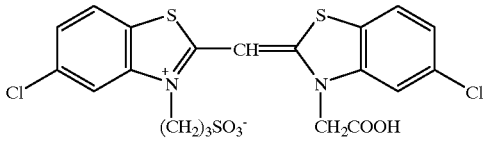

BS-2

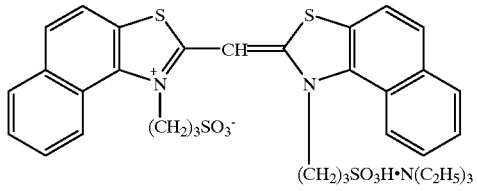

GS-1

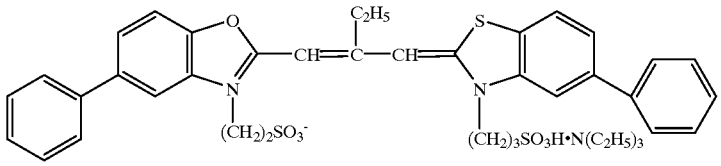

-continued

RS-1

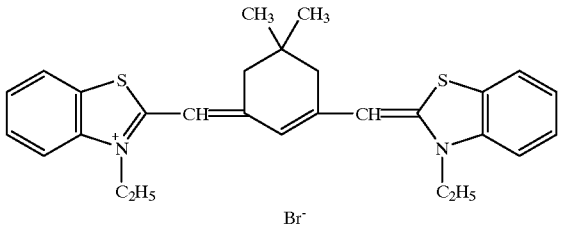

RS-2

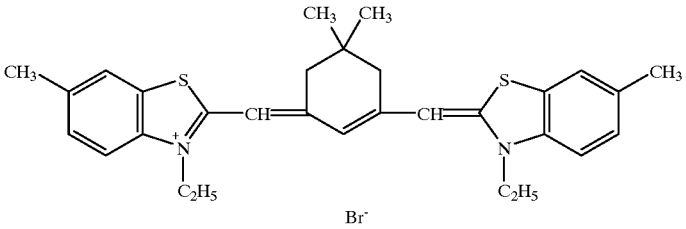

SS-1

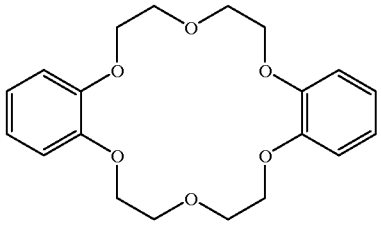

Thus prepared sample is called as Sample 101. Similar samples were prepared in the same manner as in Sample 101, except that change was made as shown in Table 3.

The resulting Samples were exposed to green light through a wedge in an ordinary method and were then processed according to the following steps, then gradation γ and minimum density Dmin were measured. Besides, employing samples stored for 6 days at high temperature condition (55° C.) before exposure the same evaluation was conducted. Change caused by high temperature storage in gradation Δγ and minimum density ΔDmin were evaluated.

$$\Delta\gamma=|\gamma \text{ after storage}-\gamma \text{ before storage}|$$

$$\Delta Dmin=|Dmin \text{ after storage}-Dmin \text{ before storage}|$$

The gradation γ is reciprocal value of difference of logarithm value of exposure amount necessary to obtain density 0.8 and 1.8 respectively.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30° C. to 34° C. | 90 sec. |
| Drying | 60° C. to 80° C. | 60 sec. |

The compositions of the processing liquids used in each of the processing steps were as follows. The replenishing rate of each processing liquid was 80 cc per $m^2$ of the photographic material.

Color developer:

| | Tank soln. | Replen-isher |
|---|---|---|
| Water | 800 cc | 800 cc |
| Triethanol amine | 10 g | 18 g |
| N,N-diethyl hydroxylamine | 5 g | 9 g |
| Potassium chloride | 2.4 g | — |
| 1-Hydroxyethylidene-1,1-diphosphonic acid | 1.0 g | 1.8 g |
| 3-Methyl-4-amino-N-ethyl-N-(β-methane sulfonamido ethyl) aniline | 5.4 g | 8.2 g |
| Fluorescent whitening agent (4,4'-diamino stilbene sulfonic acid derivative) | 1.0 g | 1.8 g |
| Potassium carbonate | 27 g | 27 g |
| Add water to make in total of | 1 l | |

The pH of the tank liquid and replenisher were adjusted to 10.10 and 10.60, respectively.

Bleach-fixer:

(A tank liquid and replenisher were the same.)

| | |
|---|---|
| Ferric ammonium ethylenediamine tetraacetate, dihydrate | 60 g |
| Ethylenediamine tetraacetic acid | 3 g |
| Ammonium thiosulfate (in an aqueous 70% liquid) | 100 cc |
| Ammonium sulfite (in an aqueous 40% liquid) | 27.5 cc |
| Add water to make in total of | 1 l |
| Adjust pH with potassium carbonate or glacial acetic acid to be | 5.7 |

Stabilizer:

(A tank liquid and replenisher ere the same.)

| | |
|---|---|
| F-1 (5-Chloro-2-methyl-4-isothiazoline-3-one) | 1.0 g |
| Ethylene glycol | 1.0 g |
| 1-Hydroxyethylidene-1,1-diphoshonic acid | 2.0 g |
| Ethylenediamine tetraacetic acid | 1.0 g |
| Ammonium hydroxide (in an aqueous 20% liquid) | 3.0 g |
| Fluorescent whitening agent (4,4'-diamino stilbene sulfonic acid derivative) | 1.5 g |
| Add water to make in total of | 1 l |
| Adjust pH with sulfuric acid or potassium hydroxide to be | 7.0 |

Results thereof are shown in Table 3.

As can be seen from Table 3, the use of magenta couplers of the invention led to markedly improved results in light fastness, as compared to comparative couplers. In addition, the use of the inventive coupler in combination with the dye image stabilizer led to further enhanced results.

Example 1

Samples 201 to 214 were prepared in the same way as Referential Example, except that the yellow coupler Y-1 in the first layer and the magenta coupler MM-1 were replaced by the same mole of couplers shown in Table 4.

The samples were exposed wedgewise to white light according to usual way, then processed by the processing steps described in Referential Example. Gradation balance (γB/γG) of Gradation to blue light (γB) to gradation to green light (γG) was estimated for the samples just after the

TABLE 3

| Sample No. | Magenta coupler in 3rd layer | Amount of the magenta coupler (mmol/m$^2$) | Amount of silver in 3rd layer (Converted in silver amount) | Molar ratio of silver halide to magenta coupler in 3rd layer ($M_A/M_C$) | γ | $D_{min}$ | Δγ | $\Delta D_{min}$ |
|---|---|---|---|---|---|---|---|---|
| 101 | MM-1 | 0.402 | 1.205 | 3.00 | 3.10 | 0.028 | 0.34 | 0.007 |
| 102 | MM-1 | 0.390 | 1.242 | 3.18 | 3.12 | 0.027 | 0.31 | 0.011 |
| 103 | MM-1 | 0.378 | 1.281 | 3.39 | 3.14 | 0.029 | 0.28 | 0.015 |
| 104 | MM-1 | 0.367 | 1.320 | 3.60 | 3.21 | 0.030 | 0.24 | 0.017 |
| 105 | MM-1 | 0.356 | 1.361 | 3.82 | 3.22 | 0.032 | 0.21 | 0.018 |
| 106 | MM-2 | 0.378 | 1.281 | 3.39 | 3.28 | 0.030 | 0.26 | 0.014 |
| 107 | MM-3 | 0.378 | 1.281 | 3.39 | 3.07 | 0.026 | 0.25 | 0.013 |
| 108 | M-2 | 0.402 | 1.205 | 3.00 | 3.02 | 0.024 | 0.32 | 0.008 |
| 109 | M-2 | 0.390 | 1.242 | 3.18 | 3.07 | 0.026 | 0.19 | 0.008 |
| 110 | M-2 | 0.378 | 1.281 | 3.39 | 3.14 | 0.023 | 0.17 | 0.009 |
| 111 | M-2 | 0.367 | 1.320 | 3.60 | 3.12 | 0.027 | 0.19 | 0.010 |
| 112 | M-2 | 0.356 | 1.361 | 3.82 | 3.09 | 0.026 | 0.26 | 0.016 |
| 113 | M-41 | 0.402 | 1.205 | 3.00 | 3.23 | 0.027 | 0.30 | 0.006 |
| 114 | M-41 | 0.390 | 1.242 | 3.18 | 3.27 | 0.024 | 0.15 | 0.005 |
| 115 | M-41 | 0.378 | 1.281 | 3.39 | 3.30 | 0.028 | 0.12 | 0.004 |
| 116 | M-41 | 0.367 | 1.320 | 3.60 | 3.29 | 0.029 | 0.14 | 0.006 |
| 117 | M-41 | 0.356 | 1.361 | 3.82 | 3.34 | 0.030 | 0.23 | 0.013 |
| 118 | M-16 | 0.378 | 1.281 | 3.39 | 2.74 | 0.025 | 0.16 | 0.008 |
| 119 | M-39 | 0.378 | 1.281 | 3.39 | 3.28 | 0.027 | 0.11 | 0.005 |
| 120 | M-51 | 0.378 | 1.281 | 3.39 | 3.15 | 0.025 | 0.12 | 0.005 |

MM-2

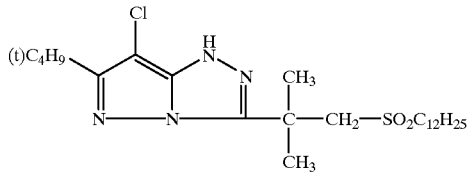

MM-3

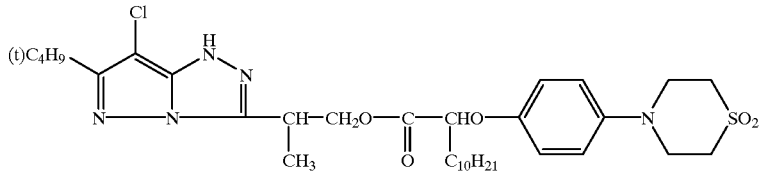

starting of running processing and after running processing which the developer was replenished in amount of two times of tank volume of developer. The result is summarized in Table 4.

TABLE 4

| Sample No. | Yellow coupler in the 1st layer | Magenta coupler in the 3rd layer | γB/γG Starting | γB/γG After running processing | Δ (γB/γG) % |
|---|---|---|---|---|---|
| 101 (Comp.) | Y-1 | MM-1 | 95 | 87 | −8 |
| 201 (Comp.) | Y-2 | MM-1 | 98 | 91 | −7 |
| 202 (Comp.) | Y-3 | MM-1 | 94 | 84 | −10 |
| 203 (Comp.) | (19) | MM-1 | 101 | 107 | +6 |
| 204 (Comp.) | (24) | MM-1 | 99 | 105 | +6 |
| 205 (Comp.) | (24) | MM-2 | 96 | 102 | +6 |
| 206 (Comp.) | (24) | MM-3 | 95 | 103 | +8 |
| 207 (Comp.) | Y-1 | M-28 | 93 | 81 | −12 |
| 208 (Comp.) | Y-2 | M-28 | 95 | 84 | −11 |
| 209 (Comp.) | Y-3 | M-28 | 91 | 78 | −13 |
| 210 (Inv.) | (19) | M-28 | 100 | 99 | −1 |
| 211 (Inv.) | (24) | M-28 | 98 | 100 | +2 |
| 212 (Inv.) | (23) | M-2 | 96 | 99 | +3 |
| 213 (Inv.) | (26) | M-51 | 95 | 96 | +1 |
| 214 (Inv.) | (31) | M-57 | 97 | 95 | −2 |

Y-2

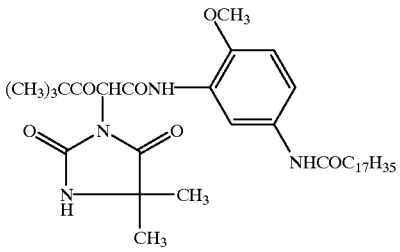

Y-3

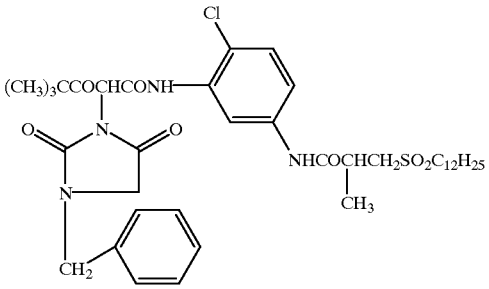

Samples in combination of a magenta coupler of the invention and a yellow coupler of the invention according to claim 2 of the present invention displays small change of gradation balance and an excellent sample shown in Table 4.

Example 2

Samples 301 to 318 were prepared in the same manner as Sample 204 except that the yellow coupler (24) in the 1st layer and the magenta coupler MM-1 in the third layer were replaced by the same mol of couplers shown in Table 5, and, compound represented by formula (A) and/or water insoluble and organic solvent soluble polymer compounds were added in the 1st layer. Samples were exposed wedge-wise to white light in usual way, and were processed according to processing steps of Referential Example. Processed samples were stored under sun light for two months, then the residual dye ratio at the initial blue, green and red density of 1.0 respectively were measured.

Change of color balance after storage was estimated by eye view and the residual ratio of the dyes.

Criteria of the estimate

D: Bad color balance

C: Slightly bad color balance

B: Good color balance (Bright)

A: Excellent in color balance (Particularly bright)

The result is shown in Table 5.

TABLE 5

| Sample No. | Yellow coupler in 1st layer | Compound (A-1) in 1st layer | Polymer in 1st layer | Magenta coupler in 3rd layer | Stability against light B* | G* | R* | Color balance after storage |
|---|---|---|---|---|---|---|---|---|
| 204 | (24) | — | — | MM-1 | 61 | 55 | 76 | D |
| 301 | (24) | A-28 (0.20) | — | MM-1 | 75 | 59 | 79 | D |
| 302 | (24) | — | PO-1 (0.20) | MM-1 | 70 | 58 | 78 | D |
| 303 | (24) | A-28 (0.10) | PO-1 (0.10) | MM-1 | 78 | 60 | 81 | D |
| 304 | (24) | — | — | M-2 | 66 | 74 | 78 | C |
| 305 | (24) | A-2 (0.20) | — | M-2 | 76 | 76 | 80 | B |
| 306 | (24) | A-25 (0.20) | — | M-2 | 75 | 77 | 80 | B |
| 307 | (24) | A-28 (0.20) | — | M-2 | 77 | 79 | 82 | B |
| 308 | (24) | — | PO-1 (0.20) | M-2 | 76 | 76 | 81 | B |
| 309 | (24) | — | PO-2 (0.20) | M-2 | 74 | 74 | 79 | C |
| 310 | (24) | A-2 (0.10) | PO-1 (0.10) | M-2 | 83 | 81 | 85 | B |
| 311 | (24) | A-25 (0.10) | PO-2 (0.10) | M-2 | 81 | 81 | 84 | B |
| 312 | (24) | A-28 (0.10) | PO-1 (0.10) | M-2 | 85 | 83 | 87 | B |
| 313 | (29) | A-28 (0.20) | — | M-54 | 78 | 85 | 85 | C |
| 314 | (29) | — | PO-7 (0.20) | M-54 | 77 | 85 | 84 | C |
| 315 | (29) | A-28 (0.10) | PO-7 (0.10) | M-54 | 87 | 88 | 89 | A |
| 317 | (26) | A-28 (0.10) | PO-7 (0.10) | M-48 | 88 | 87 | 89 | A |
| 318 | (26) | A-28 (0.10) | PO-7 (0.10) | M-51 | 88 | 87 | 88 | A |

**Value in parenthesis ( ) indicates amount added in g/m$^2$.
B*: B Residual ratio (%)
G*: G residual ratio (%)
R*: R Residual ratio (%)

Y-4

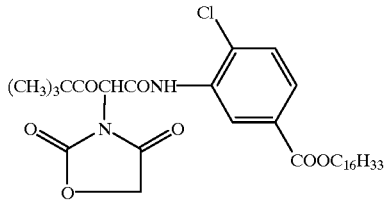

Samples according to claim 3 of the invention all show high residual ratio for blue, green and red dyes, and excellent color balance after storage as demonstrated in Table 5.

Example 3

Samples 303, 312, 316, 317 and 318 prepared in Example 2 were exposed to white light through wedge, then they were processed by two kind of processing A and B. For each sample the reflecting density for green light at 10 points of the maximum density portion of obtained neutral wedge image was measured by X-rite 310 densitometer (product by X-rite Co.), the difference between the maximum and minimum density among the 10 points were estimated as the density variation.

The samples were stored before exposing under the condition of high temperature and high humidity (40 kC, 80% RH) for 7 days, then the samples were exposed and processed in the same. For each sample the gradation γ for green light of obtained neutral wedge image (reciprocal value of the difference of logarithm of exposure light necessary to obtain density of 0.8 and 1.8) was measured, difference of gradation γy before and after storage of unexposed samples.

$$\Delta\gamma = |\gamma \text{ of stored sample} - \gamma \text{ of fresh sample}|$$

Processing A: Running processing according to CPK 2-J1, employing processing machine NPS-868J, product of Konica Corporation with processing chemical ECOJET-P, processing time being 10 seconds.

Apparatus

FIG. 1 shows schematic view of primary part of the developing machine. Heating means 10 is placed at the upper stream of conveying path of thee silver halide photographic light sensitive material P to be processed by processing composition. The heating means 10 includes a heating drum 11. Outlet roller 12 is placed below the heating drum 12. Entrance roller 13 is placed at the left of the outlet roller 12. Driving roller 14 for pressure belt is placed at the left of the outlet roller 12 and over the entrance roller 13. The pressure belt 15 is extended along with outlet roller 12, the entrance roller 13 and driving roller 14. The belt conveys the light sensitive material pressing the surface of the light sensitive material, as the belt is driven being pressed against the heating drum 11 for range of 90° of the peripheral of the heating drum 11. Light sensitive material P is heated.

Processing composition coating means 20 is placed at the down stream side of the conveying path of the light sensitive material P with reference to the heating drum 11. The Processing composition coating means 20 comprises a processing composition container 25 which contains the first processing composition (a) of the light sensitive material P. Processing composition container 25 is flexible and sealed to outer air. A coater having slit is employed as a processing supplying means 26. According to this, the processing composition supplying means supplies the first processing composition (a) to the emulsion surface of the light sensitive material heated by heating means 10.

Subsequently, the second processing composition (b) is supplied to the emulsion surface of the light sensitive material in the similar way employing a coater having slit as the processing composition supplying means 28. The second processing composition (b) is supplied 0.5 seconds after the first processing composition (a) is supplied.

A heating device 30 is placed from the upstream to down stream of the processing composition supplying means 16, and 28, which supply the first processing composition and the second processing composition respectively. The second heating means 30 comprises a heating roller 31, a driving roller 32 and a heating belt 33. The heating belt 33 is extended along with the heating roller 31 and driving roller 32. The heating roller 31 heats the driving belt 33 and is placed at the upper stream side of conveying path of the light sensitive material with reference to the processing supplying means 26 and 28 which supply processing compositions. Driving roller 32 is placed at the lower stream side of conveying path of light sensitive material P and drives the heating. According to this, the heating belt 33 under heated condition heats the light sensitive material P. The processing composition supplying means 26 and 28 supplies the processing composition on the emulsion surface of the silver halide photographic light sensitive material subjected to heating. The second heating means 30 heats the silver halide photographic light sensitive material on whose emulsion surface the processing composition is supplied by the processing composition supplying means 26 and 28.

The light sensitive material P which has been subjected to color development processing by processing composition supplying means 26 and 28, is subjected to bleach-fixing processing in a bleach-fixing tank BF, and is subjected to stabilization processing in the stabilizing tank ST.

Figure 2:
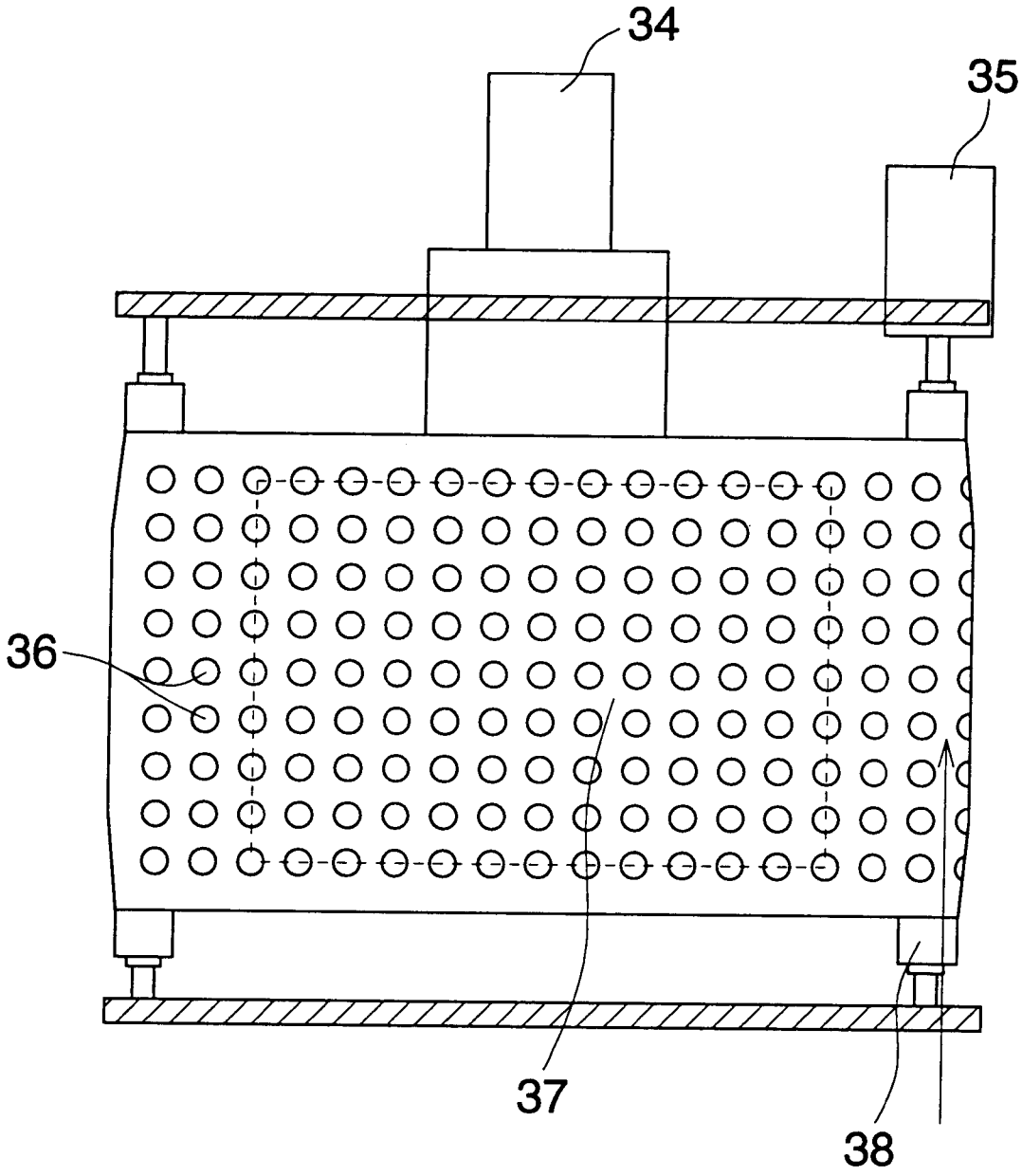
FIG. 2 Outline of the second heating means 30.

FIG. 2 illustrates the schematic view of second heating means 30. By means of unction pump 34 the light sensitive material P is pressed by suction to the heating belt 37 having pores of 5 mm diameter provided 15 mm distance. Area heater is mounted in the heating belt 37, and the light sensitive material is heated at predetermined temperature. The heating belt 37 is driven by driving motor 35. Number 36 indicates suction opening, and 38 heating roller.

Heating Condition

The emulsion surface of the light sensitive material is heated to 80° C. by the heating drum 11 whose surface temperature is 80° C.

Heating Condition (second)

The emulsion surface of the light sensitive material is heated from the back side to keep at 80° C. by means of the heating belt 37 whose surface temperature is 80° C.

Supplying Head

Figure 3:
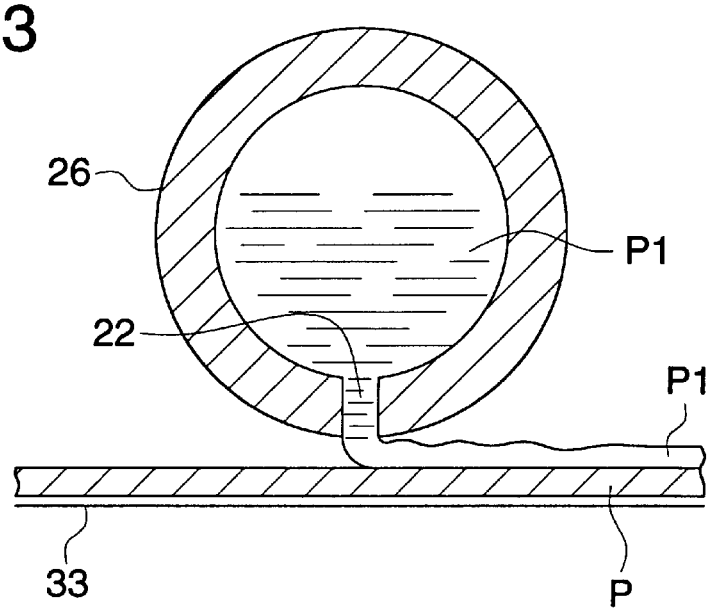
FIG. 3 Sectional view of an example of a coater head having slit.
Figure 3:
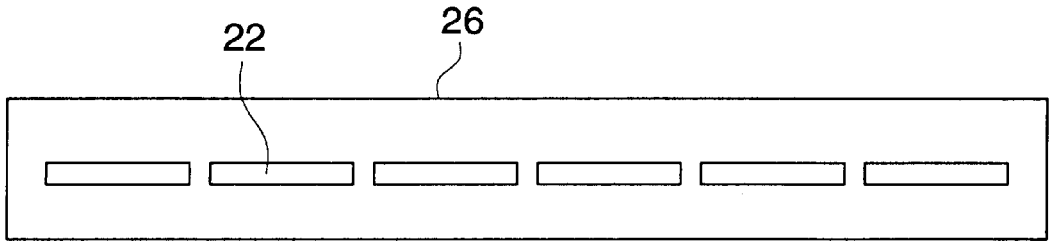
Figure 3:
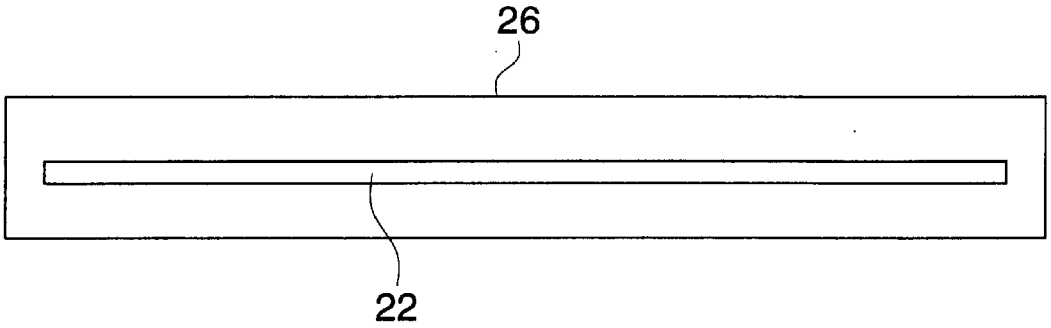

Supplying head of coater having slit is employed. FIG. 3, FIG. 2*a* and FIG. 2*b* illustrate the sectional view of examples of coater head. Numeral 26 shows a processing composition supplying means. Processing composition is shown by P1, heating belt, 33, and the second heating means 30. The supplying means is placed perpendicular to the conveying direction of the light sensitive material. Width of processing composition supplying opening 22 is 220 μm, edge to edge distance from closest supplying opening.

Supplying amount of processing compositions (a) and (b) are each 20 ml, total 40 ml per 1 m2 of the silver halide photographic light sensitive material.

Component Of Processing Compositions a and b (Per 1 liter)

First Composition (a)

| | |
|---|---|
| Water | 500 ml |
| Sodium sulfite | 1.0 g |
| Diethylenetriamine penta acetic acid 5 sodium | 3.0 g |
| p-Toluensulfonic acid | 20.0 g |
| 4-Amino-3-methyl-N-ethyl-N-(__-methane sulfonamido ethyl) aniline sulfuric acid salt | 43.0 g |

Water is added to make 1 l, and pH is adjusted to 2.0 by using potassium hydroxide or 50% sulfuric acid.

Second Composition (b)

| | |
|---|---|
| Water | 500 ml |
| Potassium chloride | 10.0 g |
| Diethylenetriamine penta acetic acid 5 sodium | 3.0 g |
| Potassium carbonate | 82.0 g |
| p-Toluensulfonic acid | 15.0 g |

Water is added to make 1 l, and pH is adjusted to 13.5 by using potassium hydroxide or 50% sulfuric acid.

Bleach-Fixing Stabilization Process

The processing was made by employing processing composition for CPK-2-28 Konica Corporation in the following procedure.

| Processing step | Time | Temperature | Replenishing amount (per 1 $m^2$) |
|---|---|---|---|
| Color developing (CD) | 10 sec. | 80° C. | 40 ml |
| Bleach-fixing (BF) | 28 sec. | 38° C. | 100 ml |
| Stabilizing (ST) | 10 sec. × 3 | 38° C. | 248 ml |
| Drying (Dry) | 20 sec. | 40 to 80° C. | |

Stabilizing was conducted by 3-tank counter current method.

The result is summarized in Table 6.

TABLE 6

| Sample No. | Magenta coupler in 3rd layer | Processing | Density unevenness | Δγ |
|---|---|---|---|---|
| 303 | MM-1 | A | 0.031 | 0.18 |
| 303 | MM-1 | B | 0.017 | 0.38 |
| 312 | M-2 | A | 0.029 | 0.17 |
| 312 | M-2 | B | 0.015 | 0.19 |
| 316 | M-16 | A | 0.028 | 0.16 |
| 316 | M-16 | B | 0.016 | 0.18 |
| 317 | M-48 | A | 0.030 | 0.15 |
| 317 | M-48 | B | 0.012 | 0.13 |
| 318 | M-51 | A | 0.029 | 0.16 |
| 318 | M-51 | B | 0.012 | 0.14 |

Table 6 clearly shows in case that samples containing a magenta coupler of the invention is processed by a method which the processing compound is coated, as claimed in one of claims 4 to 9, density unevenness is small and gradation change due to storage is small.

Example 4

For the same samples employed in Example 3, processing B in Example 3 was conducted to the both samples before and after storage under the condition of high temperature and high humidity before exposure, except that the heating condition and second heating condition were varied at 30° C., 50° C. and 70° C. Maximum reflect density for green light Dmax, unevenness and increased range of minimum reflect density for green light after storage of unexposed sample ΔDmin.

The result is summarized in Table 7.

TABLE 7

| Sample No. | Magenta coupler in 3rd layer | Processing | Temp. (° C.) | Dmax | Density uneven-ness | ΔDmin |
|---|---|---|---|---|---|---|
| 303 | MM-1 | B | 30 | 2.31 | 0.026 | 0.008 |
| 303 | MM-1 | B | 50 | 2.35 | 0.21 | 0.018 |
| 303 | MM-1 | B | 70 | 2.38 | 0.18 | 0.029 |
| 312 | M-2 | B | 30 | 2.28 | 0.25 | 0.009 |
| 312 | M-2 | B | 50 | 2.32 | 0.19 | 0.012 |
| 312 | M-2 | B | 70 | 2.35 | 0.17 | 0.014 |
| 316 | M-16 | B | 30 | 2.10 | 0.24 | 0.010 |
| 316 | M-16 | B | 50 | 2.14 | 0.19 | 0.012 |
| 316 | M-16 | B | 70 | 2.16 | 0.17 | 0.015 |
| 317 | M-48 | B | 30 | 2.34 | 0.27 | 0.008 |
| 317 | M-48 | B | 50 | 2.38 | 0.18 | 0.009 |
| 317 | M-48 | B | 70 | 2.40 | 0.14 | 0.012 |
| 318 | M-51 | B | 30 | 2.33 | 0.24 | 0.007 |
| 318 | M-51 | B | 50 | 2.37 | 0.16 | 0.008 |
| 318 | M-51 | B | 70 | 2.38 | 0.13 | 0.010 |

Table 7 clearly shows in case that samples containing a magenta coupler of the invention is processed by a method of the present invention in which the sample is heated not less than 40° C. before developing process, as claimed in claim 10, high maximum density is obtained and density unevenness is small and increase of minimum density due to storage of unexposed sample is small.

Example 5

Similar evaluation as Example 3 was repeated except that processing composition supplying head employed in Example 3 was replaced by array style piezo method ink-jet type supplying head which supplies the processing composition through air phase.

Processing composition in each processing containers (a) and (b) is the same as Example 3.

Each of processing composition of bleach-fixing and stabilizing is the same as Example 3.

The light sensitive materials are the same as Example 3.

In the image forming method of the invention which is a combination of specified light sensitive material with processing method as claimed in one of claims 4 to 10, the effect of the invention, adaptability to rapid processing, low density unevenness and low gradation change after storage of unexposed sample, is observed as shown in Example 3.

The silver halide photographic light sensitive material and an image forming method using it have excellent advantage as image stability of the obtained image when exposed to light, stability of property after long time storage at unexposed status, stability of property against change of processing condition, adaptability to rapid processing and low unevenness of formed image as demonstrated Examples described above.

Advantage of the invention

The invention provides a silver halide photographic light sensitive material excellent in color reproduction and improved in storability of the obtained image particularly image stability against light exposure, a silver halide photographic light sensitive material having improved stable quality such as stability of property stored unexposed status and stability against change of processing condition as well as an image forming method using it, and a a silver halide photographic light sensitive material having excellent adaptability to rapid processing as well as an image forming method using it.

What is claimed is:

1. A silver halide photographic light-sensitive material having an emulsion layer containing a yellow dye forming coupler, an emulsion layer containing a magenta dye forming coupler and an emulsion layer containing a cyan, dye forming coupler provided on a support, wherein the magenta dye forming coupler is represented by formula (M-1) or (M-1'), and the yellow dye forming coupler is represented by formula (Y-1), (M-1)

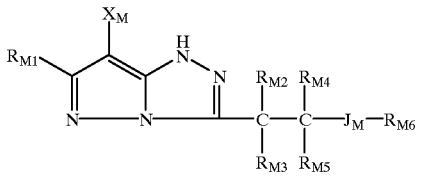

(M-1')

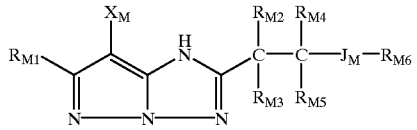

wherein $R_{M1}$ represents a hydrogen atom or a substituent, $R_{M2}$ and $R_{M3}$ represent an alkyl group, and $R_{M4}$ and $R_{M5}$ represent a hydrogen atom or alkyl group, $J_M$ represents —O—C(=O)—, —$NR_{M7}$CO— or —$NR_{M7}SO_2$—, and $R_{M7}$ represents a hydrogen atom or alkyl group, $R_{M6}$ represents an alkyl, aryl, alkoxy, aryloxy, alkylamino or arylamino group, $X_M$ represents a hydrogen atom, halogen atom or a group capable of splitting off by reaction with oxidation product of color developing agent, (Y-1)

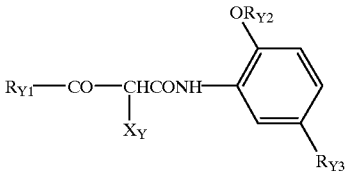

wherein $R_{Y1}$ represents an aliphatic group or an aromatic group, $R_{Y2}$ represents a non-diffusible aliphatic or aromatic group, $R_{Y3}$ represents a hydrogen or a halogen atom and $X_Y$ represents a 5- or 6-member nitrogen containing heterocyclic group splitting off when coupled with an oxidation product of a developing agent.

2. The silver halide photographic light sensitive material of claim 1, wherein the emulsion layer containing a yellow dye forming coupler comprises a water-insoluble and organic solvent-soluble polymer.

3. The silver halide photographic light sensitive material of claim 1, wherein number average molecular weight is not more than 200,000.

4. The silver halide photographic light sensitive material of claim 1, wherein number average molecular weight is 5,000 to 100,000.

5. The silver halide photographic light sensitive material of claim 2, wherein the emulsion layer containing a yellow dye forming coupler comprises a compound represented by a formula (A-1), (A-1)

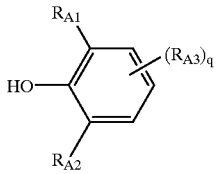

wherein $R_{A1}$ represents a secondary or tertiary alkyl group, $R_{A2}$ represents an alkyl group, $R_{A3}$ represents a group capable of substituting to the benzene ring, q is an integer of 0 to 3, and plural of $R_{A3}$ may be the same or different when q is 2 or more.

6. The silver halide photographic light sensitive material of claim 1, wherein a molar ratio MA/MC of silver halide and the magenta dye forming coupler in the silver halide emulsion layer containing the magenta dye forming coupler is 3.1 to 3.7 wherein MA is mols per unit area of silver halide in the silver halide emulsion layer, and MC is mols per unit area of the magenta dye forming coupler in the silver halide emulsion layer.

* * * * *